US011986874B2

(12) United States Patent
Ono et al.

(10) Patent No.: US 11,986,874 B2
(45) Date of Patent: May 21, 2024

(54) METHOD OF MANUFACTURING PRESS-FORMED ARTICLE, PRESS-FORMED ARTICLE, AND PRESS FORMING APPARATUS

(71) Applicant: NIPPON STEEL CORPORATION, Tokyo (JP)

(72) Inventors: Atsushi Ono, Tokyo (JP); Yoshiaki Nakazawa, Tokyo (JP); Satoshi Shirakami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 326 days.

(21) Appl. No.: 17/632,502

(22) PCT Filed: Aug. 5, 2020

(86) PCT No.: PCT/JP2020/030076
§ 371 (c)(1),
(2) Date: Feb. 2, 2022

(87) PCT Pub. No.: WO2021/025083
PCT Pub. Date: Feb. 11, 2021

(65) Prior Publication Data

US 2022/0280992 A1 Sep. 8, 2022

(30) Foreign Application Priority Data

Aug. 5, 2019 (JP) ..... 2019-143704
Dec. 20, 2019 (JP) ..... 2019-230803

(51) Int. Cl.
*B21D 22/06* (2006.01)
*B21D 3/10* (2006.01)
(Continued)

(52) U.S. Cl.
CPC ..... *B21D 22/26* (2013.01); *B21D 22/22* (2013.01); *B21D 24/04* (2013.01); *B21D 22/06* (2013.01)

(58) Field of Classification Search
CPC ..... B21D 22/26; B21D 22/22; B21D 22/06; B21D 22/20; B21D 22/30; B21D 24/04;
(Continued)

(56) References Cited

U.S. PATENT DOCUMENTS 5,921,618 A * 7/1999 Mori ..... B62D 25/2036 296/203.03
2011/0210582 A1* 9/2011 Mori ..... B62D 25/2036 296/193.07
(Continued)

FOREIGN PATENT DOCUMENTS

EP 3037188 A1 6/2016
JP H0332989 A * 2/1991
(Continued)

OTHER PUBLICATIONS

English translate (JPH0332989A), retrieved date Feb. 5, 2024.*

*Primary Examiner* — Matthew Katcoff
*Assistant Examiner* — Mohammed S. Alawadi
(74) *Attorney, Agent, or Firm* — SOLARIS Intellectual Property Group, PLLC

(57) ABSTRACT

A method of manufacturing a press-formed article includes first press forming and second press forming. In the first press forming, an intermediate formed article is formed from a metal sheet by subjecting the metal sheet to processing including performing draw-forming on the metal sheet to form a peripheral wall portion, bending the metal sheet to form a convex flange portion, and bending the metal sheet to form at least a side standing flange main body portion of a side standing flange portion and a floor flange main body portion of a floor flange portion. The second press forming
(Continued)

includes bending the intermediate formed article to form the convex flange portion to an inclined flange portion.

10 Claims, 68 Drawing Sheets

(51) Int. Cl.

| | |
|---|---|
| ***B21D 19/08*** | (2006.01) |
| ***B21D 22/22*** | (2006.01) |
| ***B21D 22/26*** | (2006.01) |
| ***B21D 24/00*** | (2006.01) |
| ***B21D 24/04*** | (2006.01) |
| ***B21D 35/00*** | (2006.01) |

(58) Field of Classification Search
CPC ..... B21D 24/005; B21D 3/10; B21D 19/08; B21D 35/002
See application file for complete search history.

(56) References Cited

U.S. PATENT DOCUMENTS

| | | | |
|---|---|---|---|
| 2015/0061323 | A1 | 3/2015 | Otsuka et al. |
| 2015/0174634 | A1 | 6/2015 | Nishimura et al. |
| 2015/0367392 | A1 | 12/2015 | Nishimura et al. |
| 2017/0008573 | A1 | 1/2017 | Otsuka et al. |
| 2019/0185070 | A1 | 6/2019 | Ito |

FOREIGN PATENT DOCUMENTS

| | | | |
|---|---|---|---|
| JP | 2007-029966 | A | 2/2007 |
| JP | 5569661 | B2 | 8/2014 |
| JP | 2015-081036 | A | 4/2015 |
| JP | 5958644 | B2 | 8/2016 |
| JP | 6265315 | B1 | 1/2018 |
| WO | 2013/154114 | A1 | 10/2013 |
| WO | 2015/133531 | A1 | 9/2015 |
| WO | 2018/034104 | A1 | 2/2018 |

* cited by examiner

METHOD OF MANUFACTURING PRESS-FORMED ARTICLE, PRESS-FORMED ARTICLE, AND PRESS FORMING APPARATUS

TECHNICAL FIELD

The present disclosure relates to a method of manufacturing a press-formed article, a press-formed article, and a press forming apparatus.

BACKGROUND ART

In a structure including a plurality of members, a structural member having a predetermined shape is used to connect the plurality of members. The structural member is required to transmit a load between members. Therefore, a flange that is erected from a standing wall of the structural member and attached in surface contact with another member may be provided.

Examples of the structural member include a so-called saddle-shaped member. In the saddle-shaped member, a floor flange portion and a standing flange portion erected from the standing wall are in surface contact with other members. In particular, the saddle-shaped member may have a continuous flange in which the floor flange portion and the standing flange portion are continuous in order to improve load transfer capability. For example, Patent Document 1 (International Publication WO 2013/154114), Patent Document 2 (Japanese Patent No. 5958644), Patent Document 3 (Japanese Patent No. 5569661), and Patent Document 4 (Japanese Patent No. 6265315) describe that a saddle-shaped floor cross member connecting a side sill and a floor panel has a continuous flange in a vehicle body lower structure of an automobile.

SUMMARY OF INVENTION

Technical Problem

As another example of a structural member for connecting the members, there is a structural member having a so-called bag-shaped portion in which standing walls are formed on three sides of the top sheet. As illustrated in FIG. 39A, in a structural member 10 having the bag-shaped portion, a peripheral wall portion 13 is formed from three peripheral edge portions of a top sheet portion 11. A floor flange portion 15 extends from a lower end of the peripheral wall portion 13 in a vertical direction (Z direction illustrated in FIG. 39A). Further, a side standing flange portion 17 extends from a circumferential end portion of the peripheral wall portion 13.

As illustrated in FIG. 39B, the floor flange portion 15 of the structural member 10 is mounted in surface contact with a top sheet 21 of one member 20. Further, the side standing flange portion 17 is attached in surface contact with a standing wall 31 of another member 30. As a result, one member 20 and the other member 30 are connected by the structural member 10, and a load is transmitted.

Here, as illustrated in FIG. 39A, in the conventional structural member 10 having a bag-shaped portion, the floor flange portion 15 and the side standing flange portion 17 are not continuous, and a notch 19 is formed. As a reason for this, conventionally, in a case where a structural member having a bag-shaped portion is formed, when an attempt is made to form a continuous flange using draw-forming, wrinkles are intensively generated at a portion between the floor flange portion 15 and the side standing flange portion 17, which may cause problems such as poor appearance. In this regard, in the structural member 10 having the notch 19, problems of the wrinkles do not occur, but there is a room for improvement in load transfer capability and rigidity.

Therefore, in order to improve the load transfer capability and rigidity in the structural member having the bag-shaped portion, it is required to realize a continuous flange like a saddle-shaped structural member. Here, in order to avoid the above-described problem of wrinkles in the continuous flange caused by draw-forming, it is also conceivable to form the standing wall portion and the flange portion using bending press forming as described in Patent Document 4, for example.

However, in the technique described in Patent Document 4, a portion corresponding to the floor flange portion is formed in advance, and the standing wall portion is bent from the top sheet portion (refer to Patent Document 4, FIG. 28). Therefore, there is a problem that a blank edge portion necessary for draw-forming the bag-shaped portion cannot be sandwiched, and the technique cannot realize a press-formed article of a continuous flange having the bag-shaped portion.

Therefore, the present disclosure has been made in view of the above problems, and an object of the present disclosure is to provide a novel and excellent method of manufacturing a press-formed article, a press-formed article, and a press forming apparatus capable of suppressing concentration of wrinkles generated at a portion between a floor flange portion and a side standing flange portion in a press-formed article having a so-called bag-shaped portion.

Solution to Problem

In order to solve the above problem, according to one aspect of the present disclosure, there is provided a method of manufacturing a press-formed article including a top sheet portion, a peripheral wall portion formed along three peripheral edge portions of the top sheet portion and extending from the peripheral edge portions in a direction intersecting an extending direction of the top sheet portion, a floor flange portion extending outward from an end portion of the peripheral wall portion opposite to an end portion continuous with the top sheet portion in a direction intersecting an extending direction of the peripheral wall portion, a side standing flange portion extending outward from a circumferential end portion of the peripheral wall portion, and an inclined flange portion that is an inclined wall continuous between the side standing flange portion and the floor flange portion, the method including: first press forming; and second press forming, in which an intermediate formed article is formed from a metal sheet by subjecting the metal sheet to the first press forming including moving the metal sheet sandwiched between a first holder and a first die relative to a first punch in a state in which a portion of the metal sheet to be the floor flange portion is sandwiched between the first holder and the first die to perform draw-forming on the metal sheet to form the peripheral wall portion, bending the metal sheet by the metal sheet abutting on a first punch protrusion forming portion provided at the first punch to form a convex flange portion having a convex shape formed at the inclined flange portion, and bending the metal sheet by the metal sheet abutting on the first punch to form at least a side standing flange main body portion located on a side opposite to the inclined flange portion with respect to an end portion on the inclined flange portion side of the side standing flange portion and a floor flange main body portion located on a side opposite to the inclined flange portion with respect to an end portion on the inclined flange portion side of the floor flange portion, and the second press forming includes bending the intermediate formed article by a second die and a second punch to form the convex flange portion at the inclined flange portion.

In the method of manufacturing a press-formed article, the press-formed article may further include a central standing flange portion extending from an end portion of the top sheet portion where the peripheral wall portion is not formed in the direction intersecting the extending direction of the top sheet portion and opposite to the extending direction of the peripheral wall portion, the central standing flange portion being continuous with the side standing flange portion, and before the draw-forming is performed in the first press forming, a ridgeline portion between the top sheet portion and the peripheral wall portion on an end portion side where the peripheral wall portion is not formed and a continuous portion between the central standing flange portion and the side standing flange portion may be formed in the metal sheet by a first pad and the first punch.

In the method of manufacturing a press-formed article, the first press forming may include bending the metal sheet to form the convex flange portion having at least one step shape in side view after the first press forming.

In the method of manufacturing a press-formed article, the first press forming may include bending the metal sheet by the metal sheet abutting on the first punch to form the side standing flange portion and the floor flange portion.

In the method of manufacturing a press-formed article, the first press forming may include bending the metal sheet by the metal sheet abutting on the first punch to form the side standing flange main body portion of the side standing flange portion, a first preliminary ridgeline connecting the side standing flange main body portion and the convex flange portion, the floor flange main body of the floor flange portion, and a second preliminary ridgeline connecting the floor flange main body and the convex flange portion, and the second press forming may include at least one of bending the intermediate formed article by the second die and the second punch to form the first preliminary ridgeline into a part of the side standing flange portion or bending the intermediate formed article by the second die and the second punch to form the second preliminary ridgeline into a part of the floor flange portion.

In the method of manufacturing a press-formed article, the second press forming may include bending the first preliminary ridgeline to form a part of the side standing flange portion and bending the second preliminary ridgeline to form a part of the floor flange portion by the second die and the second punch.

In the method of manufacturing a press-formed article, the press-formed article may include an upper flange ridgeline formed between the inclined flange portion and the side standing flange portion and a lower flange ridgeline formed between the inclined flange portion and the floor flange portion, and in the first press forming, at least one of a portion to be the upper flange ridgeline or a portion to be the lower flange ridgeline may be formed into a flat shape in the convex flange portion.

In order to solve the above problem, according to another aspect of the present disclosure, there is provided a press-formed article including: a top sheet portion; a peripheral wall portion formed along three peripheral edge portions of the top sheet portion and extending from the peripheral edge portions in a direction intersecting an extending direction of the top sheet portion; a floor flange portion extending outward from an end portion of the peripheral wall portion opposite to an end portion continuous with the top sheet portion in a direction intersecting an extending direction of the peripheral wall portion; a side standing flange portion extending outward from a circumferential end portion of the peripheral wall portion; and an inclined flange portion that is an inclined wall continuous between the side standing flange portion and the floor flange portion.

In the press-formed article, a flange including the floor flange portion, the side standing flange portion, and the inclined flange portion and formed around the press-formed article may be continuous over an entire periphery of the press-formed article.

In the press-formed article, a line length of the inclined flange portion in a side view may be from 10% to 70% of a distance between the top sheet portion and the floor flange portion.

In order to solve the above problem, according to still another aspect of the present disclosure, there is provided a press forming apparatus for obtaining a press-formed article including a top sheet portion, a peripheral wall portion formed along three peripheral edge portions of the top sheet portion and extending from the peripheral edge portions in a direction intersecting an extending direction of the top sheet portion, a floor flange portion extending outward from an end portion of the peripheral wall portion opposite to an end portion continuous with the top sheet portion in a direction intersecting an extending direction of the peripheral wall portion, a side standing flange portion extending outward from a circumferential end portion of the peripheral wall portion, and an inclined flange portion that is an inclined wall continuous between the side standing flange portion and the floor flange portion, the press forming apparatus including: a first holder having a portion abutting on a region to be the floor flange portion on one surface of a metal sheet; a first die including a portion abutting on a region to be the floor flange portion on another surface of the metal sheet, a portion sandwiching the metal sheet between the first holder and the first die, and a portion abutting on a region to be the peripheral wall portion of the metal sheet; a first punch, the first punch including a first punch peripheral wall forming portion that abuts on a region to be the peripheral wall portion of the one surface of the metal sheet and performs draw-forming on the metal sheet together with the first die to form the peripheral wall portion, a first punch protrusion forming portion that abuts on a region to be the inclined flange portion of the one surface of the metal sheet and bends the metal sheet together with the first die to form a convex flange portion, a first punch standing flange forming portion that abuts on a region to be the side standing flange portion of the one surface of the metal sheet and bends the metal sheet together with the first die to form at least a side standing flange main body portion located on a side opposite to the inclined flange portion with respect to an end portion of the side standing flange portion on the inclined flange portion side, and a first punch floor flange forming portion that abuts on a region to be the floor flange portion of the one surface of the metal sheet and bends the metal sheet together with the first die to form at least a floor flange main body portion located on a side opposite to the inclined flange portion with respect to an end portion of the floor flange portion on the inclined flange portion side; a second die including an inclined surface abutting on the other surface of the convex flange portion; and a second punch, the second punch including a second punch inclined surface portion which is provided on the one surface side of the convex flange portion and bends the inclined flange portion from the convex flange portion by sandwiching the convex flange portion with the second die.

In the press forming apparatus, the first punch standing flange forming portion may have a shape for bending the side standing flange portion, and the first punch floor flange forming portion may have a shape for bending the floor flange portion.

In the press forming apparatus, the first punch standing flange forming portion may have a shape for bending the metal sheet to form the side standing flange main body portion of the side standing flange portion, and a first preliminary ridgeline connecting the side standing flange main body portion and the convex flange portion, and the first punch floor flange forming portion may have a shape for bending the metal sheet to form the floor flange main body portion of the floor flange portion, and a second preliminary ridgeline connecting the floor flange main body portion and the convex flange portion, and the second punch may include at least one of a first bend-forming portion which forms the first preliminary ridgeline at a part of the side standing flange portion with the second die or a second bend-forming portion which forms the second preliminary ridgeline at a part of the floor flange portion with the second die.

Advantageous Effects of Invention

As described above, according to the present disclosure, there are provided a novel and excellent method of manufacturing a press-formed article, a press-formed article, and a press forming apparatus, which are capable of suppressing concentration of wrinkles generated at a portion between a floor flange portion and a side standing flange portion in a press-formed article having a so-called bag-shaped portion.

DESCRIPTION OF EMBODIMENTS

First Embodiment

Figure 1A:
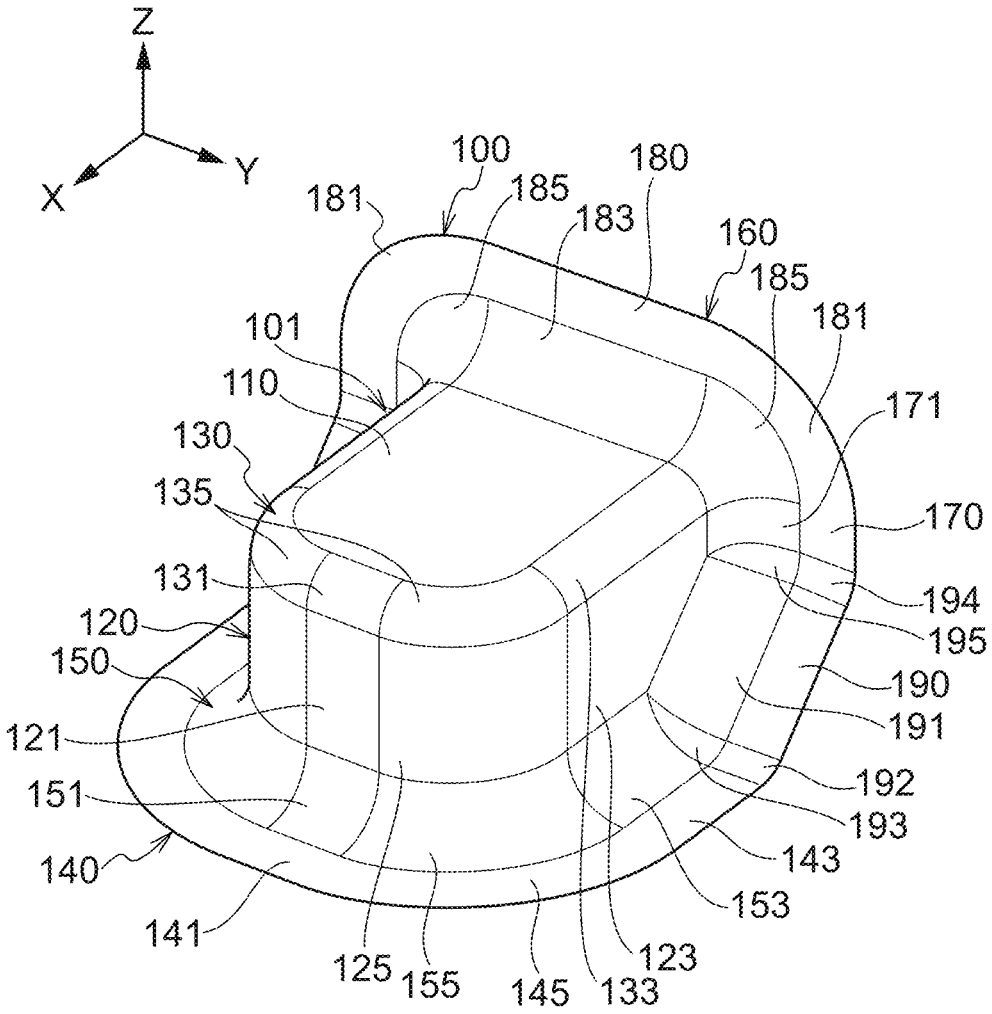
FIG. 1A is a perspective view illustrating a configuration example of a press-formed article according to a first embodiment of the present disclosure.

First, a preferred first embodiment of the present disclosure will be described in detail. Note that, in the present specification and the drawings, components having substantially the same functional configuration are denoted by the same reference numerals, and redundant description is omitted.

<1. Configuration of Press-Formed Article 100>

First, a schematic configuration of a press-formed article 100 according to a first embodiment of the present disclosure will be described with reference to FIG. 1A. FIG. 1A is a perspective view of a press-formed article 100 according to a first embodiment. As illustrated in FIG. 1A, the press-formed article 100 according to the first embodiment is a structural member having a so-called bag-shaped portion 101. Here, the bag-shaped portion 101 refers to a shape which is formed along a peripheral edge of a top sheet and in which at least three sides of the top sheet are covered with standing walls, and does not include a hat shape having only a pair of opposing standing walls formed by bend-forming. The press-formed article 100 transmits a load between both members by connecting the members.

The press-formed article 100 is formed by press-forming a metal sheet (corresponding to a blank 1 described below in FIG. 2). Details regarding the press forming will be described below. The press-formed article 100 is formed of a steel sheet. In particular, the press-formed article 100 is formed of a high-tensile steel sheet. A thickness of the blank 1 may be 0.8 mm or more, and can be appropriately set according to strength and rigidity of the press-formed article 100. The shape of the blank 1 and the dimensions (distance in X, Y, and Z directions) of the press-formed article 100 after forming can be appropriately set depending on the strength and rigidity of the press-formed article 100.

As illustrated in FIG. 1A, the press-formed article 100 includes a top sheet portion 110, a peripheral wall portion 120, a floor flange portion 140, a side standing flange portion 170, and an inclined flange portion 190. A bag-shaped portion 101 of the press-formed article 100 mainly includes the top sheet portion 110 and the peripheral wall portion 120. In a use state, the press-formed article 100 is joined in surface contact with one member (not illustrated) by the floor flange portion 140, and is joined in surface contact with another member (not illustrated) by a standing flange portion 160 including the side standing flange portion 170.

[Top Sheet Portion]

The top sheet portion 110 is a planar portion extending along an X-Y plane illustrated in FIG. 1A in the press-formed article 100. The top sheet portion 110 has a substantially rectangular shape having long sides along a X direction in plan view (as viewed in a Z direction in FIG. 1A). The top sheet portion 110 constitutes a part of the bag-shaped portion 101.

[Peripheral Wall Portion]

The peripheral wall portion 120 is formed along three peripheral edge portions of the top sheet portion 110, and extends from the peripheral edge portions in a direction intersecting an extending direction of the top sheet portion 110. The peripheral wall portion 120 constitutes a part of the bag-shaped portion 101. Specifically, as illustrated in FIG.

1A, the peripheral wall portion 120 is bent from a peripheral edge portion including one end of the top sheet portion 110 in the X direction and both ends of the top sheet portion 110 in the Y direction and extends in the Z direction.

The peripheral wall portion 120 includes a central standing wall portion 121 continuous with one end of the top sheet portion 110 in the X direction and a side standing wall portion 123 continuous with each of both ends of the top sheet portion 110 in the Y direction. The peripheral wall portion 120 has ridgeline standing wall portions 125 connecting the central standing wall portion 121 and the side standing wall portions 123. Since the central standing wall portion 121 and the side standing wall portion 123 are connected by the ridgeline standing wall portion 125, rigidity of the press-formed article 100 is improved, a resistance force against torsion and crushing increases, and a load transfer capability is improved.

A top sheet ridgeline portion 130 having a predetermined curvature radius is formed between the top sheet portion 110 and the peripheral wall portion 120. Specifically, a central top sheet ridgeline portion 131 is formed between the top sheet portion 110 and the central standing wall portion 121. A side top sheet ridgeline portion 133 is formed between the top sheet portion 110 and the side standing wall portion 123. A curvature radius of the top sheet ridgeline portion 130 is appropriately set according to workability during press forming, and strength and rigidity of the press-formed article 100.

Atop sheet corner portion 135 is formed between the central top sheet ridgeline portion 131 and the side top sheet ridgeline portion 133. The top sheet corner portion 135 connects the ridgeline standing wall portion 125 and the top sheet portion 110. The central top sheet ridgeline portion 131 and the side top sheet ridgeline portion 133 are connected by the top sheet corner portion 135, and thus, the rigidity of the press-formed article 100 is improved, the resistance force against torsion and crushing increases, and the load transfer capability is improved.

[Floor Flange Portion]

The floor flange portion 140 extends outward from an end portion opposite to an end portion of the peripheral wall portion 120 continuous with the top sheet portion 110 in a direction intersecting the extending direction of the peripheral wall portion 120. Specifically, as illustrated in FIG. 1A, the floor flange portion 140 is an end portion of the peripheral wall portion 120 in the Z direction and extends along the X-Y plane outward with respect to an internal space formed by the bag-shaped portion 101 from an end portion on a side opposite to the top sheet portion 110. The floor flange portion 140 includes a central floor flange portion 141 continuous with the central standing wall portion 121 and a side floor flange portion 143 continuous with the side standing wall portion 123. The floor flange portion 140 includes a ridgeline floor flange portion 145 that connects the central floor flange portion 141 and the side floor flange portion 143.

Since the central floor flange portion 141 and the side floor flange portion 143 are connected by the ridgeline floor flange portion 145, the rigidity of the press-formed article 100 is improved, the resistance force against torsion and crushing increases, and the load transfer capability is improved.

A floor flange ridgeline portion 150 is formed between the peripheral wall portion 120 and the floor flange portion 140. Specifically, a central floor flange ridgeline portion 151 is formed between the central standing wall portion 121 and the central floor flange portion 141. A side floor flange ridgeline portion 153 is formed between side standing wall portion 123 and side floor flange portion 143.

A floor flange corner portion 155 is formed between the central floor flange ridgeline portion 151 and the side floor flange ridgeline portion 153. The floor flange corner portion 155 connects the ridgeline standing wall portion 125 and the ridgeline floor flange portion 145 of the floor flange portion 140. Since the respective portions are connected by the floor flange corner portion 155, the rigidity of the press-formed article 100 is improved, the resistance force against torsion and crushing increases, and the load transfer capability is improved.

[Side Standing Flange Portion]

The side standing flange portion 170 extends outward from a circumferential end portion of the peripheral wall portion 120. Specifically, as illustrated in FIG. 1A, the side standing flange portion 170 extends along the Y direction from an end portion of the side standing wall portion 123 on a side opposite to a side where the central standing wall portion 121 is provided, outward with respect to the internal space formed by the bag-shaped portion 101. A side standing flange ridgeline portion 171 is formed between the side standing flange portion 170 and the side standing wall portion 123.

[Inclined Flange Portion]

The inclined flange portion 190 is an inclined wall continuous between the side standing flange portion 170 and the floor flange portion 140. Specifically, as illustrated in FIG. 1A, the inclined flange portion 190 is inclined with respect to the X direction and the Z direction as viewed in the Y direction between the side floor flange portion 143 of the floor flange portion 140 and the side standing flange portion 170. As the angle (inclination angle) formed by the extending direction of the inclined flange portion 190 and the X direction illustrated in FIG. 1A is smaller, an area of the side standing flange portion 170 is larger, and thus, the load transfer capability and rigidity of the press-formed article 100 are improved. For example, the inclination angle of the inclined flange portion 190 is set to about 30 to 45°.

The inclined flange portion 190 allows the floor flange portion 140 and the side standing flange portion 170 to be continuous, thereby improving the load transfer capability and rigidity of the press-formed article 100. As will be described below, the inclined flange portion 190 is formed by forming a convex flange portion 51 having a convex shape between the floor flange portion 140 and the side standing flange portion 170 and then crushing the convex flange portion 51. Therefore, wrinkles are dispersed in the inclined flange portion 190, and concentration of wrinkles is suppressed.

An inclined flange ridgeline portion 191 is formed between the inclined flange portion 190 and the side standing wall portion 123. The inclined flange ridgeline portion 191 allows the inclined flange portion 190 and the side standing wall portion 123 to be continuous with each other, and allows the inclined flange portion 190 to be continuous with the bag-shaped portion 101, and thus, the load transfer capability and the rigidity of the press-formed article 100 are improved.

A lower flange ridgeline portion 192 is formed between the inclined flange portion 190 and the side floor flange portion 143. Further, a lower flange corner portion 193 is formed between the lower flange ridgeline portion 192, the inclined flange ridgeline portion 191, the side floor flange ridgeline portion 153, and the side standing wall portion 123.

An upper flange ridgeline portion 194 is formed between the inclined flange portion 190 and the side standing flange portion 170. An upper flange corner portion 195 is formed between the upper flange ridgeline portion 194, the inclined flange ridgeline portion 191, the side standing flange ridgeline portion 171, and the side standing wall portion 123.

Since the lower flange ridgeline portion 192 and the upper flange ridgeline portion 194 are provided, the inclined flange portion 190 is continuous with the side floor flange portion 143 and the side standing flange portion 170 with a predetermined curvature radius. As a result, the load transfer capability of the press-formed article 100 is improved.

Further, by providing the lower flange corner portion 193 and the upper flange corner portion 195, the inclined flange ridgeline portion 191 is continuous with the side floor flange ridgeline portion 153 and the side standing flange ridgeline portion 171. As described above, the inclined flange portion 190 is continuous with other portions via the inclined flange ridgeline portion 191, and thus, the load transfer capability and the rigidity of the press-formed article 100 are improved.

Figure 1B:
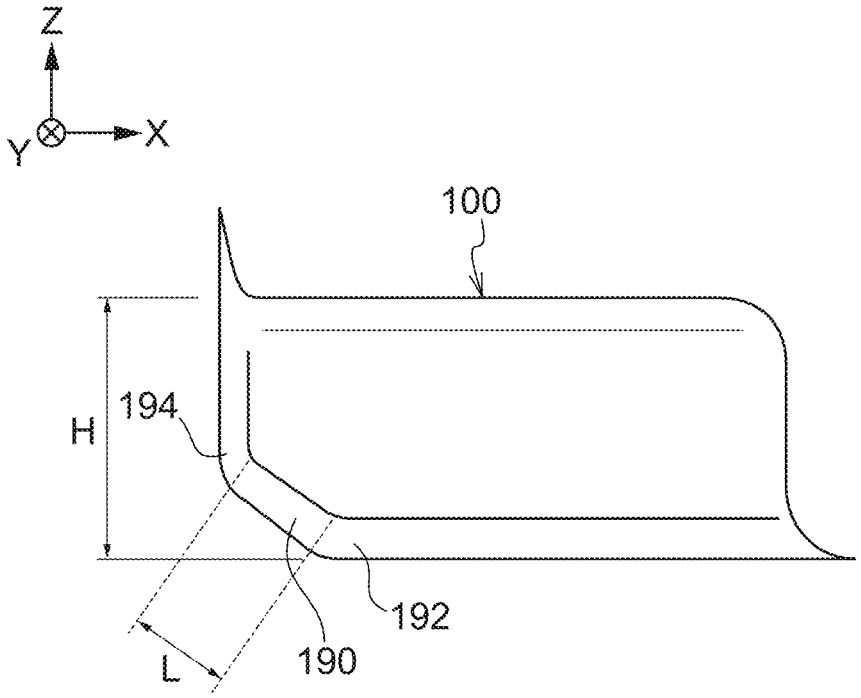
FIG. 1B is a side view illustrating a configuration example of the press-formed article according to the first embodiment.

As illustrated in FIG. 1B, the inclined flange portion 190 is set such that a line length L of the inclined flange portion 190 in side view is from 10% to 70% of a height H (distance between the top sheet portion 110 and the floor flange portion 140) of the press-formed article 100. Here, the line length L of the inclined flange portion 190 is a distance along the inclined flange portion 190 between an upper flange ridgeline portion 194 and a lower flange ridgeline portion 192 to be described below when the press-formed article 100 is viewed from the side (as viewed in the Y direction illustrated in FIG. 1B).

As an example, when the height H of the press-formed article 100 is about 50 mm, the line length L of the inclined flange portion 190 is in a range of about from 5 mm to 35 mm.

When the line length L of the inclined flange portion 190 is 70% or less of the height H of the press-formed article 100, the load transfer capability of the press-formed article 100 is improved. That is, by shortening the line length L of the inclined flange portion 190, it is possible to increase an area where the side standing flange portion 170 or the side floor flange portion 143 comes into contact with another member (not illustrated). As a contact area with other members increases, the rigidity and load transfer capability of the press-formed article 100 are improved. In addition, a load applied per unit area of the inclined flange portion 190 or the standing flange portion 160 is reduced, and a moment applied to the press-formed article 100 and the two members (not illustrated) connected via the press-formed article 100 is also suppressed. Since the contact area increases, when the press-formed article 100 is welded to another member (not illustrated), the welding area can also increase.

In addition, as compared with a case where the line length L of the inclined flange portion 190 is long and the area where the side standing flange portion 170 or the side floor flange portion 143 comes into contact with another member cannot be sufficiently secured, the generation of the moment with respect to the press-formed article 100 is also suppressed. Specifically, for example, it is assumed that only an upper side (the top sheet portion 110 side) of the side standing flange portion 170 is joined to another member (not illustrated, and for example, a side sill or the like). In this case, in the press-formed article 100, a deviation occurs between a portion where a load from the side sill acts and a support portion (joint portion), and as a result, a moment may be generated in the press-formed article 100. Therefore, as described above, by setting the length of the line length L within the predetermined range, the generation of the moment can be suppressed, and the deformation of the press-formed article 100 can be more effectively suppressed.

Since the line length L of the inclined flange portion 190 is 10% or more of the height H of the press-formed article 100, it is possible to improve formability of the inclined flange portion 190 without increasing the sizes of the upper flange ridgeline portion 194 and the lower flange ridgeline portion 192 while securing the load transfer capability. When the press-formed article 100 is welded to another member (not illustrated) via the inclined flange portion 190, a welding area is secured.

In other words, when the line length L of the inclined flange portion 190 is larger than 70% of the height H of the press-formed article 100, the load transfer capability and the rigidity required for the press-formed article 100 are not satisfied, and for example, it is difficult to exhibit the function as the press-formed article 100 connecting other members. Meanwhile, when the line length L of the inclined flange portion 190 is smaller than 10% of the height H of the press-formed article 100, it is difficult to form a planar portion of the inclined flange portion 190.

[Central Standing Flange Portion]

The press-formed article 100 may further include a central standing flange portion 180. The standing flange portion 160 includes the side standing flange portion 170 and the central standing flange portion 180. The press-formed article 100 may be brought into surface contact with another member (not illustrated) by the standing flange portion 160.

The central standing flange portion 180 extends from an end portion of the top sheet portion 110 where the peripheral wall portion 120 is not formed in a direction intersecting the extending direction of the top sheet portion 110 and opposite to the extending direction of the peripheral wall portion 120, and is continuous with the side standing flange portion 170. Specifically, as illustrated in FIG. 1A, the top sheet portion 110 extends along the Z direction from an end portion opposite to a side where the central standing wall portion 121 is provided. A ridgeline standing flange portion 181 is formed between the central standing flange portion 180 and the side standing flange portion 170.

A central standing flange ridgeline portion 183 is formed between the central standing flange portion 180 and the top sheet portion 110. A standing flange corner portion 185 is formed between the central standing flange ridgeline portion 183 and the side standing flange ridgeline portion 171. In addition, the standing flange corner portion 185 connects the side top sheet ridgeline portion 133 and the ridgeline standing flange portion 181.

Since the central standing flange portion 180 and the side standing flange portion 170 are connected by the ridgeline standing flange portion 181, the rigidity of the press-formed article 100 is improved, the resistance force against torsion and crushing increases, and the load transfer capability is improved.

Furthermore, the central standing flange portion 180 and the side standing flange portion 170 are connected by the ridgeline standing flange portion 181, whereby the floor flange portion 140, the side standing flange portion 170, and the central standing flange portion 180 are continuously formed. As a result, the load transfer capability between one member and another member by the press-formed article 100 is improved. Furthermore, the central standing flange portion 180 is connected to the bag-shaped portion 101 including the top sheet portion 110 and the side standing flange portion 170 via various ridgeline portions and corner portions. As a result, the load transfer capability and the rigidity of the press-formed article 100 are further improved.

The press-formed article 100 described above includes the floor flange portion 140, the side standing flange portion 170, the central standing flange portion 180, and the inclined flange portion 190, and the flange formed around the press-formed article 100 is continuous over the entire periphery of the press-formed article 100. That is, the floor flange portion 140, the side standing flange portion 170, the central standing flange portion 180, and the inclined flange portion 190 forming the flange are continuous over the entire periphery of the press-formed article 100. Therefore, the rigidity of the press-formed article 100 is improved.

(Intermediate Formed Article)

Subsequently, an intermediate formed article preliminarily formed in forming the press-formed article 100 according to the first embodiment will be described. The intermediate formed article (corresponding to an intermediate formed article 50 illustrated in FIG. 9B) has a shape corresponding to the bag-shaped portion 101 of the press-formed article 100 and a shape including the convex flange portion 51. The convex flange portion 51 is provided between a portion corresponding to the side floor flange portion 143 and a portion corresponding to the side standing flange portion 170. Although details will be described below, the intermediate formed article 50 is further subjected to press forming, and the convex flange portion 51 is flattened, whereby the inclined flange portion 190 is formed from the convex flange portion 51, and the press-formed article 100 having the inclined flange portion 190 is formed. Hereinbefore, the schematic configuration of the press-formed article 100 according to the first embodiment is described.

<2. Die/Punch>

Next, a die/punch according to the first embodiment will be described with reference to FIGS. 2 and 3. FIG. 2 is a view schematically describing a configuration of a first die/punch 200 according to the first embodiment. FIG. 3 is a view schematically describing a configuration of a second die/punch 300 according to the first embodiment. The configuration of the die/punch illustrated in FIGS. 2 and 3 is merely schematic, and does not indicate an actual die/punch.

The die/punch according to the first embodiment includes the first die/punch 200 and the second die/punch 300. Although the method of manufacturing the press-formed article 100 will be described in detail below, the intermediate formed article 50 having the convex flange portion 51 at a position corresponding to a portion between the floor flange portion 140 and the side standing flange portion 170 with respect to the blank 1 is formed by first press forming using the first die/punch 200. Further, by second press forming using the second die/punch 300, the convex flange portion 51 is flattened, the inclined flange portion 190 is formed from the convex flange portion 51, and the press-formed article 100 having the inclined flange portion 190 is formed.

[First Die/Punch]

Figure 9A:
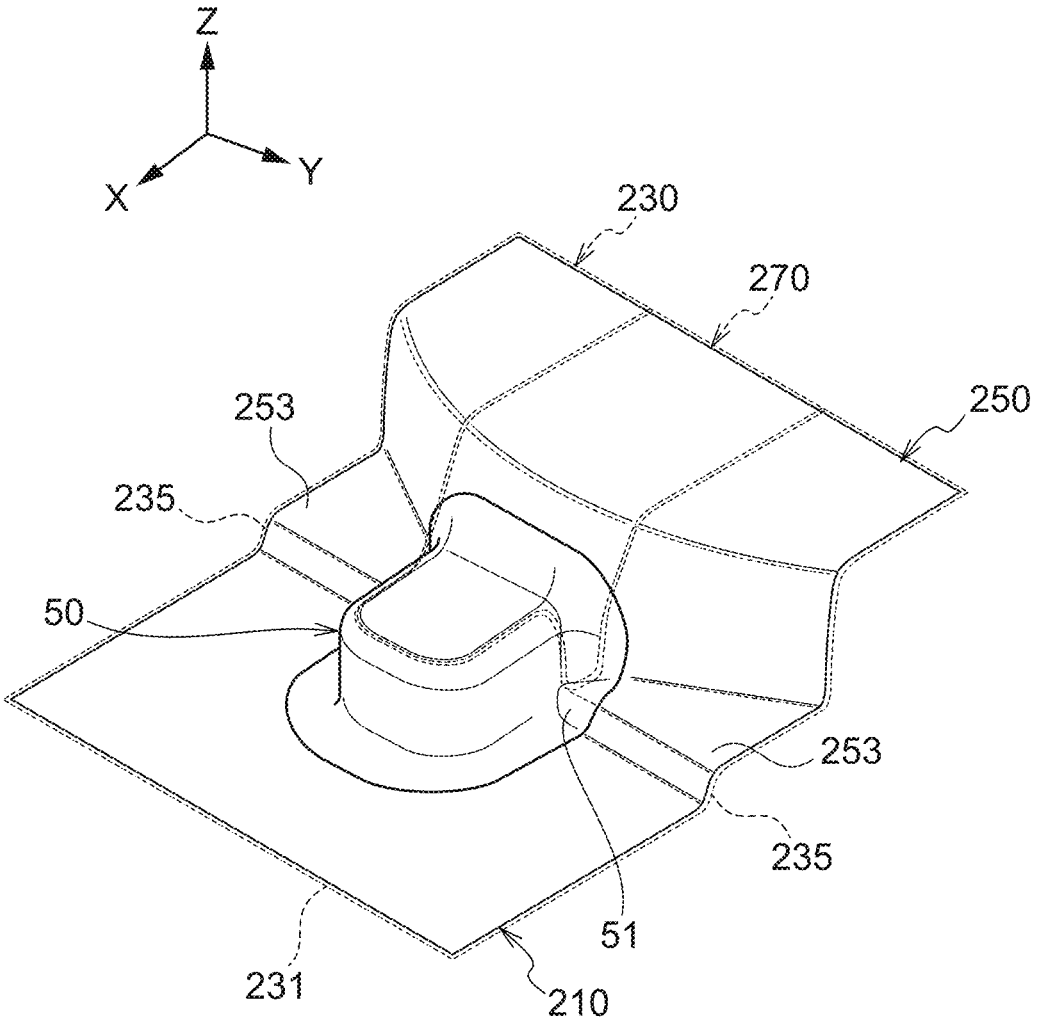
FIG. 9A is a perspective view schematically illustrating a state after completion of the first press forming according to the first embodiment.
Figure 9B:
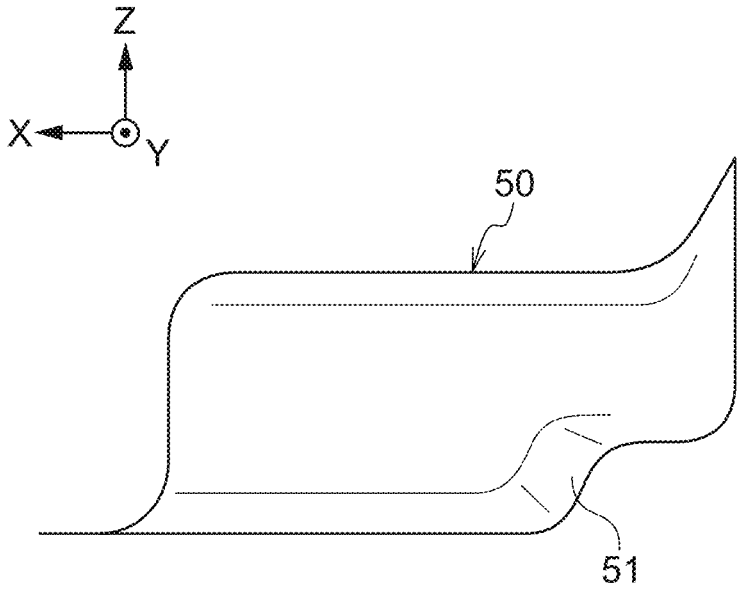
FIG. 9B is a side view illustrating a configuration example of an intermediate formed article after the first press forming according to the first embodiment.

The first die/punch 200 is used to preliminarily form the blank 1 into an intermediate formed article (corresponding to the intermediate formed article 50 described in FIG. 9B) having a predetermined shape in the first press forming. Specifically, as illustrated in FIG. 2, the first die/punch 200 includes a first holder 210, a first die 230, and a first punch 250.

[First Holder]

Figure 2:
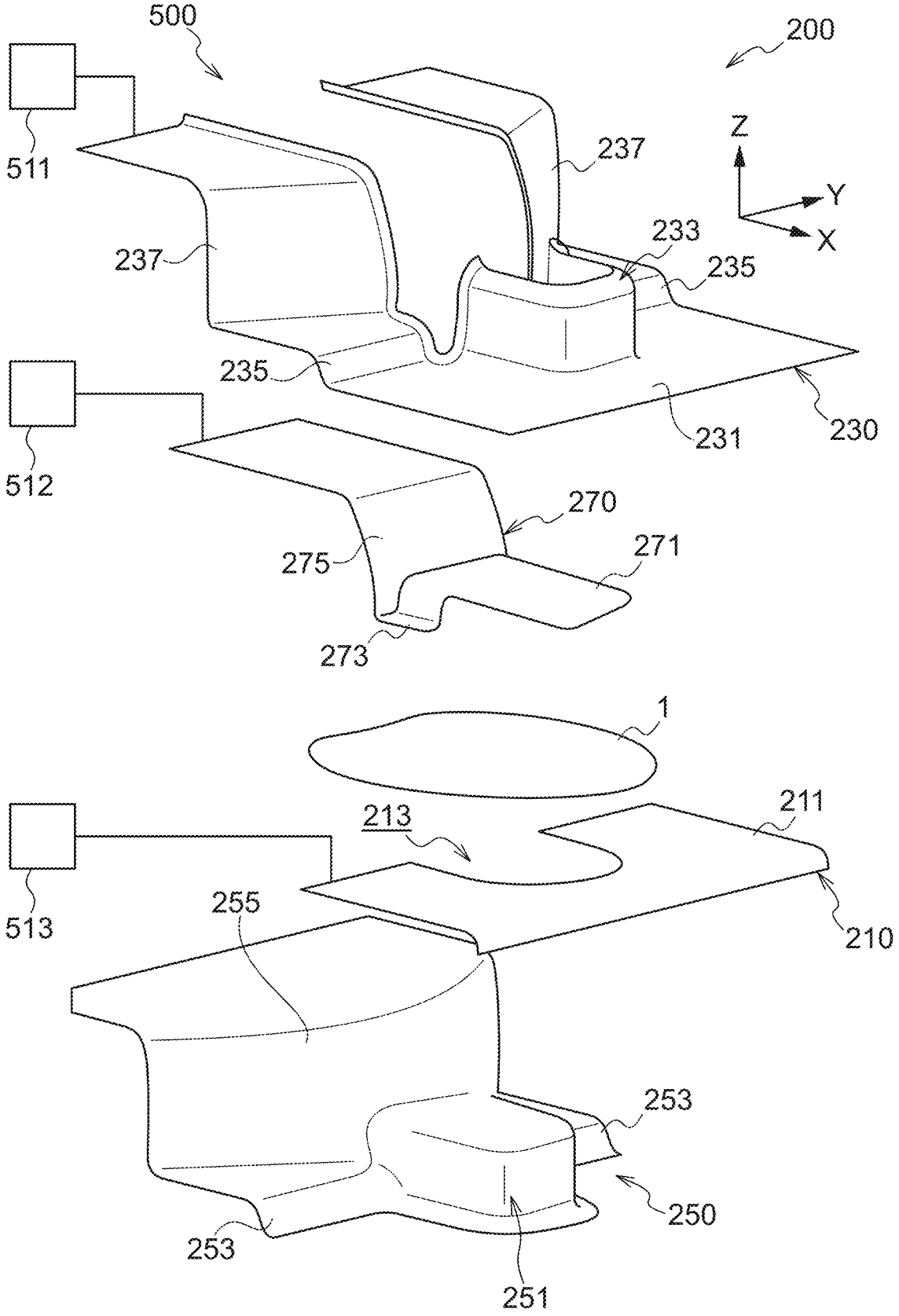
FIG. 2 is a perspective view schematically describing a configuration example of a first die/punch according to the first embodiment.
Figure 3:
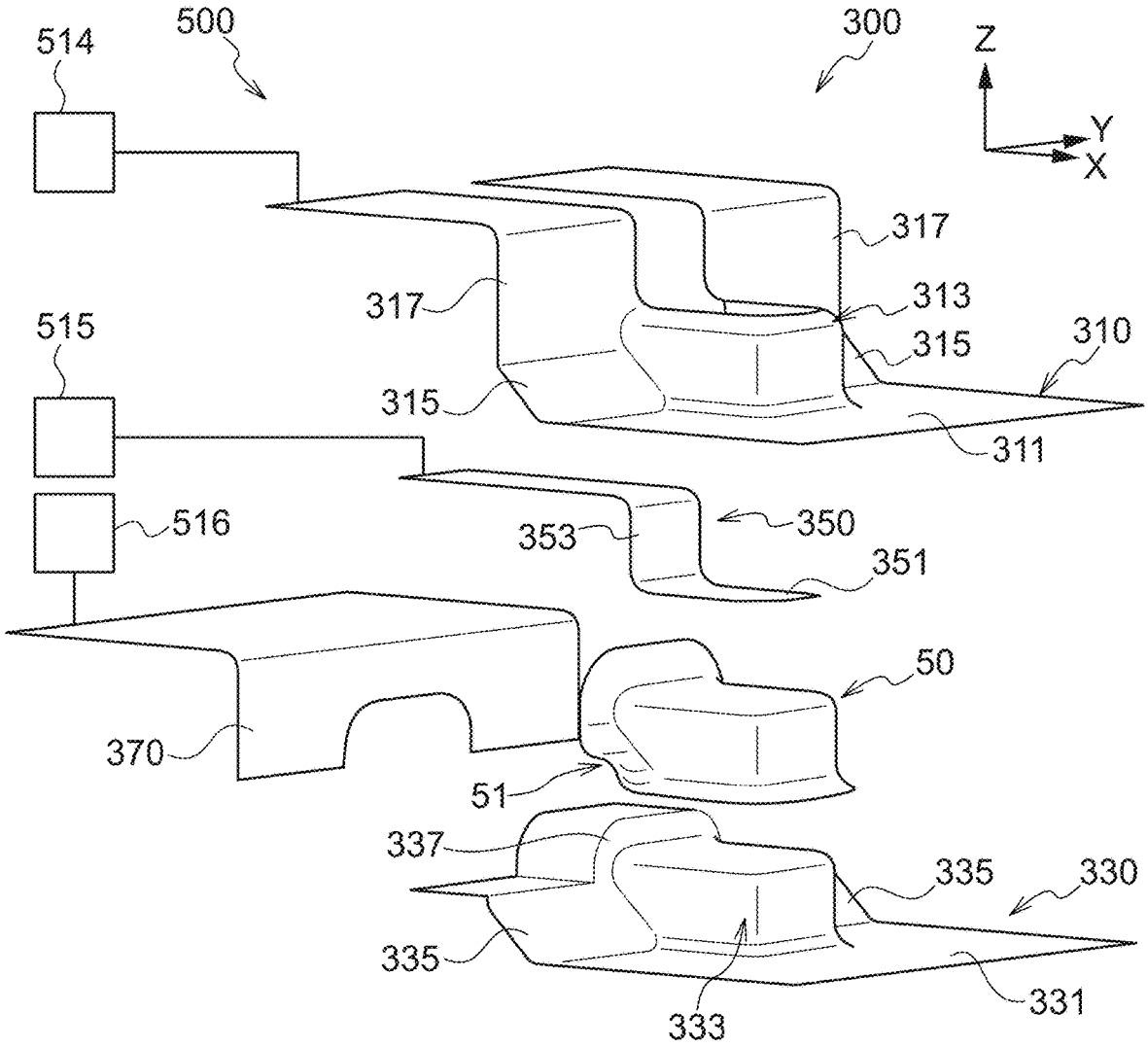
FIG. 3 is a perspective view schematically describing a configuration example of a second die/punch according to the first embodiment.

The first holder 210 abuts on one surface of the blank 1 along the Z direction in FIG. 2. For example, when the first die/punch 200 relatively moves in the vertical direction, the first holder 210 abuts on a lower surface of the blank 1. The first holder 210 has a portion abutting on a region to be the floor flange portion 140 of the press-formed article 100 in an outer peripheral edge portion of the blank 1. In addition, the first holder 210 has a portion that sandwiches the blank 1 with the first die 230 to be described below.

As an example, the first holder 210 has a holder flat surface portion 211 extending along the X-Y plane, and has a cutout portion 213 cut out in a semicircular shape at a portion corresponding to the position of the blank 1 in the holder flat surface portion 211. The cutout portion 213 is provided to have a size capable of avoiding interference with a portion forming the bag-shaped portion 101 of the press-formed article 100 in the first punch 250 described below.

[First Die]

The first die 230 abuts on the other surface of the blank 1 along the Z direction in FIG. 2. For example, when the first die/punch 200 relatively moves in the vertical direction, the first die 230 abuts on the upper surface of the blank 1. The first die 230 has a portion abutting on a region to be the floor flange portion 140 of the press-formed article 100 in the outer peripheral edge portion of the blank 1, and a portion sandwiching the blank 1 with the first holder 210. In addition, the first die 230 has a portion that abuts on a region to be the peripheral wall portion 120 of the press-formed article 100 in the blank 1.

As an example, the first die 230 includes a first die flat surface portion 231, a first die peripheral wall forming portion 233 erected from substantially the center of the first die flat surface portion 231, a first die protrusion forming portion 235 provided at an X direction end portion of the first die flat surface portion 231, and a first die standing flange forming portion 237 provided at an X direction end portion of the first die protrusion forming portion 235.

The first die flat surface portion 231 sandwiches the outer peripheral edge portion of the blank 1 with the first holder 210. The first die peripheral wall forming portion 233 is a peripheral wall-shaped portion erected from substantially the center of the first die flat surface portion 231. The first die peripheral wall forming portion 233 forms the peripheral wall portion 120 by performing draw-forming on the blank 1 with a first punch 250 to be described below.

The first die protrusion forming portion 235 holds the blank 1 from the upper surface therefor, and forms a convex flange portion 51 having a convex shape on the blank 1. The first die protrusion forming portion 235 is provided on both sides of the first die peripheral wall forming portion 233 in the Y direction, and has a step shape having a predetermined height from the first die flat surface portion 231. The first die standing flange forming portion 237 is a wall surface erected from the first die protrusion forming portion 235, and forms the standing flange portion 160 including the side standing flange portion 170 by bending the blank 1 with a first punch 250 to be described below.

[First Punch]

The first punch 250 abuts on one surface of the blank 1 along the Z direction in FIG. 2. For example, when the first die/punch 200 relatively moves in the vertical direction, the first punch 250 abuts on the lower surface of the blank 1. The first punch 250 has a portion that abuts on a region to be the peripheral wall portion 120 of one surface of the blank 1 and performs draw-forming on the blank 1 together with the first die 230 to form the peripheral wall portion 120. In addition, the first punch 250 has a first punch protrusion forming portion 253 which is a protrusion that abuts on a region to be the inclined flange portion 190 on one surface of the blank 1 and performs the bend-forming for forming the convex flange portion 51 having a protrusion shape protruding toward the other surface.

As an example, the first punch 250 includes a first punch peripheral wall forming portion 251, a first punch protrusion forming portion 253, and a first punch standing flange forming portion 255. The first punch peripheral wall forming portion 251 is a trapezoidal portion that abuts on the lower surface of the region to be the bag-shaped portion 101 of the blank 1. That is, the first punch peripheral wall forming portion 251 is a portion that abuts on a region to be the peripheral wall portion 120 of one surface of the blank 1 and performs draw-forming on the blank 1 together with the first die 230 to form the peripheral wall portion 120. The blank 1 is draw-formed along the outer surface of the first punch peripheral wall forming portion 251 to form the bag-shaped portion 101 of the press-formed article 100.

The first punch protrusion forming portion 253 is a stepped portion provided on each of both sides of the first punch peripheral wall forming portion 251 in the Y direction. That is, the first punch protrusion forming portion 253 is a portion that abuts on a region to be the inclined flange portion 190 on one surface of the blank 1 and bends and bends the blank 1 together with the first die 230 to form the convex flange portion 51. The first punch protrusion forming portion 253 sandwiches the blank 1 with the first die protrusion forming portion 235 and bends the blank 1 to form the convex flange portion 51 having a protruding shape. The first punch standing flange forming portion 255 is a wall-shaped portion provided continuously to the end portions of the first punch peripheral wall forming portion 251 and the first punch protrusion forming portion 253. The first punch standing flange forming portion 255 sandwiches the blank 1 with the first die standing flange forming portion 237 to form the standing flange portion 160 of the press-formed article 100.

[First Pad]

Furthermore, the first die/punch 200 may have a first pad 270. The first pad 270 abuts on the other surface of the blank 1 along the Z direction in FIG. 2. For example, when the first die/punch 200 relatively moves in the vertical direction, the first pad 270 abuts on the upper surface of the blank 1. The first pad 270 includes first pad top sheet pressing portion 271, first pad ridgeline forming portion 273, and first pad standing flange forming portion 275. The first pad top sheet pressing portion 271 is a tongue-shaped portion of the blank 1 that abuts on the top sheet portion 110 of the press-formed article 100. The first pad top sheet pressing portion 271 sandwiches the blank 1 with the first punch 250.

The first pad ridgeline forming portion 273 is a portion provided on each of both side portions in the Y direction at the end portion of the first pad top sheet pressing portion 271 in the X direction. The first pad ridgeline forming portion 273 has an arc shape as viewed in the X direction, extending from the planar position of the first pad top sheet pressing portion 271 toward the blank 1 side in the Z direction, and further has a portion bent outward in the Y direction from a tip of the arc shape. The first pad ridgeline forming portion 273 is provided on an end portion side of the first pad standing flange forming portion 275 in the first pad top sheet pressing portion 271. That is, the first pad ridgeline forming portion 273 forms a part of the side top sheet ridgeline portion 133 on the standing flange portion 160 side. In the first pad standing flange forming portion 275, the first pad standing flange forming portion 275, which is a wall-shaped portion erected from the end portion of the first pad top sheet pressing portion 271 in the X direction and the first pad ridgeline forming portion 273, sandwiches the blank 1 with the first punch 250 to form the standing flange portion 160 of the press-formed article 100.

[Second Die/Punch]

Subsequently, the second die/punch 300 of the die/punch according to the first embodiment will be described. The second die/punch 300 is used for forming the intermediate formed article 50 preliminarily formed in the first press forming as the press-formed article 100 by the second press forming. Here, the intermediate formed article 50 refers to a product before being formed into the press-formed article 100 by the second press forming, and is not intended to suggest that the press-formed article 100 according to the first embodiment becomes a final product. Specifically, as illustrated in FIG. 3, the second die/punch 300 includes a second die 310 and a second punch 330.

[Second Die]

The second die 310 abuts on the other surface of the intermediate formed article 50 from the Z direction in FIG. 3. For example, when the second die/punch 300 relatively moves in the vertical direction, the second die 310 abuts on the upper surface of the intermediate formed article 50. In addition, the second die 310 includes an inclined surface that abuts on the other surface of the convex flange portion 51.

As an example, the second die 310 includes a second die flat surface portion 311, a second die peripheral wall holding portion 313 provided substantially at the center of the second die flat surface portion 311, a second die inclined surface portion 315 provided at the end portion of the flat surface portion in the X direction, and a second die standing flange forming portion 317 continuous from the second die inclined surface portion 315. The second die flat surface portion 311 sandwiches a portion of the intermediate formed article 50 corresponding to the floor flange portion 140 with a second punch 330 to be described below. The second die peripheral wall holding portion 313 is a peripheral wall-shaped portion erected from substantially the center of the second die flat surface portion 311. The second die peripheral wall holding portion 313 sandwiches a portion corresponding to the peripheral wall portion 120 of the intermediate formed article 50 with a second punch 330 to be described below.

The second die inclined surface portion 315 presses the convex flange portion 51 of the intermediate formed article 50 from the upper surface to form the inclined flange portion 190 on the press-formed article 100. The second die inclined surface portion 315 is an inclined wall which is provided on each of both sides of the second die peripheral wall holding portion 313 in the Y direction and erected from the second die flat surface portion 311. The second die standing flange forming portion 317 is a wall surface erected from the second die inclined surface portion 315, and forms a standing flange portion 160 including a side standing flange portion 170 of the press-formed article 100 with a second cam 370 to be described below.

[Second Punch]

The second punch 330 abuts on one surface of the intermediate formed article 50 from the Z direction in FIG. 3. For example, when the second die/punch 300 relatively moves in the vertical direction, the second punch 330 abuts on the lower surface of the intermediate formed article 50. The second punch 330 is provided on one surface side of the convex flange portion 51 of the intermediate formed article 50, and sandwiches the convex flange portion 51 with the second die 310 to bend the inclined flange portion 190.

As an example, the second punch 330 includes a second punch flat surface portion 331, a second punch peripheral wall holding portion 333, a second punch inclined surface portion 335, and a second punch standing flange forming portion 337. The second punch flat surface portion 331 extends along the X-Y plane and sandwiches a portion corresponding to the floor flange portion 140 in the intermediate formed article 50 with the second die 310. The second punch peripheral wall holding portion 333 is a trapezoidal portion that is provided in a substantially central portion of the second punch flat surface portion 331 and abuts on a lower surface of a region corresponding to the bag-shaped portion 101 in the intermediate formed article 50.

The second punch inclined surface portion 335 is an inclined wall which is provided on each of both sides of the second punch peripheral wall holding portion 333 in the Y direction in FIG. 3 and erected from the second punch flat surface portion 331. The second punch inclined surface portion 335 forms the inclined flange portion 190 by sandwiching the convex flange portion 51 of the intermediate formed article 50 with the second die inclined surface portion 315. That is, the second punch inclined surface portion 335 is provided on one surface side of the convex flange portion 51, and is a portion that bends the inclined flange portion 190 from the convex flange portion 51 by sandwiching the convex flange portion 51 with the second die 310. The second punch standing flange forming portion 337 is a wall-shaped portion provided continuously to the end portion of the second punch peripheral wall holding portion 333 in the X direction. The second punch standing flange forming portion 337 sandwiches a portion corresponding to the standing flange portion 160 in the intermediate formed article 50 with the second pad 350 to be described below.

The second die/punch 300 may further include a second pad 350. The second pad 350 includes a second pad top sheet pressing portion 351 and a second pad standing flange forming portion 353. The second pad top sheet pressing portion 351 is a tongue-shaped portion, and sandwiches a portion corresponding to the top sheet portion 110 in the intermediate formed article 50 with the second punch peripheral wall holding portion 333. The second pad standing flange forming portion 353 is a wall-shaped portion erected from the end portion of the second pad top sheet pressing portion 351 in the X direction, and sandwiches a portion corresponding to the standing flange portion 160 in the intermediate formed article 50 with the second punch standing flange forming portion 337.

The second die/punch 300 may further include a second cam 370. The second cam 370 is in contact with the intermediate formed article 50 from the X direction in FIG. 3. The second cam 370 sandwiches a portion corresponding to the standing flange portion 160 of the intermediate formed article 50 with the second die standing flange forming portion 317, and the shape of the standing flange portion 160 of the press-formed article 100 is set to a predetermined dimension.

The die/punch according to the first embodiment may further include a third die/punch 400. The third die/punch 400 includes a plurality of cams. After the second press forming by the second die/punch 300, the cam of the third die/punch 400 comes into contact with a predetermined portion, and thus, the shape of each part of the press-formed article 100 is accurately finished. Details of the third die/punch 400 will be described below. The metal die/punch according to the first embodiment has been described above.

(Press Forming Apparatus)

The die/punch according to the first embodiment is used for press forming in a state of being provided in the press forming apparatus 500. As illustrated in FIGS. 2 and 3, the press forming apparatus 500 is not particularly limited as long as it includes general drive mechanisms 511 to 516 for performing press forming using the die/punch, a control mechanism (not illustrated), a detection mechanism (not illustrated), or the like. For example, the die/punch is movable by being driven by a hydraulic cylinder mechanism as the drive mechanisms 511 to 516. Further, the positions of the die/punch and the blank 1 are detected by a laser sensor as a detection mechanism. Furthermore, the function as the control mechanism is realized by cooperation of a central processing unit (CPU), a random access memory (RAM), a read only memory (ROM), and the like. The control mechanism controls a press forming step in the press forming apparatus based on an output from a hydraulic cylinder mechanism, a laser sensor, or the like, and an input from an input device. In addition, the control mechanism 520 controls a position, a moving speed, an operation timing, and the like of the die/punch.

<3. Manufacturing Method>

Next, an example of a method of manufacturing the press-formed article 100 according to the first embodiment will be described with reference to FIGS. 4A to 16B. The method of manufacturing the press-formed article 100 according to the first embodiment includes first press forming and second press forming. FIGS. 4A to 8B are views schematically describing a first press forming step in the first embodiment. In the first press forming, the bag-shaped portion 101 including the peripheral wall portion 120 of the press-formed article 100 is substantially formed by draw-forming, and the convex flange portion 51 is formed by the bend-forming between the side standing flange portion 170 and the floor flange portion 140. Hereinafter, the first press forming will be described with reference to FIGS. 4A to 8B.

(First Press Forming)

Figure 4A:
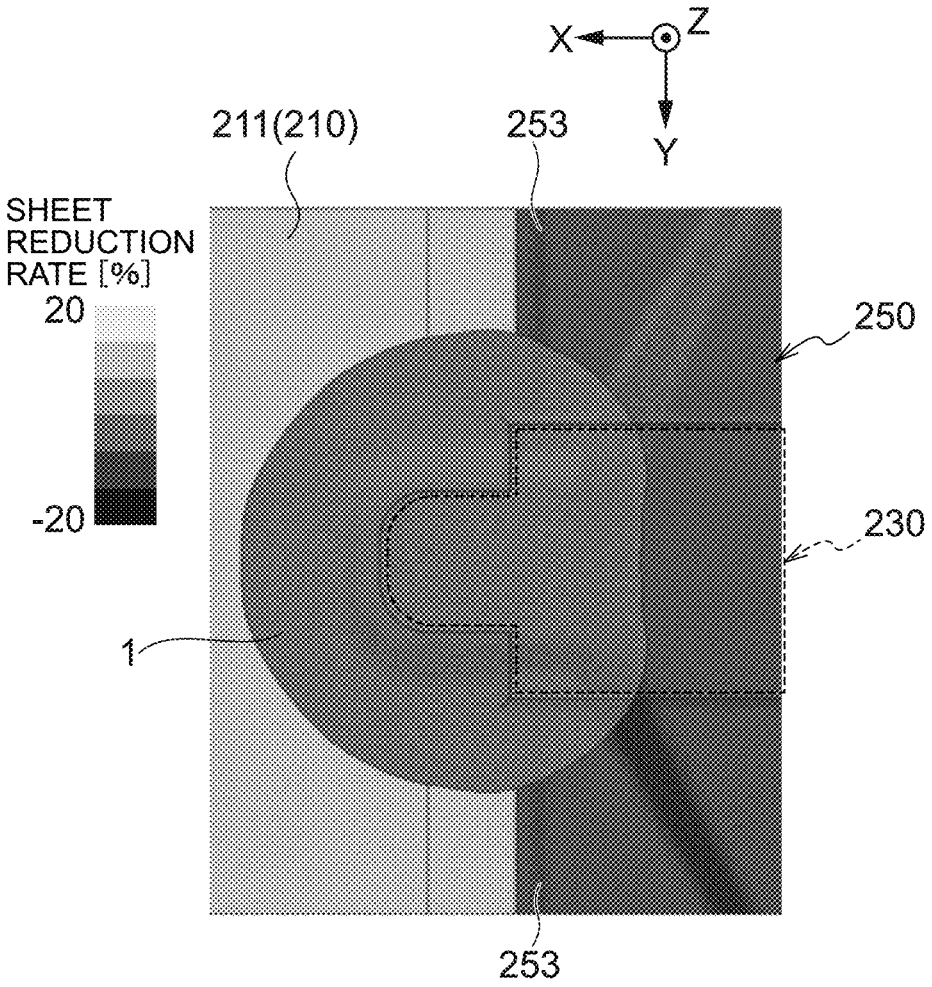
FIG. 4A is a plan view schematically describing a first press forming step according to the first embodiment.
Figure 4B:
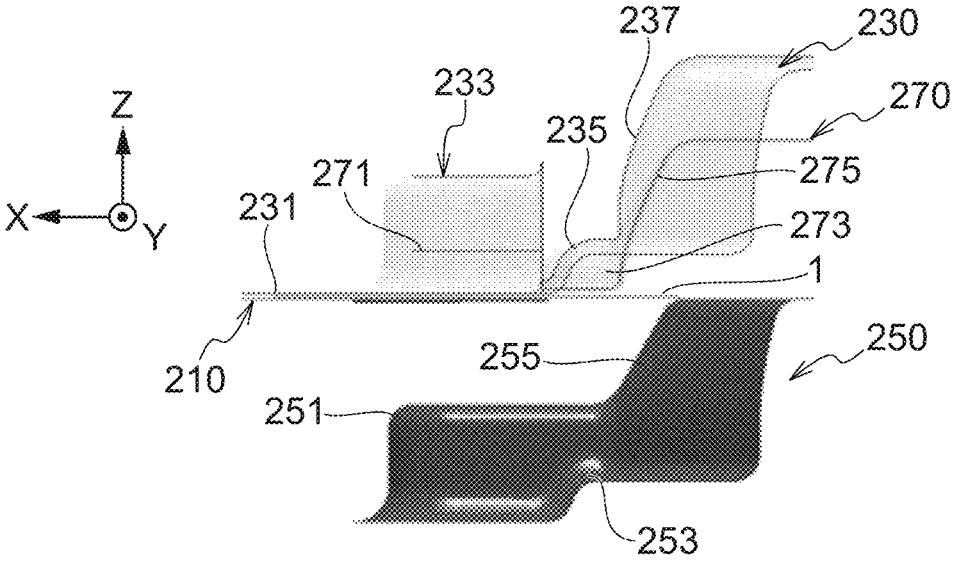
FIG. 4B is a side view schematically describing the first press forming step according to the first embodiment.

Specifically, as illustrated in FIG. 4B, first, the blank 1 is sandwiched between the first holder 210 and the first die 230. Here, as illustrated in FIG. 4A, the blank 1 is a substantially circular sheet material in plan view (as viewed in the Z direction in FIG. 4A), and the longest length in the X direction is about 170 mm, and the longest length in the Y direction is about 200 mm. The first holder 210 and the first die 230 sandwich a portion of the blank 1 to be the floor flange portion 140 of the press-formed article 100. Specifically, the outer peripheral edge portion of the blank 1 is sandwiched between the holder flat surface portion 211 and the first die flat surface portion 231.

Figure 5A:
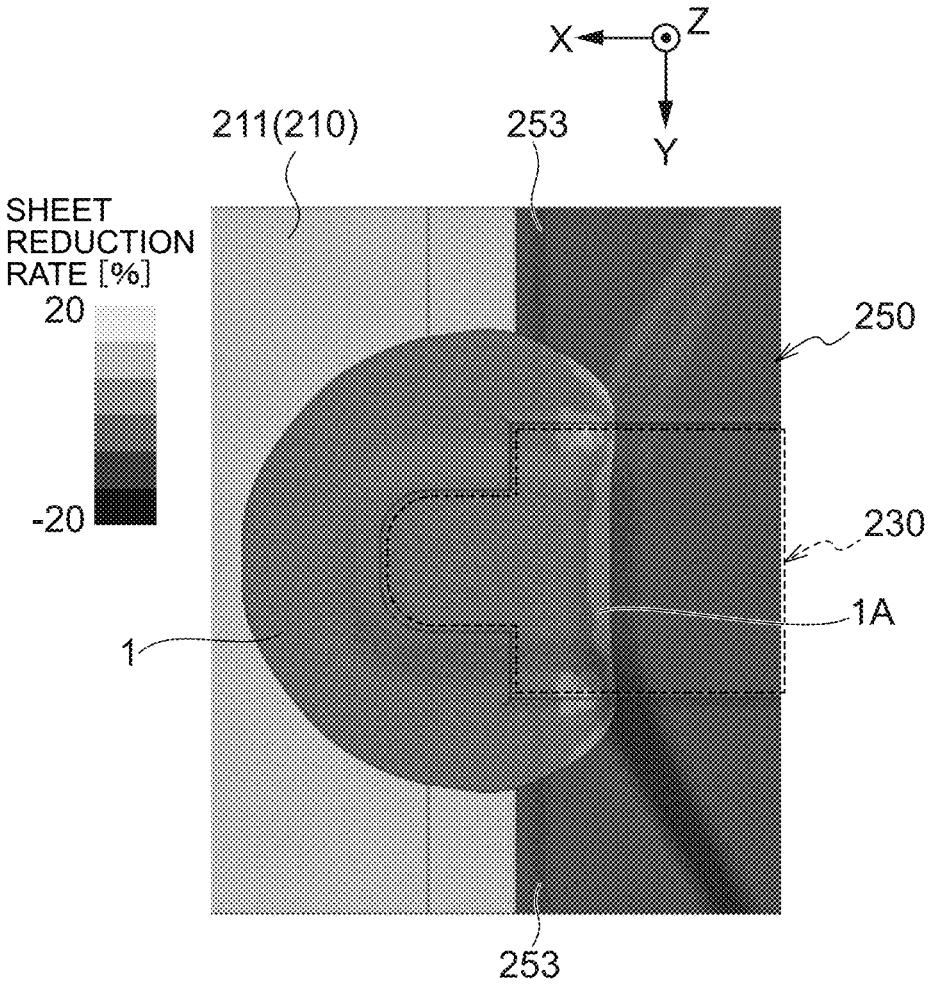
FIG. 5A is a plan view schematically describing the first press forming step according to the first embodiment.
Figure 5B:
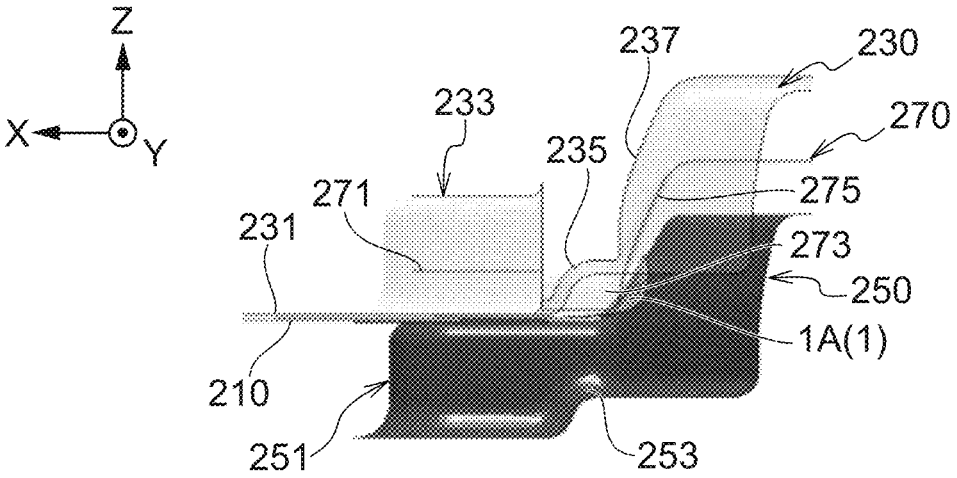
FIG. 5B is a side view schematically describing the first press forming step according to the first embodiment.

Next, as illustrated in FIG. 5B, the blank 1 sandwiched between the first holder 210 and the first die 230 is moved relative to the first punch 250, and the first punch 250 and the blank 1 are brought into contact with each other. Specifically, the substantially central portion of the blank 1 and the upper wall surface of the first punch peripheral wall forming portion 251 abut on each other. As illustrated in FIG. 5A, an end portion 1A of the blank 1 in the X direction abuts on the first punch standing flange forming portion 255 and is deformed.

In the embodiment in which the first die/punch 200 includes the first pad 270, the first pad 270 abuts on the blank 1 prior to the draw-forming. As a result, a part of the side top sheet ridgeline portion 133, which is a ridgeline portion between the top sheet portion 110 on the end portion side where the peripheral wall portion 120 is not formed and the peripheral wall portion 120 in the press-formed article 100, is formed. Further, a continuous portion between the central standing flange portion 180 and the side standing flange portion 170 of the press-formed article 100 is formed. That is, in the first press forming, before the draw-forming is performed, a part of the side top sheet ridgeline portion 133, the central standing flange ridgeline portion 183, and the standing flange corner portion 185 are formed by the first pad 270 and the first punch 250.

Specifically, as illustrated in FIG. 5A, the blank 1 is sandwiched between the first pad ridgeline forming portion 273 and the first punch peripheral wall forming portion 251 to form a part of the side top sheet ridgeline portion 133. The first pad standing flange forming portion 275 abuts on the end portion 1A of the blank 1 in the X direction. As a result, as illustrated in FIG. 5B, the blank 1 is sandwiched between the first pad standing flange forming portion 275 and the first punch standing flange forming portion 255, the blank 1 is partially bent, and the formation of the central standing flange portion 180 and the peripheral portion thereof is started.

Figure 6A:
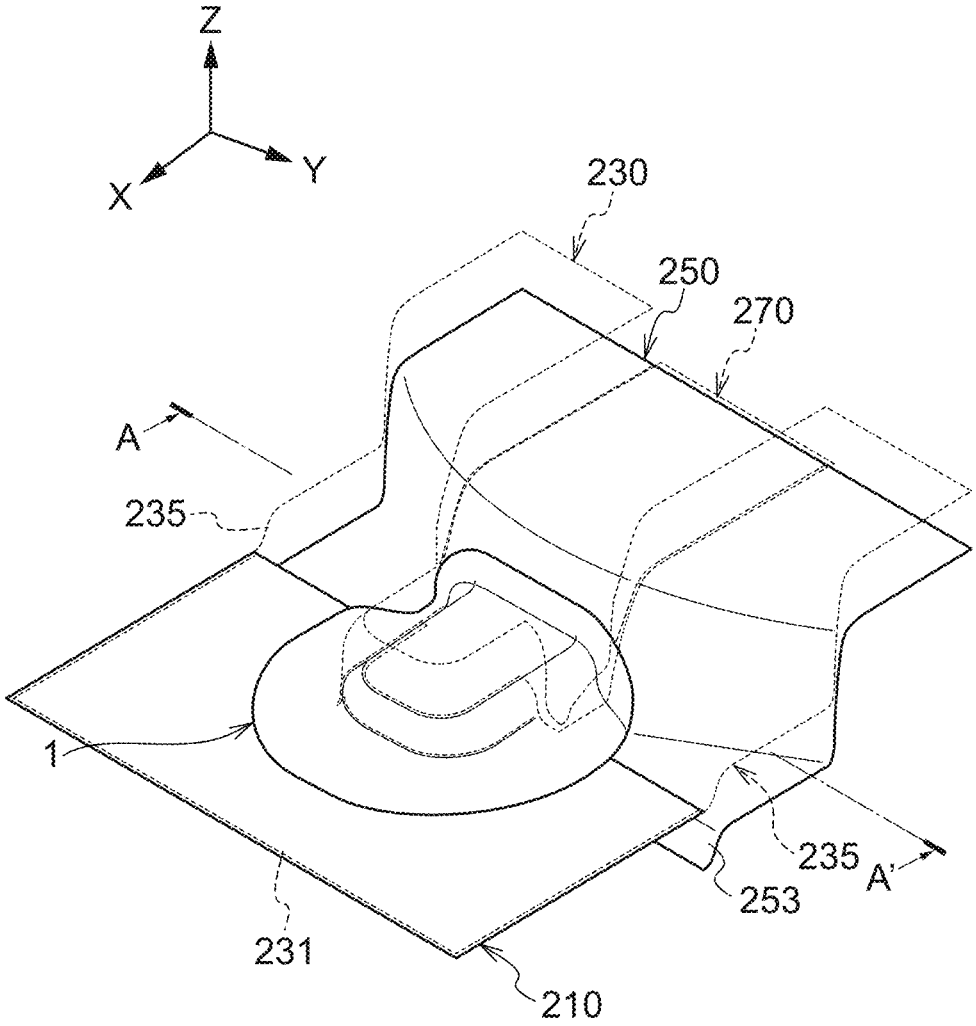
FIG. 6A is a perspective view schematically describing the first press forming step according to the first embodiment.
Figure 6B:
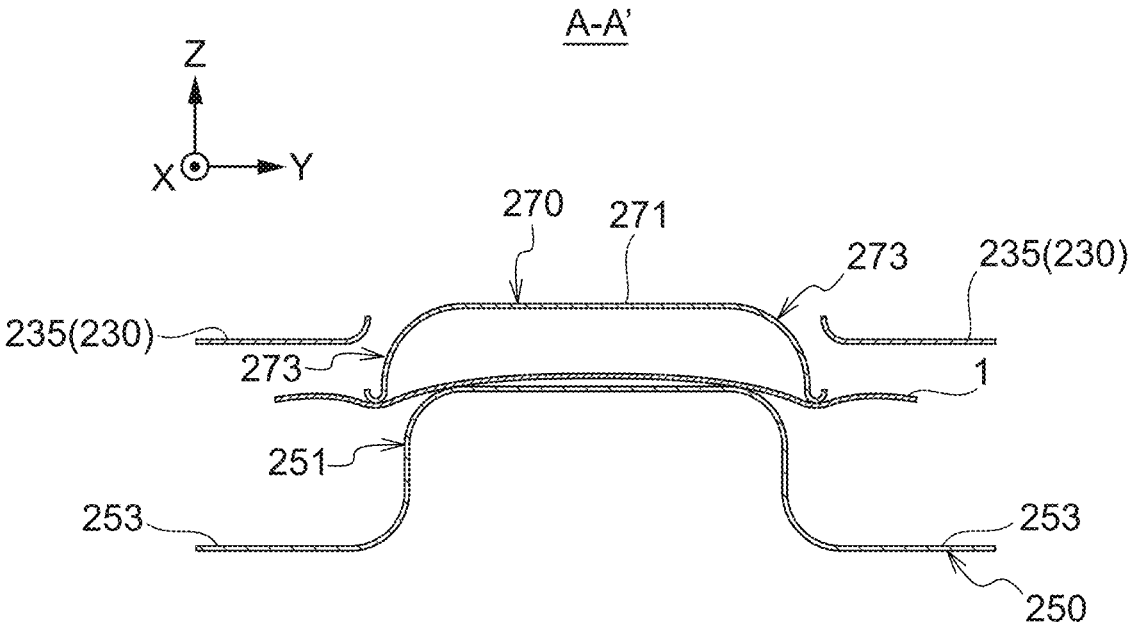
FIG. 6B is an end view schematically describing the first press forming step according to the first embodiment.
Figure 6C:
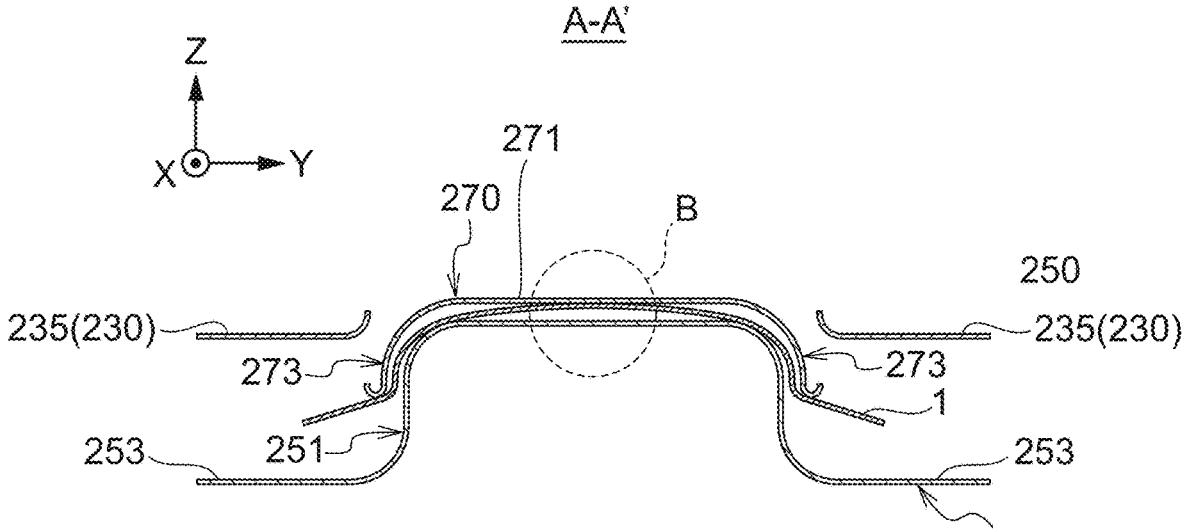
FIG. 6C is an end view schematically describing the first press forming step according to the first embodiment.
Figure 6D:
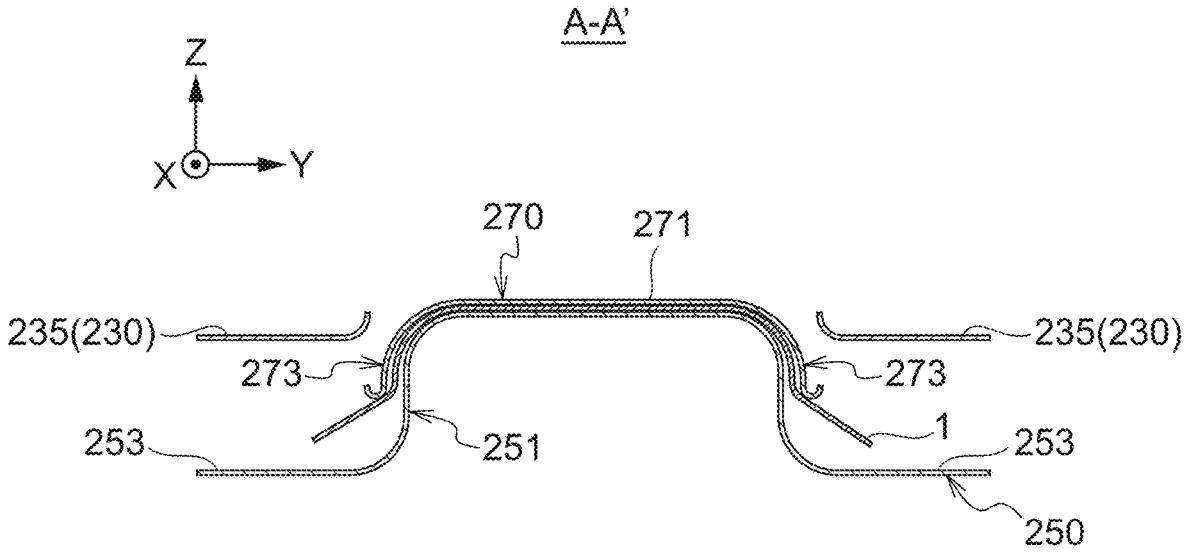
FIG. 6D is an end view schematically describing the first press forming step according to the first embodiment.

Here, forming of the side top sheet ridgeline portion 133 and the central standing flange portion 180 by the first pad 270 will be described in more detail with reference to FIGS. 6A to 6D. FIG. 6A is a view schematically describing a state of forming by the first pad 270. FIGS. 6B to 6D are end views taken along line A-A' and views schematically describing a state of the forming by the first pad 270.

As illustrated in FIG. 6A, the first pad 270 is brought into contact with the upper surface of the blank 1 prior to the draw-forming by the first die 230 and the first punch 250. In this case, as illustrated in FIG. 6B, first, a tip portion of first pad ridgeline forming portion 273 abuts on the blank 1.

Further, when the first pad 270 is moved in the Z direction, as illustrated in FIG. 6C, the blank 1 is sandwiched between the first pad ridgeline forming portion 273 and the first punch peripheral wall forming portion 251, and a part of the side top sheet ridgeline portion 133 is bent. In this case, a surplus thickness of the blank 1 is generated at an intermediate portion of the blank 1 in the Y direction (refer to a dotted line region B in FIG. 6C). That is, as a result of both ends of the blank 1 in the Y direction being sandwiched between the first pad ridgeline forming portion 273 and the first punch 250, deflection occurs at the center portion in the Y direction.

When the first pad 270 is further moved in the Z direction, side top sheet ridgeline portion 133 is bent as illustrated in FIG. 6D. In this case, as illustrated in FIG. 5B, the central standing flange portion 180 and the ridgeline standing flange portion 181 are also bent between the first pad ridgeline forming portion 273 and the first punch peripheral wall forming portion 251. By bending these portions, concentration of tensile strain is suppressed, and concentration of strain in the ridgeline standing flange portion 181 to be finally formed is suppressed.

Further, in the formation of the ridgeline standing flange portion 181, since the excess of the blank 1 illustrated in FIG. 6C is used for performing the bend-forming between the first pad 270 and the first punch 250 due to the material flow, concentration of tensile strain in the ridgeline standing flange portion 181 is further suppressed. As described above, by bringing the first pad 270 into contact with the blank 1 prior to the draw-forming, concentration of distortion at the ridgeline standing flange portion 181 is suppressed, and as a result, occurrence of cracking is suppressed. Hereinbefore, the forming of the side top sheet ridgeline portion 133, the central standing flange portion 180, and the peripheral portion thereof by the first pad 270 has been described.

Figure 7A:
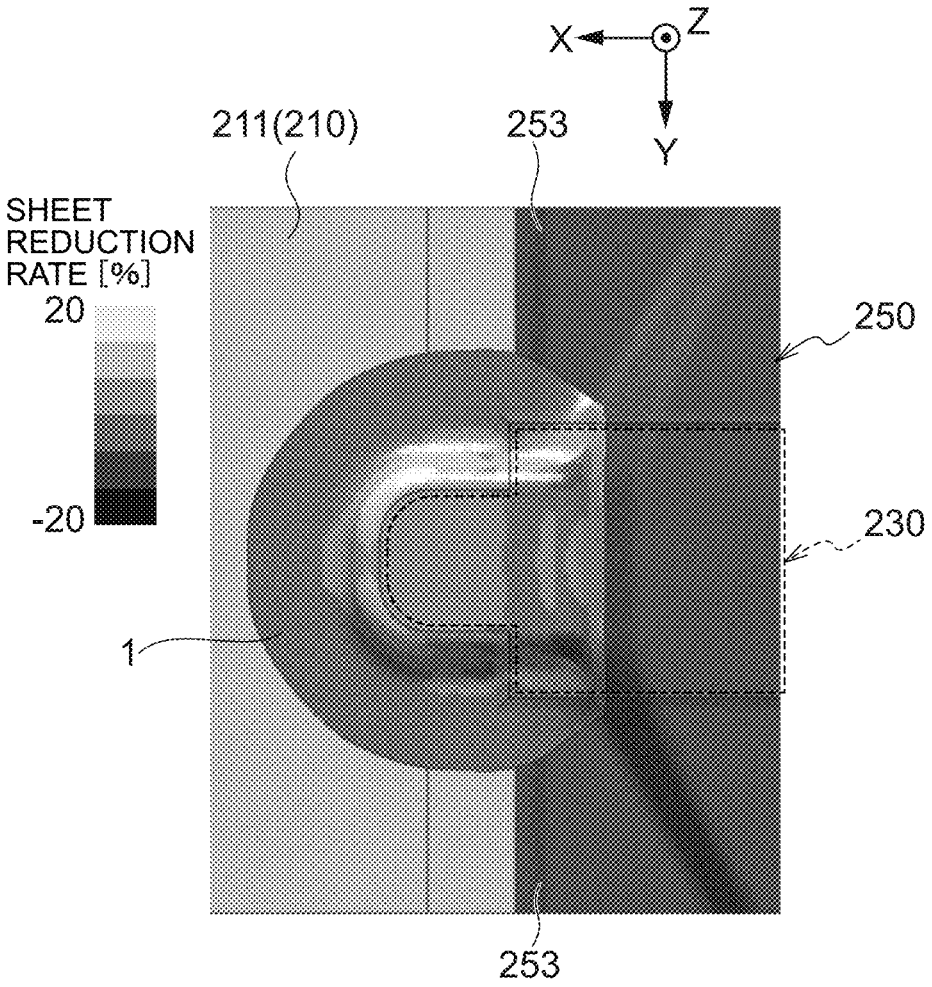
FIG. 7A is a plan view schematically describing the first press forming step according to the first embodiment.
Figure 7B:
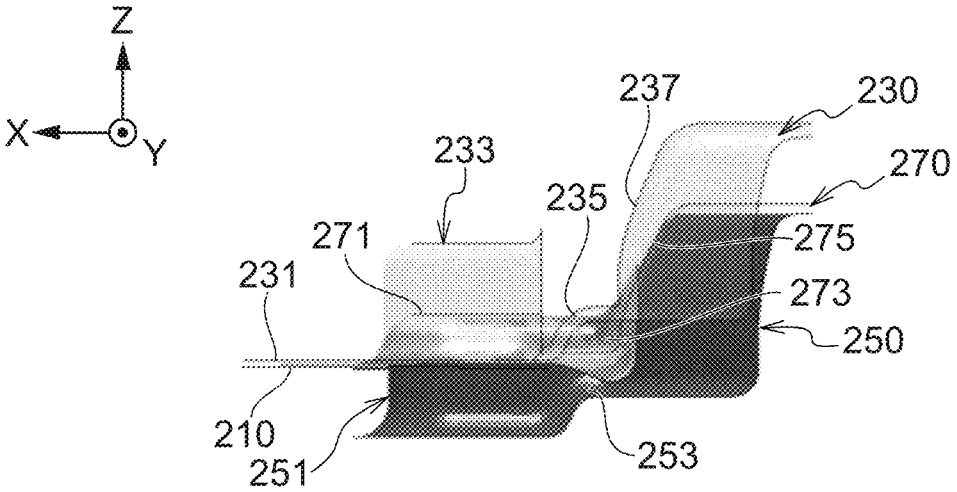
FIG. 7B is a side view schematically describing the first press forming step according to the first embodiment.

Subsequently, as illustrated in FIG. 7A, the blank 1 sandwiched between the first holder 210 and the first die 230 is further moved relative to the first punch 250, and the peripheral wall portion 120 starts to be formed by the draw-forming. Specifically, as illustrated in FIG. 7B, the substantially central portion of the blank 1 is drawn and formed while being sandwiched between the first die peripheral wall forming portion 233 and the first punch peripheral wall forming portion 251. At this time, first, the top sheet ridgeline portion 130 is drawn and formed. Since the top sheet ridgeline portion 130 is formed by the draw-forming, generation of wrinkles at a portion adjacent to the top sheet ridgeline portion 130 is suppressed. In fact, as illustrated in FIG. 7A, a thickness of the blank 1 uniformly decreases from the top sheet ridgeline portion 130 to the top sheet portion 110 and the peripheral wall portion 120 along with the draw-forming, and the generation of wrinkles is suppressed.

In the embodiment in which the first die/punch 200 includes the first pad 270, the first pad 270 moves relative to the first punch 250 together with the first holder 210 and the first die 230. As described with reference to FIG. 6C, the first pad ridgeline forming portion 273 forms the side top sheet ridgeline portion 133 with the first punch 250. Further, the end portion of the blank 1 in the X direction is sandwiched between the first pad standing flange forming portion 275 and the first punch standing flange forming portion 255, and bent to form the central standing flange ridgeline portion 183. During the draw-forming by the first holder 210 and the first die 230, the first pad top sheet pressing portion 271 holds the substantially central portion of blank 1 from above. Finally, the first pad top sheet pressing portion 271 sandwiches the substantially center of the blank 1 with the upper wall surface of the first punch peripheral wall forming portion 251.

Figure 8A:
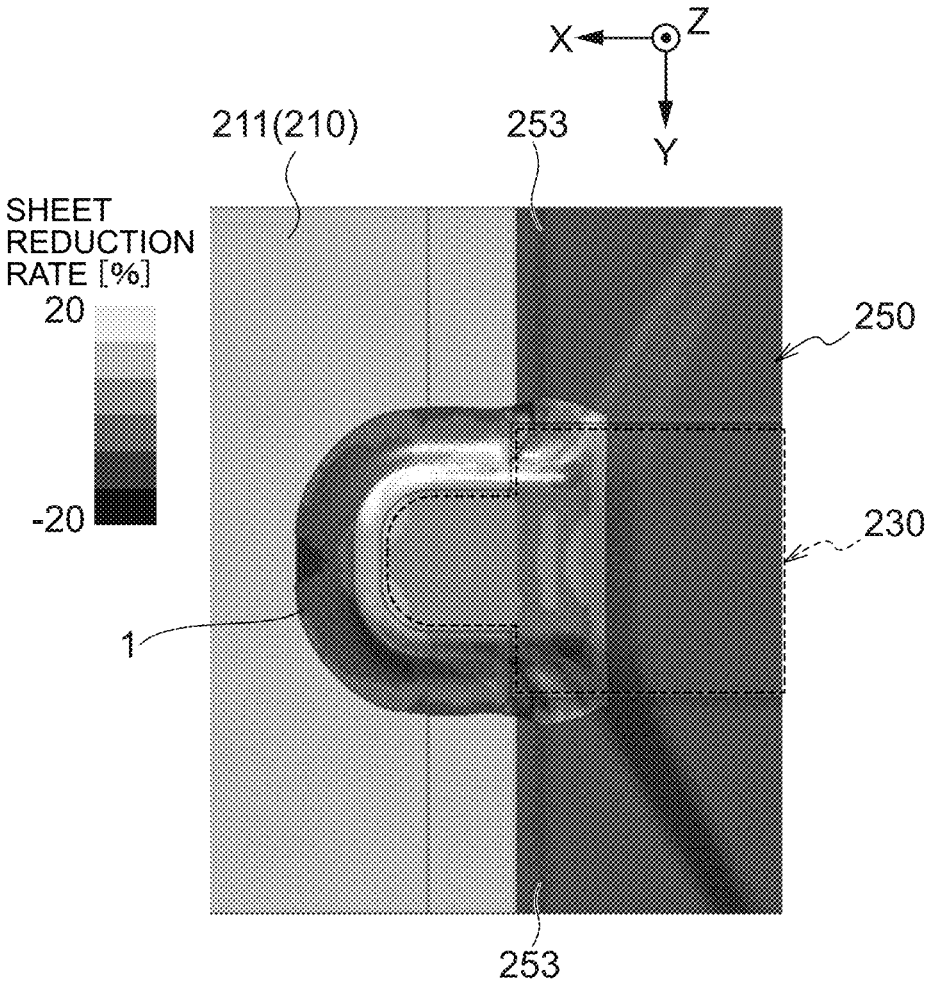
FIG. 8A is a plan view schematically describing the first press forming step according to the first embodiment.
Figure 8B:
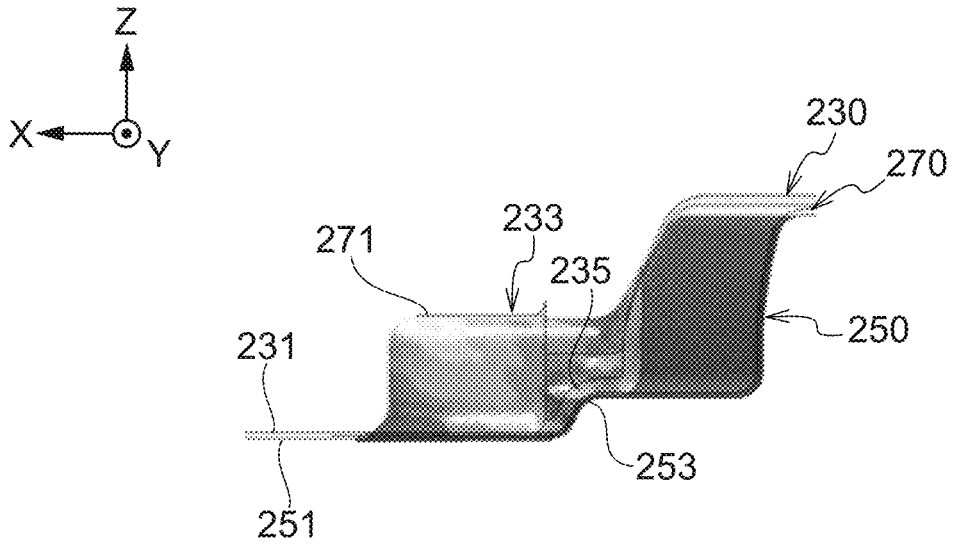
FIG. 8B is a side view schematically describing the first press forming step according to the first embodiment.

As illustrated in FIGS. 8A and 8B, the blank 1 sandwiched between the first holder 210 and the first die 230 is further moved relative to the first punch 250 to form the peripheral wall portion 120. In addition, the blank 1 abuts on the first punch protrusion forming portion 253, whereby the convex flange portion 51 having a protruding shape is bent and formed. Specifically, since the blank 1 is moved relative to the first punch 250, a part of the blank 1 is sandwiched between the first die protrusion forming portion 235 and the first punch protrusion forming portion 253 and deformed into at least one step shape, whereby the convex flange portion 51 is formed. A height of the step shape of the convex flange portion 51 is appropriately set to such an extent that the inclined flange portion 190 can be formed based on a sheet thickness and a tensile strength of the blank 1.

FIG. 9A is an explanatory view schematically illustrating a state after completion of the first press forming. FIG. 9B is a side view illustrating an example of the intermediate formed article 50 after the first press forming. As illustrated in FIGS. 9A and 9B, after completion of the first press forming, the blank 1 is formed into the intermediate formed article 50 having a shape corresponding to the bag-shaped portion 101 and the convex flange portion 51. The intermediate formed article 50 taken out from the first die/punch 200 is used for the second press forming.

In the first press forming, the intermediate formed article 50 may be formed such that an angle formed by portions corresponding to the top sheet portion 110, the peripheral wall portion 120, the floor flange portion 140, or the standing flange portion 160 including the side standing flange portion 170 is large and obtuse. Accordingly, concentration of distortion during forming can be alleviated. In this case, in the second press forming or the third press forming, forming is performed such that an angle formed by each portion in the press-formed article 100 becomes a predetermined angle.

(Second Press Forming)

Next, the second press forming of the manufacturing method according to the first embodiment will be described with reference to FIGS. 10A to 13B. FIGS. 10A to 13B are views schematically illustrating the second press forming step in the first embodiment. In the second press forming, the convex flange portion 51 is formed in the inclined flange portion 190 by bending. Hereinafter, the second press forming will be described with reference to FIGS. 10A to 13B.

Figure 10A:
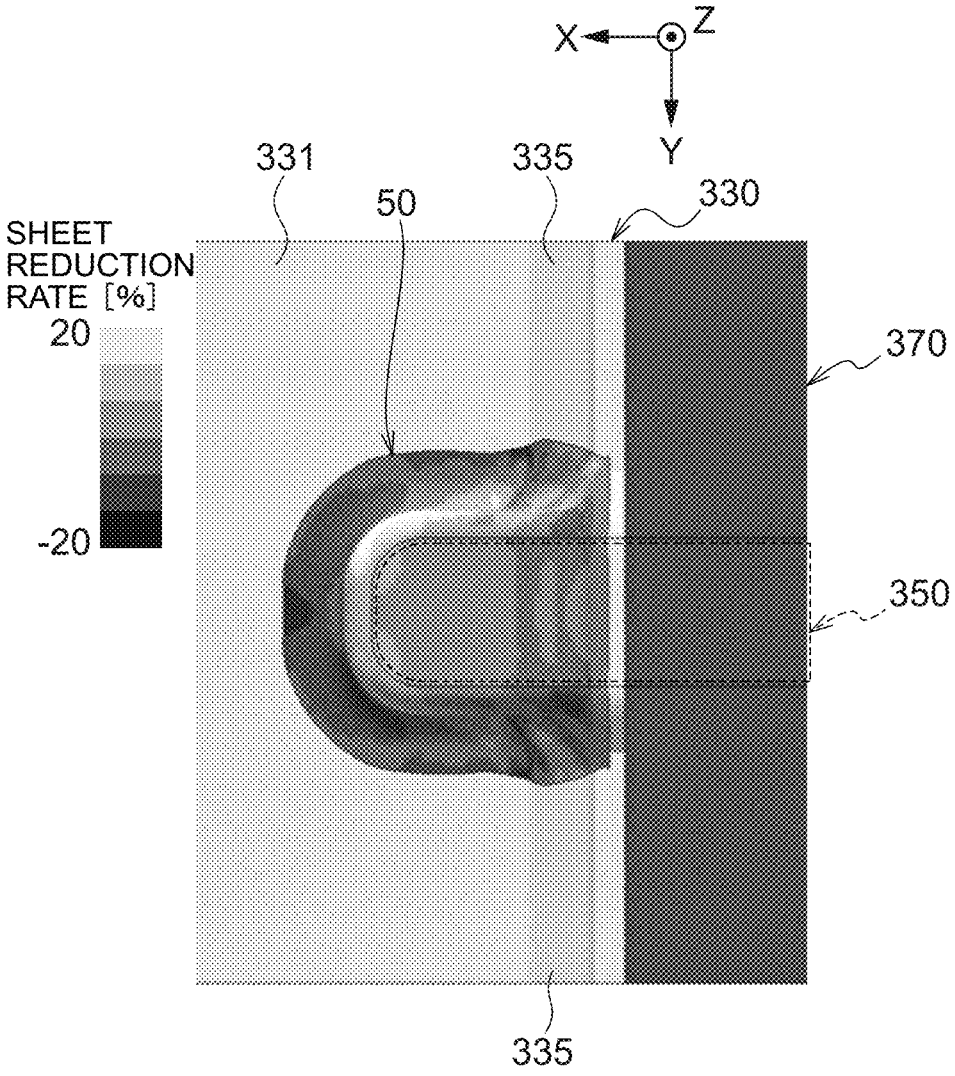
FIG. 10A is a plan view schematically describing a second press forming step according to the first embodiment.
Figure 10B:
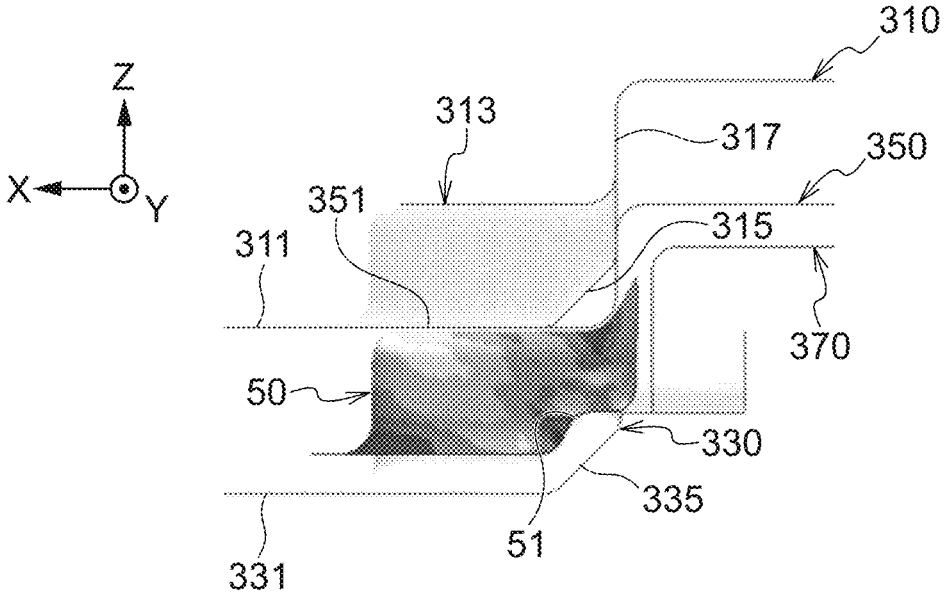
FIG. 10B is a side view schematically describing the second press forming step according to the first embodiment.

First, as illustrated in FIGS. 10A and 10B, the intermediate formed article 50 comes into contact with the second die/punch 300. Specifically, an inner peripheral surface of a portion corresponding to the peripheral wall portion 120 in the intermediate formed article 50 and an outer peripheral surface of the second punch peripheral wall holding portion 333 come into contact with each other. The second pad top sheet pressing portion 351 abuts on a portion corresponding to the top sheet portion 110 of the intermediate formed article 50. The intermediate formed article 50 is pushed down by the second pad top sheet pressing portion 351, guided by the second punch peripheral wall holding portion 333, and moves relative to the second punch 330.

Figure 11A:
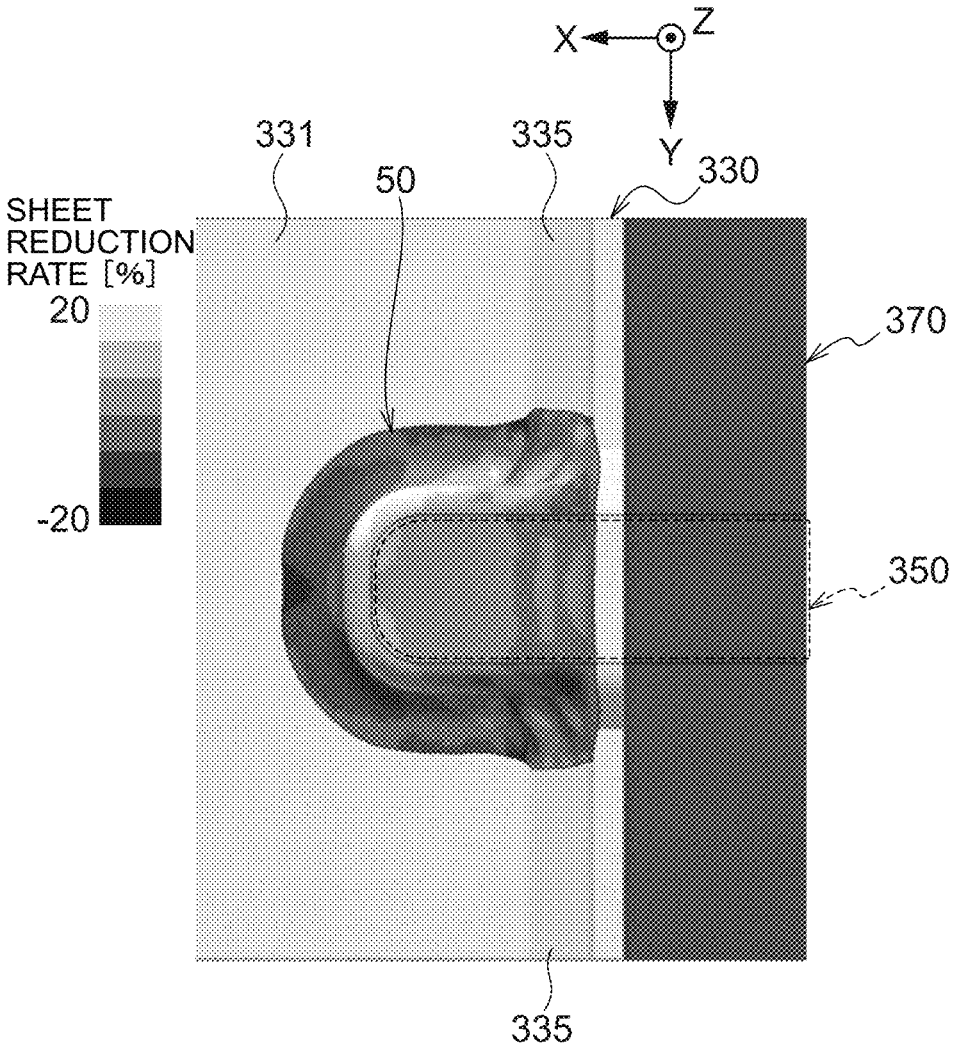
FIG. 11A is a plan view schematically describing the second press forming step according to the first embodiment.
Figure 11B:
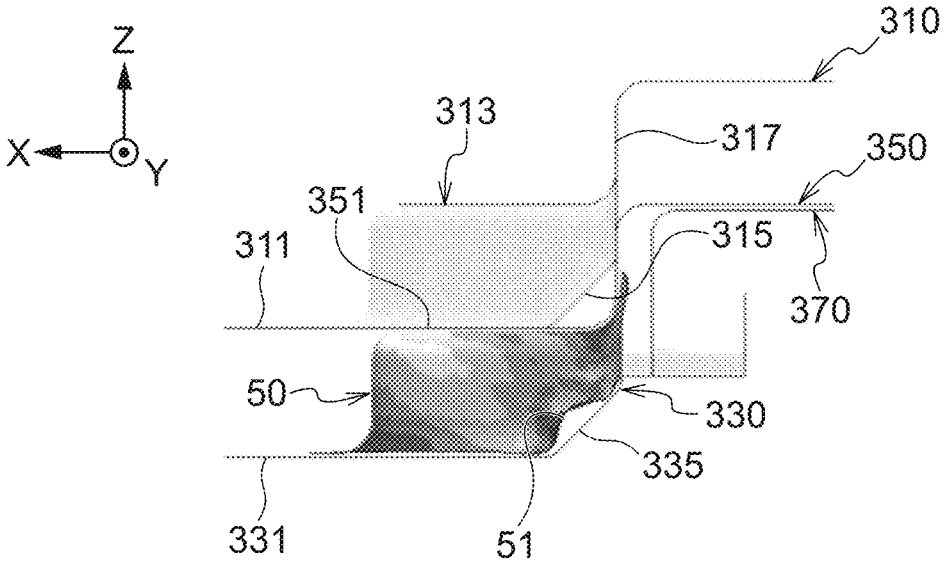
FIG. 11B is a side view schematically describing the second press forming step according to the first embodiment.

Next, as illustrated in FIGS. 11A and 11B, as a result of the intermediate formed article 50 being pushed down by the second pad top sheet pressing portion 351, a portion of the intermediate formed article 50 corresponding to the floor flange portion 140 abuts on the second punch flat surface portion 331. The inner peripheral surface of the bag-shaped portion 101 of the intermediate formed article 50 abuts on the outer peripheral surface of the second punch peripheral wall holding portion 333. As a result, the intermediate formed article 50 is held in the second die/punch 300. In this case, the convex flange portion 51 of the intermediate formed article 50 is located above the second punch inclined surface portion 335.

Figure 12A:
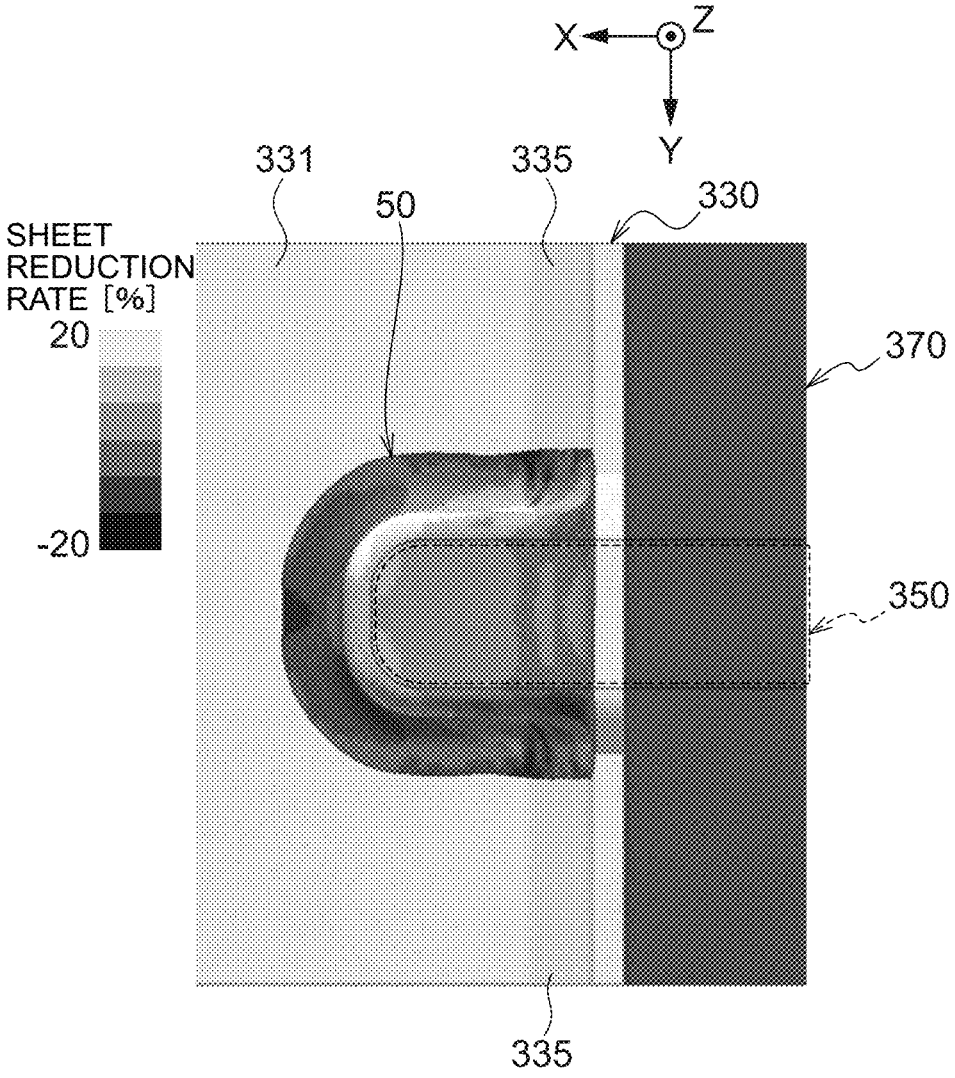
FIG. 12A is a plan view schematically describing the second press forming step according to the first embodiment.
Figure 12B:
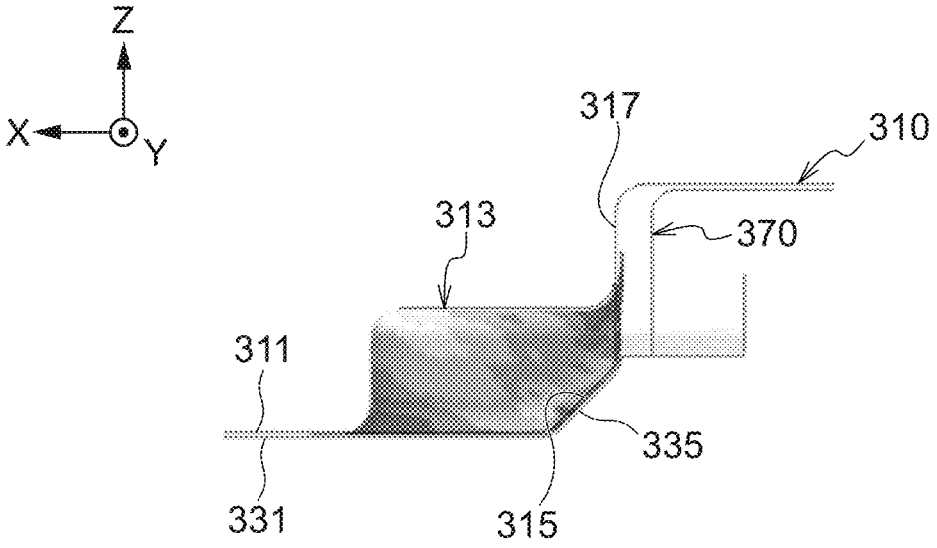
FIG. 12B is a side view schematically describing the second press forming step according to the first embodiment.

Subsequently, as illustrated in FIGS. 12A and 12B, the second die 310 moves along the Z direction toward the intermediate formed article 50. The second die flat surface portion 311 sandwiches a portion corresponding to the floor flange portion 140 of the intermediate formed article 50 with the second punch flat surface portion 331. The second die peripheral wall holding portion 313 sandwiches a portion corresponding to the peripheral wall portion 120 of the intermediate formed article 50 with the second punch peripheral wall holding portion 333. The second die inclined surface portion presses the convex flange portion 51 having a convex shape between the second die inclined surface portion 315 and the second punch inclined surface portion 335 to bend the convex flange portion 51 into a flat shape. As a result, the inclined flange portion 190, which is an inclined wall continuous between the floor flange portion 140 and the side standing flange portion 170, is formed.

Here, for example, the inventors of the present disclosure have found that when a flat inclined wall is formed from the beginning without forming the convex flange portion 51 having a convex shape, a wall thickness is biased (wrinkles are concentrated) at an end portion of the inclined wall (an end portion in the X direction in side view (viewed in the Y direction)). This is considered to be because when the flat shape is directly formed, compressive strain concentrates on the end portion of the inclined wall due to material flow during press forming, and more wrinkles are formed. Therefore, as a result of intensive studies, the inventors of the present disclosure have found that it is possible to disperse wrinkles and suppress concentration of wrinkles by once forming the convex flange portion 51 having a convex shape and crushing the convex flange portion 51. Specifically, by pressing the convex flange portion 51 of the intermediate formed article 50 to form a flat shape, concentration of wrinkles in the inclined flange portion 190 of the press-formed article 100 is suppressed. In particular, when the press-formed article 100 is made of a high-tensile steel sheet, the concentration of wrinkles can be suppressed by pressing the convex flange portion 51 to form the inclined flange portion 190.

Figure 13A:
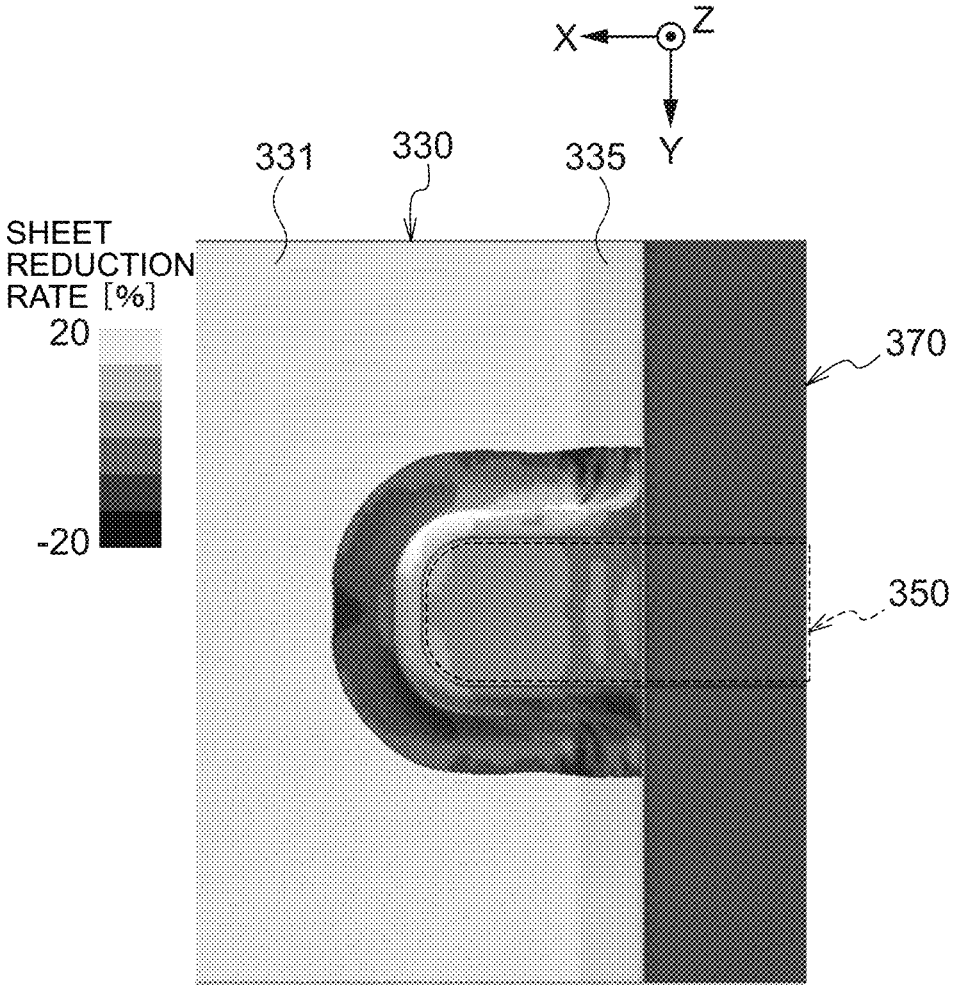
FIG. 13A is a plan view schematically describing the second press forming step according to the first embodiment.
Figure 13B:
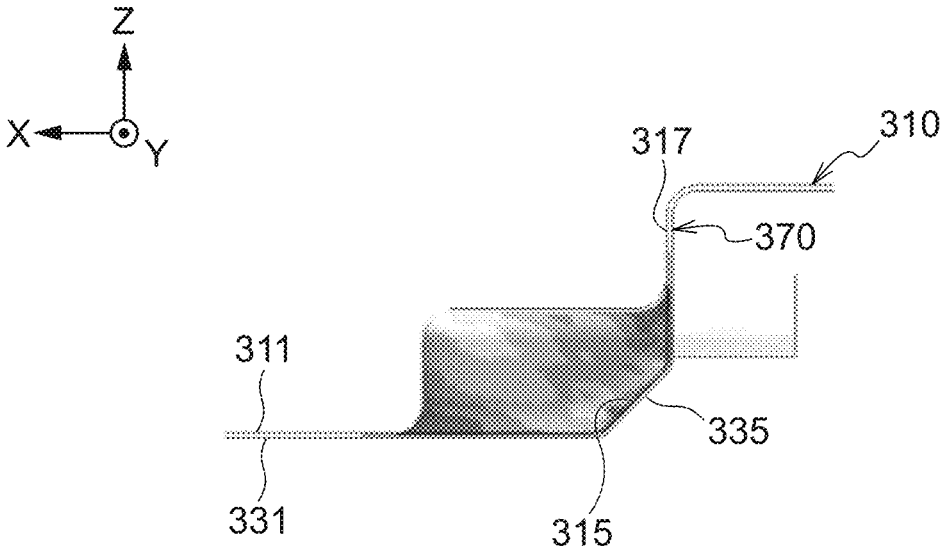
FIG. 13B is a side view schematically describing the second press forming step according to the first embodiment.

Subsequently, as illustrated in FIGS. 13A and 13B, the second cam 370 abuts on the standing flange portion of the intermediate formed article 50 along the X direction (refer to the arrow in FIG. 13). That is, the second cam 370 sandwiches a portion corresponding to the standing flange portion 160 of the intermediate formed article 50 with the second punch standing flange forming portion 337. Hereinbefore, the first press forming and the second press forming in the method of manufacturing the press-formed article 100 according to the first embodiment have been described. The method of manufacturing the press-formed article 100 according to the first embodiment may include various additional steps necessary for manufacturing the press-formed article 100 in addition to the first press forming and the second press forming.

(Third Press Forming)

The method of manufacturing the press-formed article 100 according to the first embodiment may include third press forming. The third press forming is a step performed after the second press forming in order to reduce the curvature radius of the ridgeline portion of the press-formed article 100 and improve the shape accuracy. FIGS. 14A to 16B are schematic views for describing the third press forming in the method of manufacturing the press-formed article 100 according to the first embodiment. Hereinafter, the third press forming will be described with reference to FIGS. 14A to 16B.

Figure 14A:
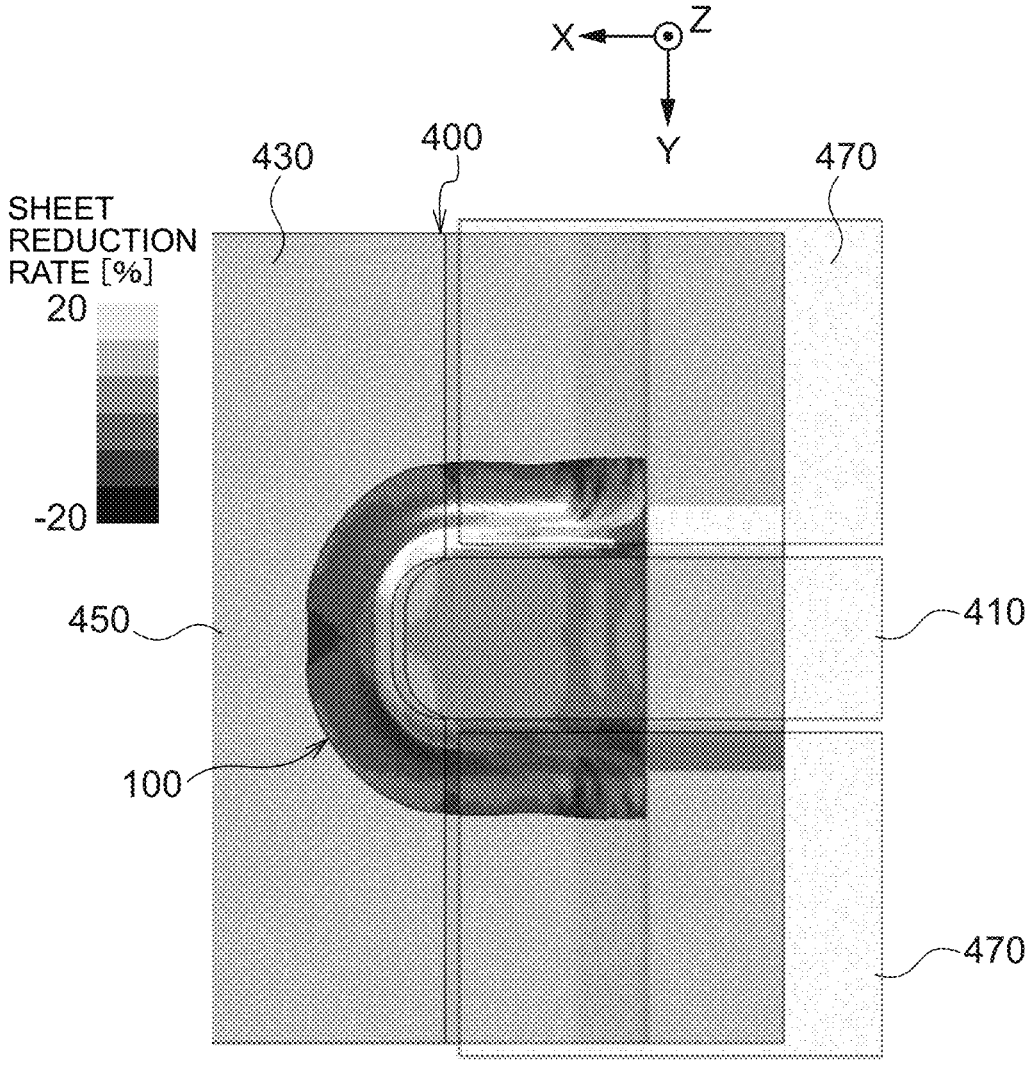
FIG. 14A is a plan view schematically describing a third press forming step according to the first embodiment.
Figure 14B:
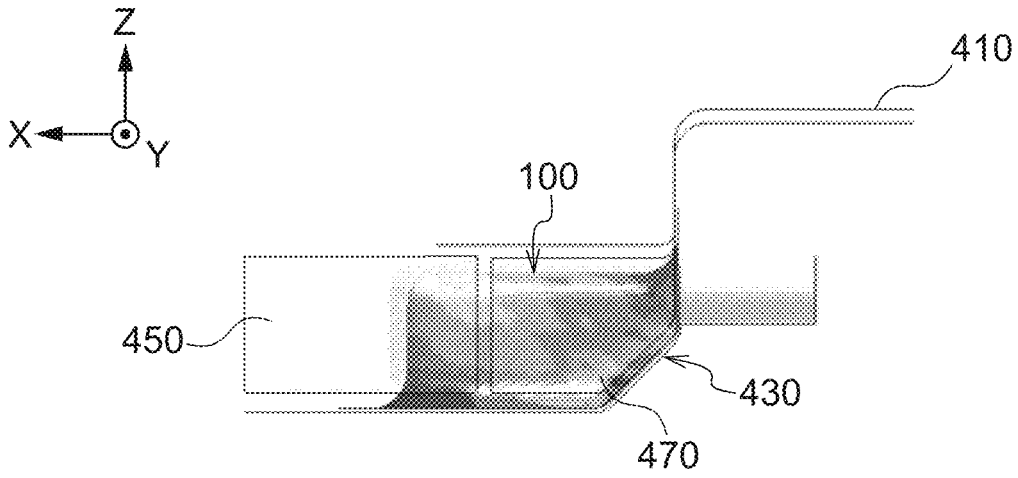
FIG. 14B is a side view schematically describing the third press forming step according to the first embodiment.

As illustrated in FIGS. 14A and 14B, the press-formed article 100 is disposed in the third die/punch 400. The third die/punch 400 includes a third pad 410, a third punch 430, a third central standing wall cam 450, and a third side standing wall cam 470. The third punch 430 supports the bag-shaped portion 101 of the press-formed article 100 from the inside, and supports the floor flange portion 140 and the standing flange portion. The third pad 410 can press the top sheet portion 110 of the press-formed article 100 from above. The third central standing wall cam 450 faces the central standing wall portion 121 and the ridgeline standing wall portion 125 of the press-formed article 100, and the third side standing wall cam 470 faces the side standing wall portion 123 of the press-formed article 100.

Figure 15A:
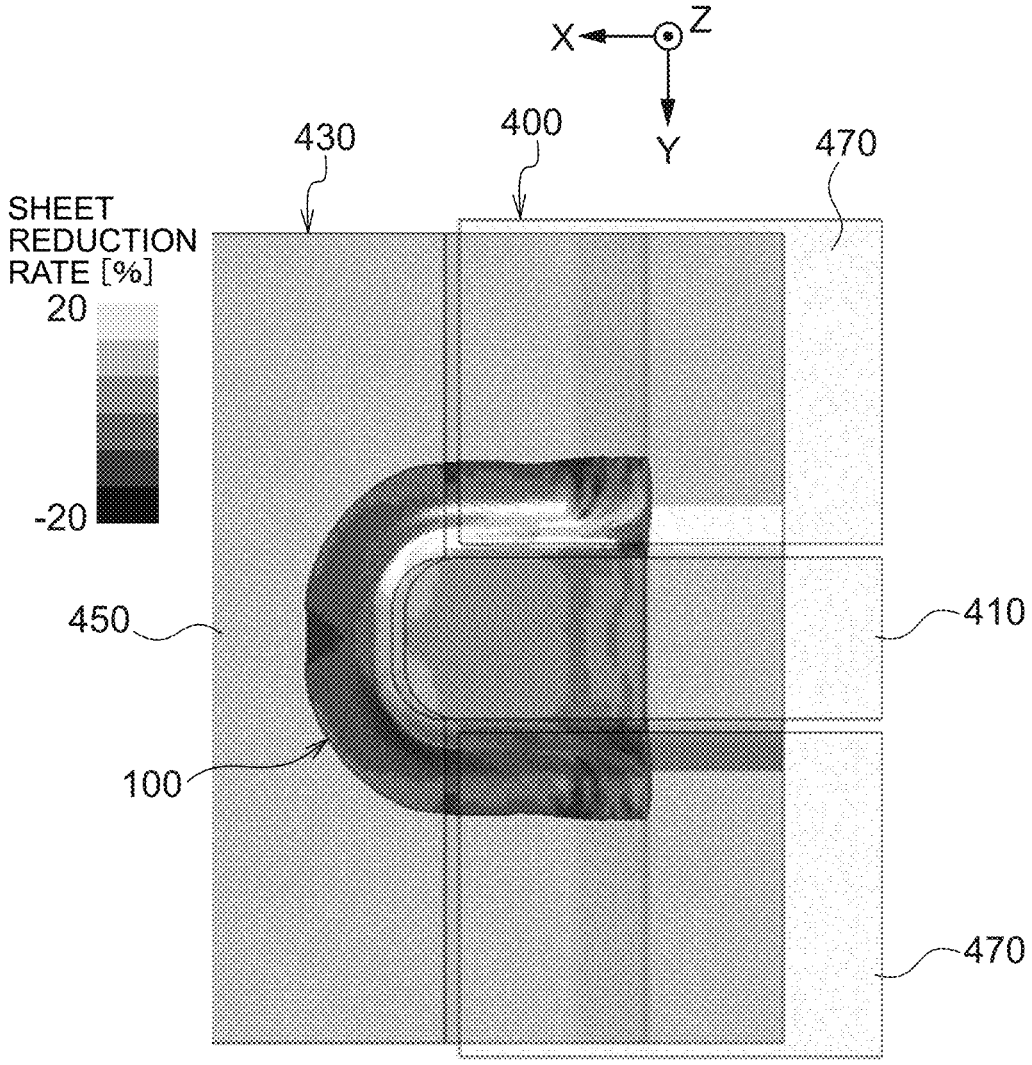
FIG. 15A is a plan view schematically describing the third press forming step according to the first embodiment.
Figure 15B:
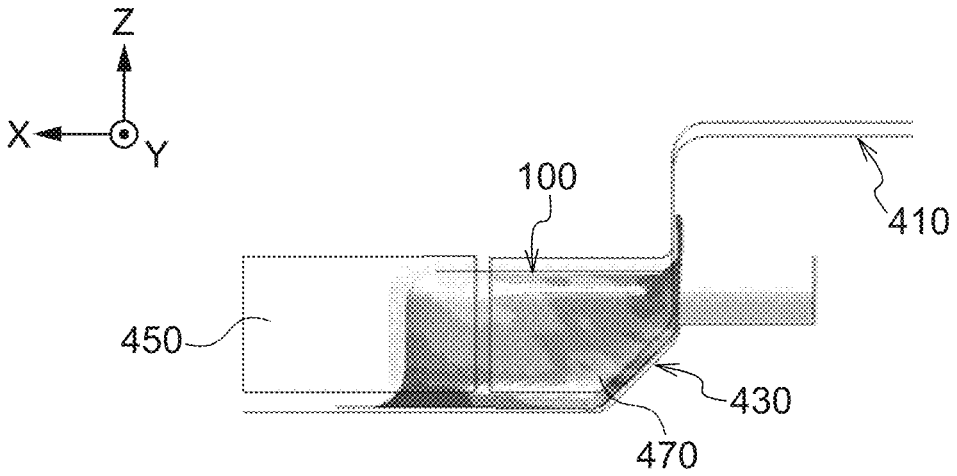
FIG. 15B is a side view schematically describing the third press forming step according to the first embodiment.
Figure 16A:
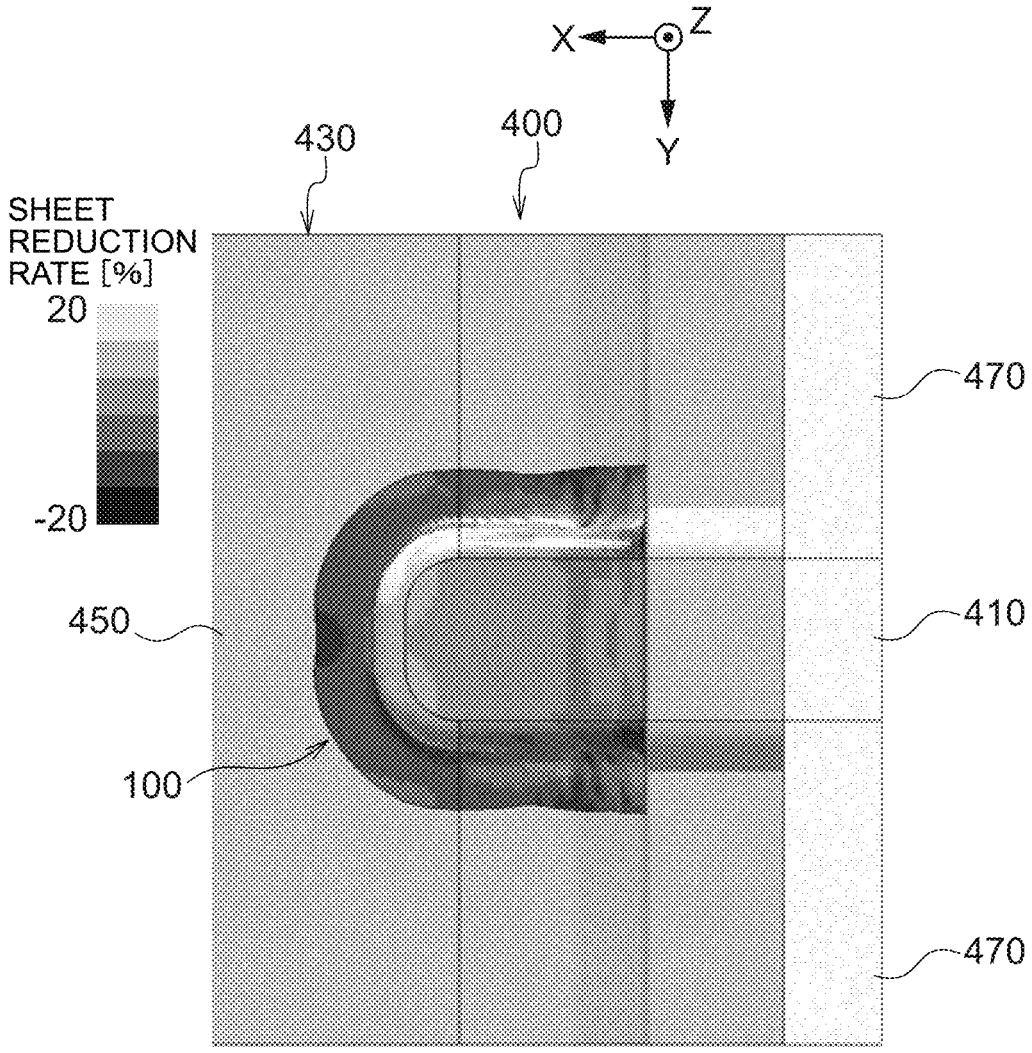
FIG. 16A is a plan view schematically describing the third press forming step according to the first embodiment.
Figure 16B:
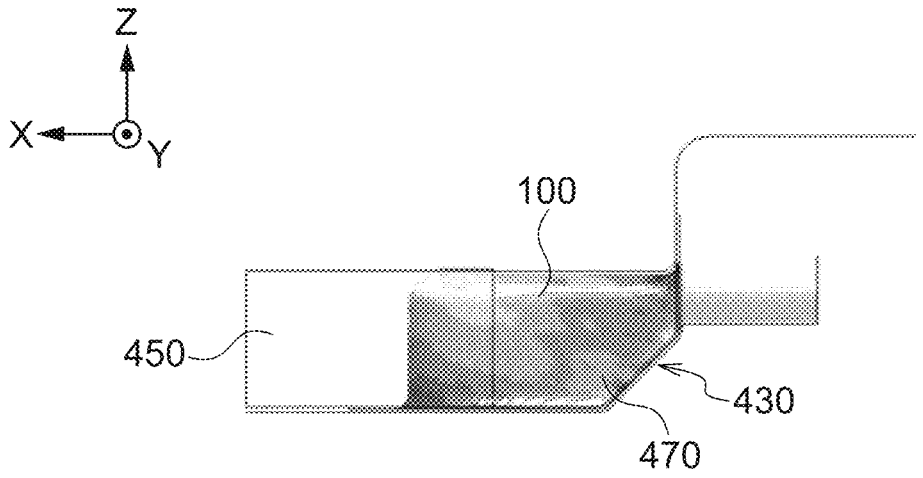
FIG. 16B is a side view schematically describing the third press forming step according to the first embodiment.

As illustrated in FIGS. 15A and 15B, the press-formed article 100 is held by the third pad 410 and the third punch 430. Subsequently, as illustrated in FIGS. 16A and 16B, the third central standing wall cam 450 and the third side standing wall cam 470 move toward the press-formed article 100 (refer to arrows in FIG. 16). As a result, the press-formed article 100 is sandwiched between the third central standing wall cam 450 and the third side standing wall cam 470, and the third punch 430, and the curvature radius of each portion of the press-formed article 100 becomes smaller than that before the third press forming. As a result, the press-formed article 100 has a predetermined shape. The method of manufacturing the press-formed article 100 according to the first embodiment has been described above.

Figure 17:
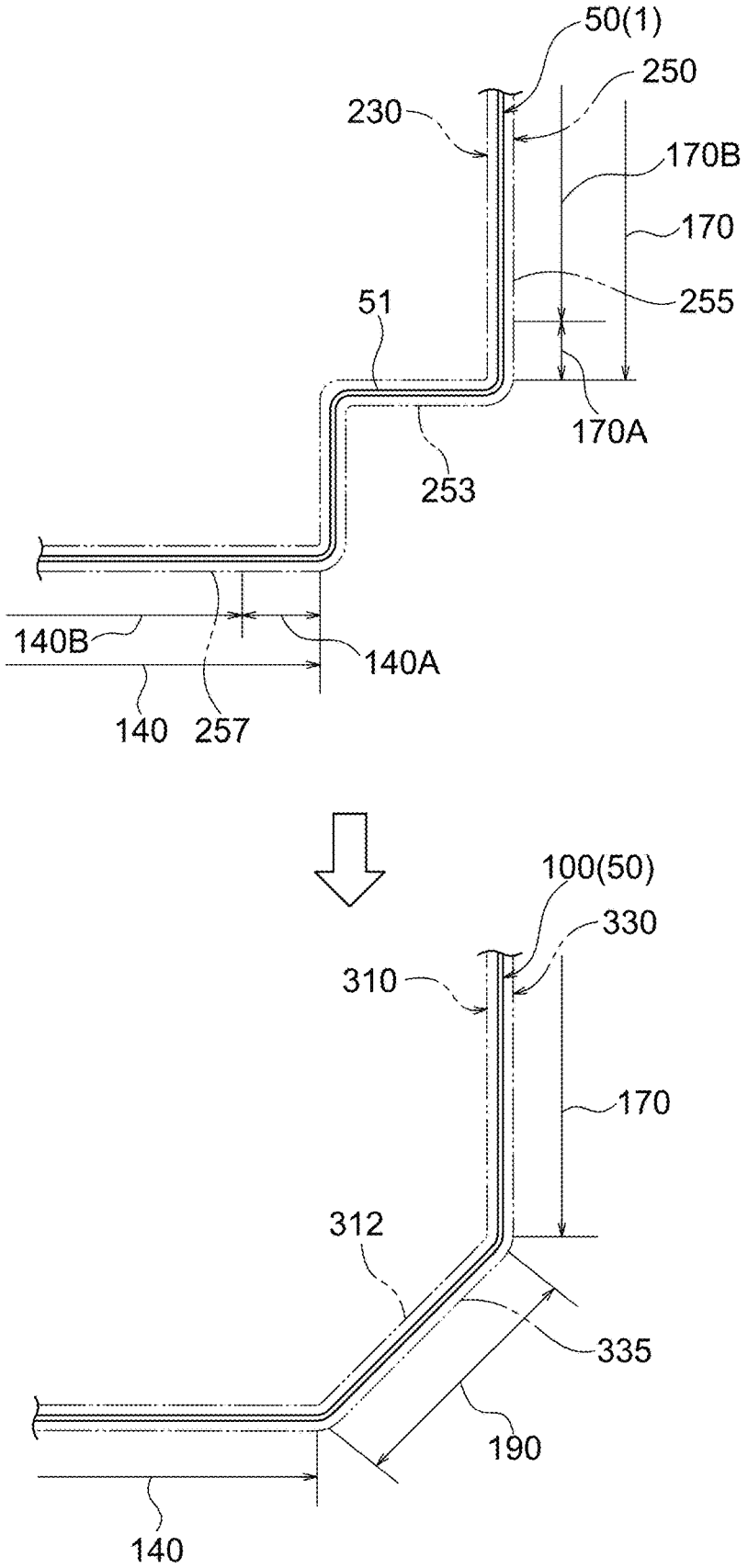
FIG. 17 is a supplementary explanatory view of the first embodiment.

The first embodiment will be supplemented as follows with reference to FIG. 17.

In the first embodiment, the first punch 250 includes: the first punch protrusion forming portion 253 that abuts on the region to be the inclined flange portion 190 on one surface of the blank 1 and bends the blank 1 together with the first die 230 to form the convex flange portion 51; the first punch standing flange forming portion 255 that abuts on a region to be the side standing flange portion 170 on one surface of the blank 1 and bends the blank 1 together with the first die 230 to form at least the side standing flange main body portion 170B located on a side opposite to the inclined flange portion 190 with respect to the end portion 170A of the side standing flange portion 170 on the inclined flange portion 190 side; and a first punch floor flange forming portion 257 that abuts on a region to be the floor flange portion 140 on one surface of the blank 1 and bends the blank 1 together with the first die 230 to form at least the floor flange main body portion 140B located on a side opposite to the inclined flange portion 190 with respect to the end portion 140A of the floor flange portion 140 on the inclined flange portion 190 side.

In the first embodiment, the first punch standing flange forming portion 255 has a shape that bends the entire side standing flange portion 170 including the end portion 170A of the side standing flange portion 170 on the inclined flange portion 190 side and the side standing flange main body portion 170B. In the first embodiment, the first punch floor flange forming portion 257 has a shape that bends the entire floor flange portion 140 including the end portion 140A of the floor flange portion 140 on the inclined flange portion 190 side and the floor flange main body portion 140B.

The second die 310 includes an inclined surface 312 that abuts on the other surface of the convex flange portion 51. The second punch 330 is provided on one surface side of the convex flange portion 51, and has a second punch inclined surface portion 335 that bends the inclined flange portion 190 from the convex flange portion 51 by sandwiching the convex flange portion 51 with the second die 310.

In the first embodiment, the intermediate formed article 50 is formed from the blank 1 by subjecting the blank 1 to the first press forming including bending the blank 1 by the blank 1 abutting on the first punch protrusion forming portion 253 provided at the first punch 250 to form the convex flange portion 51 having a convex shape formed at the inclined flange portion 190, and bending the blank 1 by the blank 1 abutting on the first punch 250 to form at least the side standing flange main body portion 170B located on the opposite side of the inclined flange portion 190 with respect to the end portion 170A of the side standing flange portion 170 on the inclined flange portion 190 side and the floor flange main body portion 190B located on the opposite side of the inclined flange portion 190 with respect to the end portion 140A of the floor flange portion 140 on the inclined flange portion 190 side.

The first press forming includes bending the blank 1 by the blank 1 abutting on the first punch 250 to form the side standing flange portion 170 including the end portion 170A of the side standing flange portion 170 on the inclined flange portion 190 side and the side standing flange main body portion 170B, and the floor flange portion 140 including the end portion 140A of the floor flange portion 140 on the inclined flange portion 190 side and the floor flange main body portion 140B.

In the first embodiment, the second press forming includes bending the intermediate formed article 50 by the second die 310 and the second punch 330 to form the convex flange portion 51 to the inclined flange portion 190.

Operation and Effect

According to the first embodiment, in the press-formed article 100, the floor flange portion 140 and the side standing flange portion 170 are continuous by the inclined flange portion 190. Further, the floor flange portion 140 and the side standing flange portion 170 extend from the bag-shaped portion 101 and are continuous. As a result, the rigidity of the press-formed article 100 is improved, the resistance force against torsion and crushing increases, and the load transfer capability is also improved.

Further, according to the first embodiment, since the inclined flange portion 190 is formed after the convex flange portion 51 is formed at the portion where the floor flange portion 140 and the side standing flange portion 170 are continuous in the press-formed article 100, it is possible to eliminate the thickness deviation. That is, by once forming the convex flange portion 51 and then flattening the convex flange portion 51, it is possible to suppress the concentration of wrinkles on the end portion of the inclined flange portion 190 due to the material flow during pressing and to disperse the wrinkles of the inclined flange portion 190. As a result, even when the draw-forming is applied to the press-formed article 100 having the bag-shaped portion 101, concentration of wrinkles generated between the floor flange portion 140 and the side standing flange portion 170 can be suppressed.

According to the first embodiment, the bag-shaped portion 101 including the peripheral wall portion 120 of the press-formed article 100 is formed by draw-forming. In addition, the standing flange portion 160 including the convex flange portion 51 and the side standing flange portion 170 is formed by bend-forming. As described above, the press-formed article 100 which has the bag-shaped portion 101 and in which the floor flange portion 140 and the side standing flange portion 170 are continuous is formed by a combination of the draw-forming and the bend-forming, which cannot be realized only by bend-forming.

According to the first embodiment, the convex flange portion 51 has a step shape in a side view. Since the convex flange portion 51 has the step shape, the line length of the convex flange portion 51 in side view is sufficiently secured, and the wrinkles are effectively dispersed during the second press forming. The first embodiment of the present disclosure has been described above.

<Modification 1>

Figure 18:
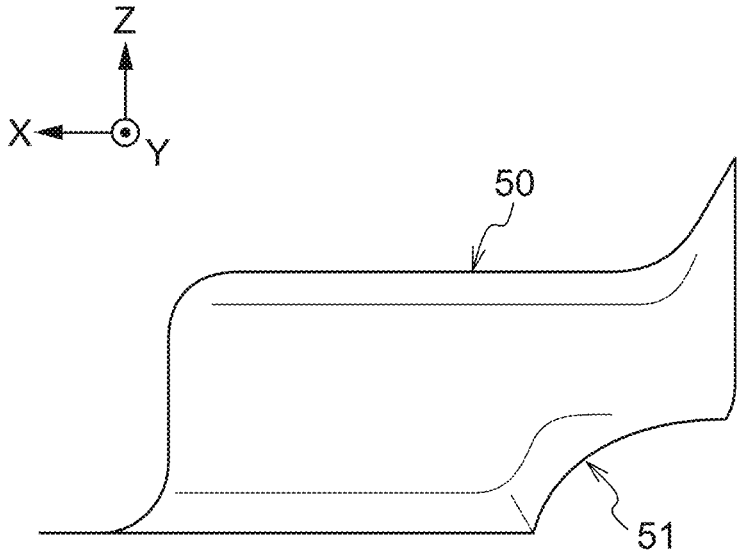
FIG. 18 is a side view of an intermediate formed article according to a modification of the first embodiment.

Next, some modifications of the first embodiment of the present disclosure will be described with reference to FIGS. 18 and 19. In some modified examples, the shape of the convex flange portion 51 of the intermediate formed article 50 is different from that of the above embodiment. FIG. 18 is a side view of an intermediate formed article 50 according to a modification. As illustrated in FIG. 18, in the present modification, the convex flange portion 51 has an arc shape in side view (as viewed in the Y direction in FIG. 18). As a result, the convex flange portion 51 can be easily formed in the first press forming, and the effect of suppressing the concentration of wrinkles can be secured.

Figure 19:
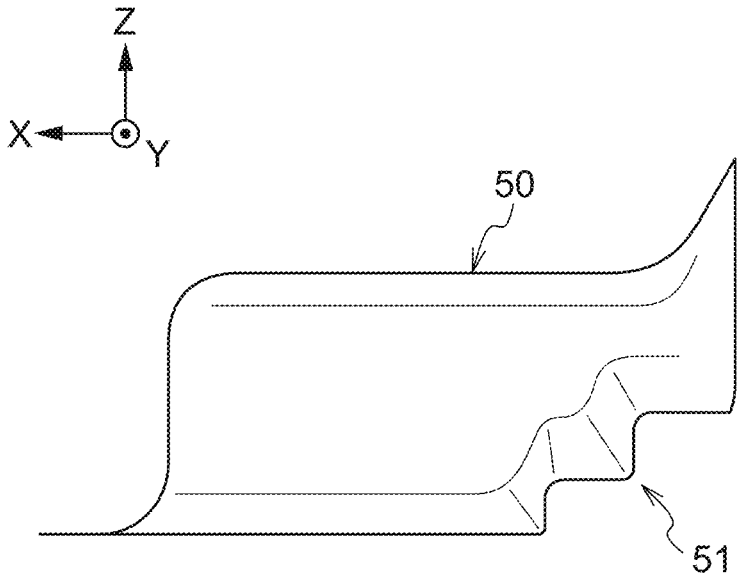
FIG. 19 is a side view of an intermediate formed article according to another modification of the first embodiment.

FIG. 19 is a side view of an intermediate formed article 50 according to another modification. As illustrated in FIG. 19, in the present modification, the convex flange portion 51 has a plurality of step shapes in a side view. As a result, the line length of the convex flange portion 51 in side view is secured longer, and the wrinkles are more effectively dispersed. In addition, by adjusting the number of step shapes, it is easy to cope with a change in the distance between the floor flange portion 140 and the side standing flange portion 170. In the modification described above, the configuration other than the shape of the convex flange portion 51 is the same as that of the embodiment described above, and thus the description thereof will be omitted.

<Modification 2>

Figure 20:
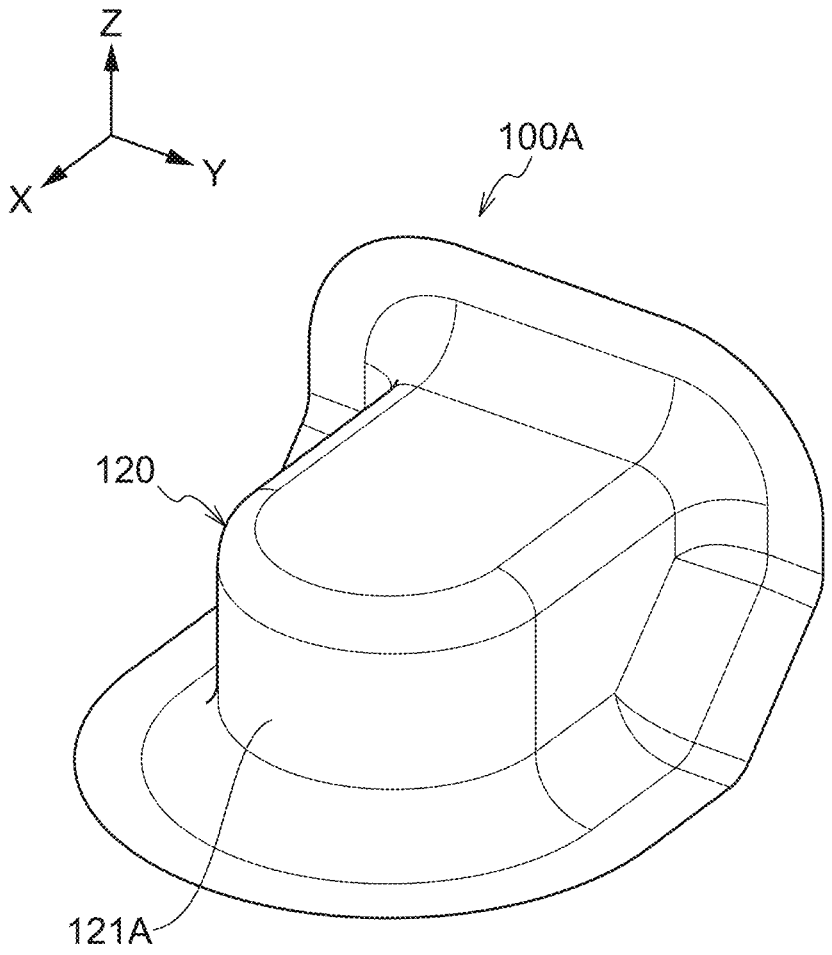
FIG. 20 is a perspective view of a press-formed article according to a modification of the first embodiment.

Next, some modifications of the first embodiment of the present disclosure will be described with reference to FIGS. 20 to 22. In some modifications, the shape of the press-formed article 100 is different as compared to the above embodiment. FIG. 20 is a perspective view of a press-formed article 100A according to a modification. As illustrated in FIG. 20, in the press-formed article 100A of the present modification, in the peripheral wall portion 120, a central standing wall portion 121A is formed in an arc shape in plan view (as viewed in the Z direction illustrated in FIG. 20). Thus, the bag-shaped portion 101 can be easily formed. In addition, interference between the press-formed article 100A and peripheral components can be suppressed.

Figure 21:
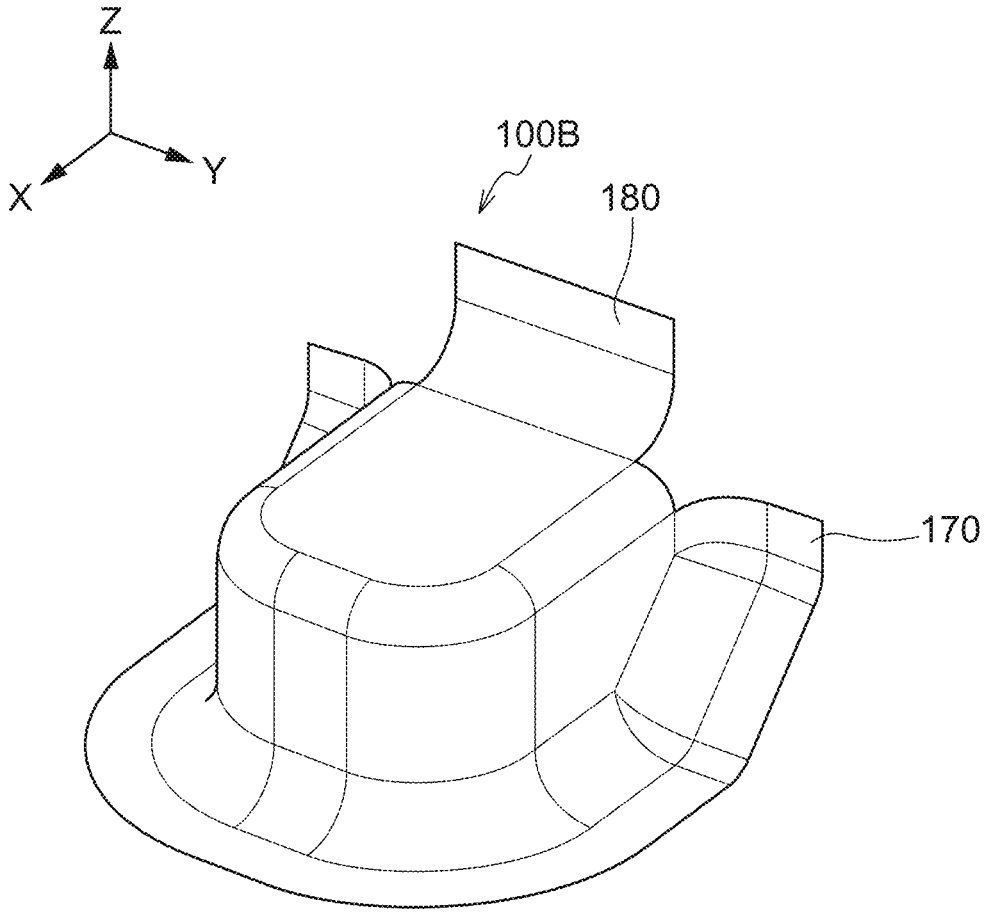
FIG. 21 is a perspective view of a press-formed article according to another modification of the first embodiment.

FIG. 21 is a perspective view of a press-formed article 100B according to another modification. As illustrated in FIG. 21, the press-formed article 100B of the present modification has a shape in which a part of the standing flange portion is cut. Specifically, the press-formed article 100B does not have the ridgeline standing flange portion 181 and the standing flange corner portion 185, and is discontinuous at this portion. This facilitates forming of the central standing flange portion 180 and the side standing flange portion 170.

Figure 22:
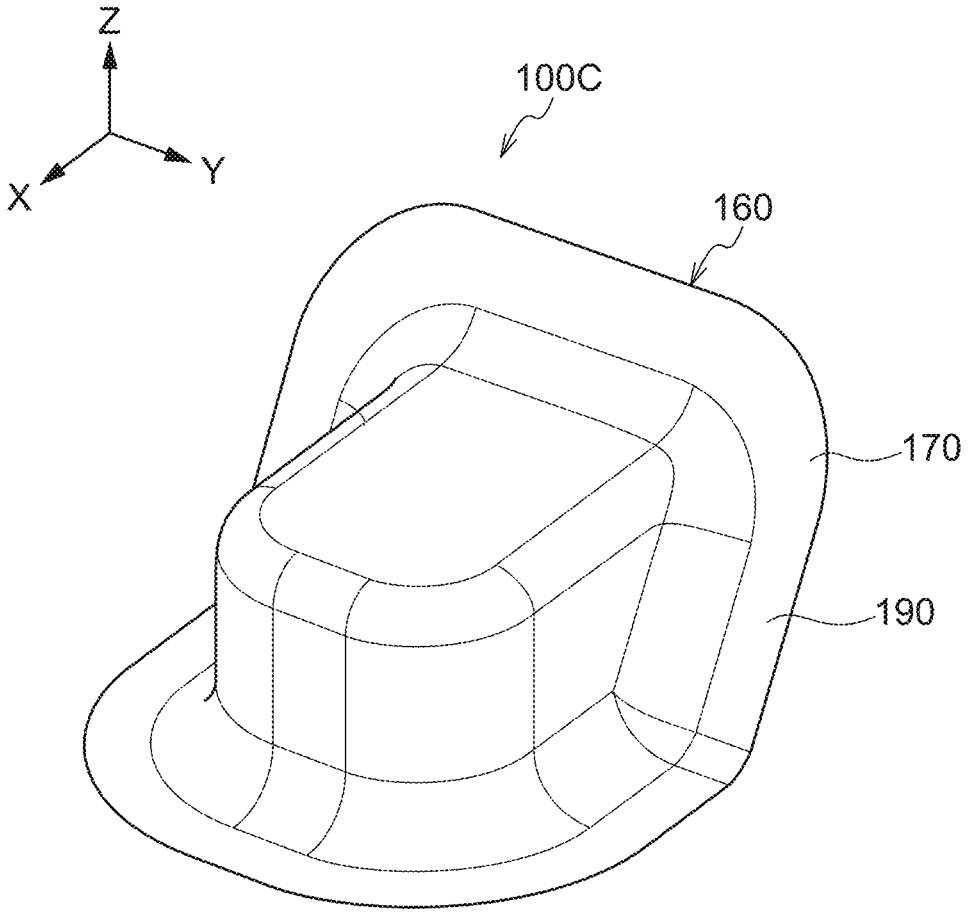
FIG. 22 is a perspective view of a press-formed article according to still another modification of the first embodiment.

FIG. 22 is a perspective view of a press-formed article 100C according to still another modification. As illustrated in FIG. 22, in the press-formed article 100C of the present modification, the inclined flange portion 190 and the standing flange portion 160 including the side standing flange portion 170 are integrally formed. When the inclined flange portion 190 and the side standing flange portion 170 are integrated, the load transfer capability of the press-formed article 100 when the standing flange portion 160 is entirely fastened to another member (not illustrated) is further improved. In addition, the concentration of wrinkles, which can disperse wrinkles in the inclined flange portion 190, is further suppressed. In the modifications described above, the configurations other than the shapes of the press-formed articles 100A, 100B, and 100C are the same as those of the above-described embodiment, and thus the description thereof is omitted.

Example 1

In order to confirm the effects of the manufacturing method, the press-formed article 100, and the press forming apparatus according to the present disclosure, characteristics of the press-formed article 100 formed by applying the manufacturing method according to the first embodiment were evaluated with respect to the suppression of the influence of wrinkles.

Specifically, simulation calculation assuming the manufacturing method according to the first embodiment was performed, and the sheet thickness reduction rate (sheet reduction rate) in the model shape of the calculation result was used as a guide for generation of wrinkles. The simulation conditions were press forming using a steel sheet having a tensile strength of 440 MPa class and a sheet thickness of about 2.3 mm.

Figure 23:
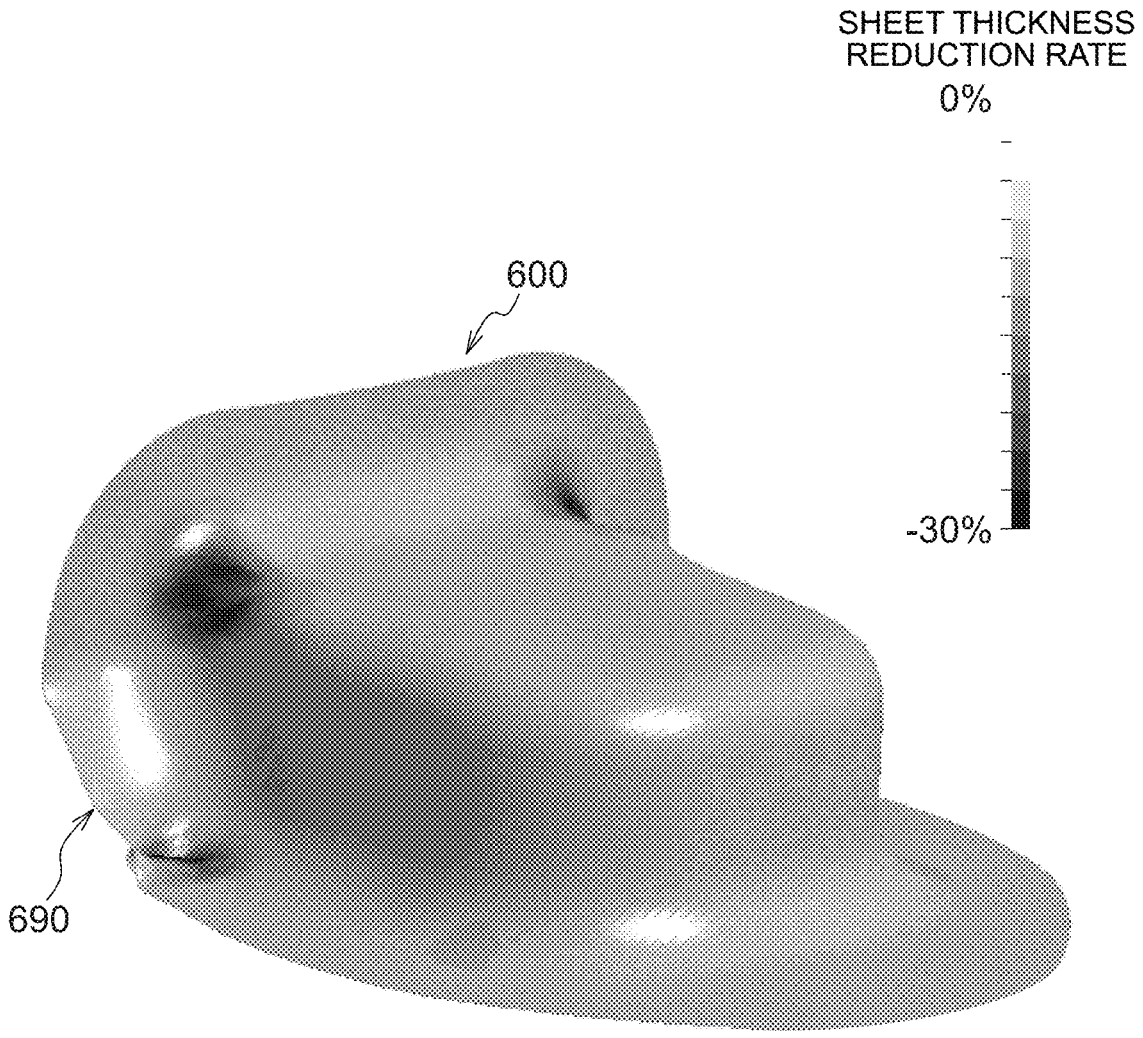
FIG. 23 is a view illustrating a simulation result as a comparative example.

A simulation result will be described with reference to FIGS. 23 to 25. FIG. 23 is a view illustrating a simulation result of Comparative Example 1. Comparative Example 1 illustrates a result of forming an inclined wall on a continuous flange in one step in press forming. Specifically, this is a case where the flat blank 1 is press-formed using a die/punch corresponding to the second die/punch 300 according to the first embodiment. As illustrated in FIG. 23, in a press-formed article 600 according to Comparative Example 1, deformation such as entanglement of a sheet material occurred at the end portion of the inclined flange portion 690.

Figure 24:
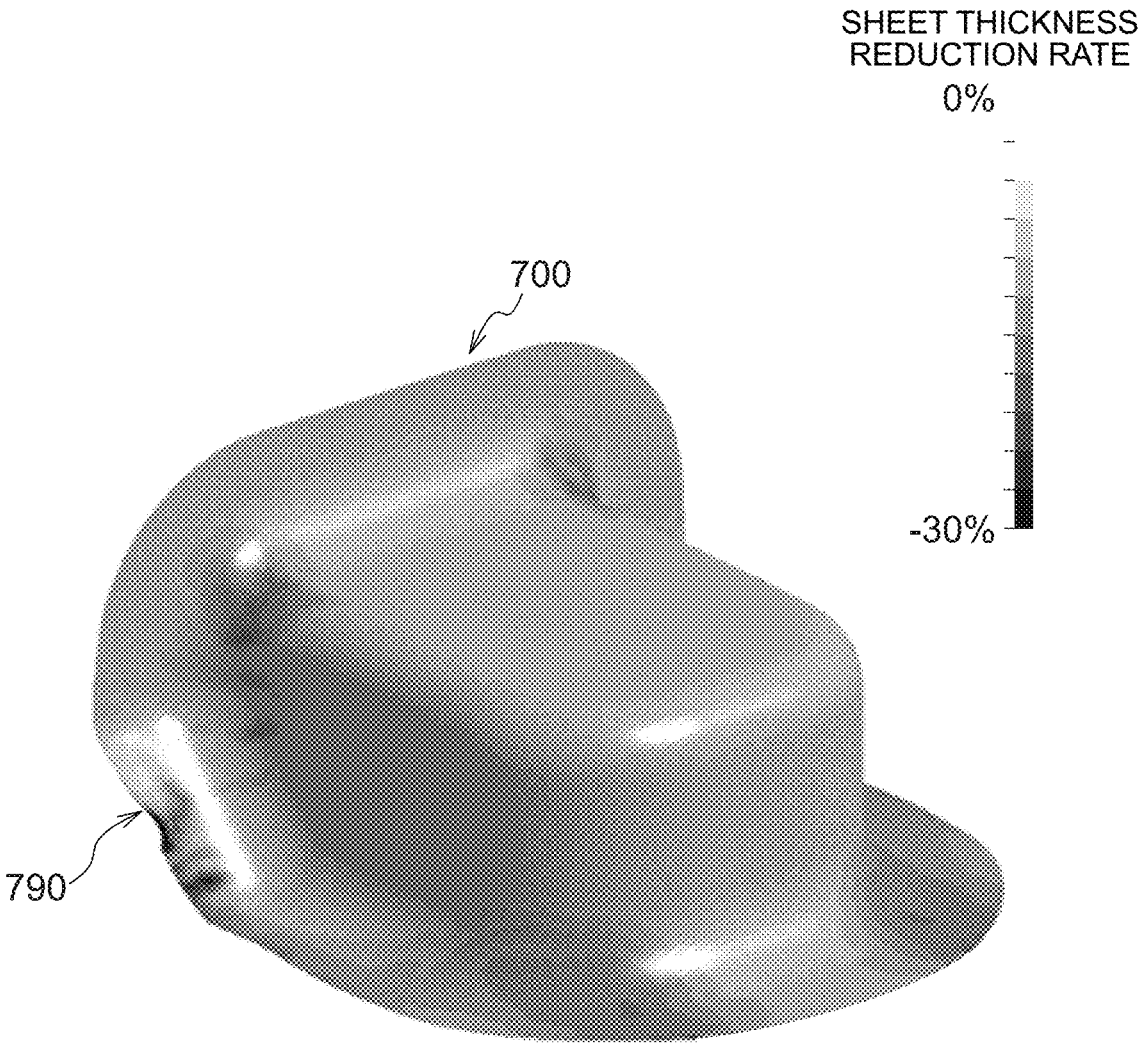
FIG. 24 is a view illustrating a simulation result as a comparative example.

FIG. 24 is a view illustrating a simulation result of Comparative Example 2. In Comparative Example 2, press forming was performed in two steps, but the inclined wall was formed instead of the convex shape in a first step, and the inclined wall was further formed in the continuous flange in a second step. Specifically, in the die/punch corresponding to the first die/punch 200 according to the first embodiment, only the convex flange forming portion of the first punch 250 is not a step but an inclined surface, and press forming is performed with a die/punch corresponding to the second die/punch 300. As illustrated in FIG. 24, in the press-formed article 700 according to Comparative Example 2, the inclined flange portion 790 was not deformed as in Comparative Example 1, but had a portion where the sheet thickness greatly increased, and large wrinkles were generated.

Figure 25:
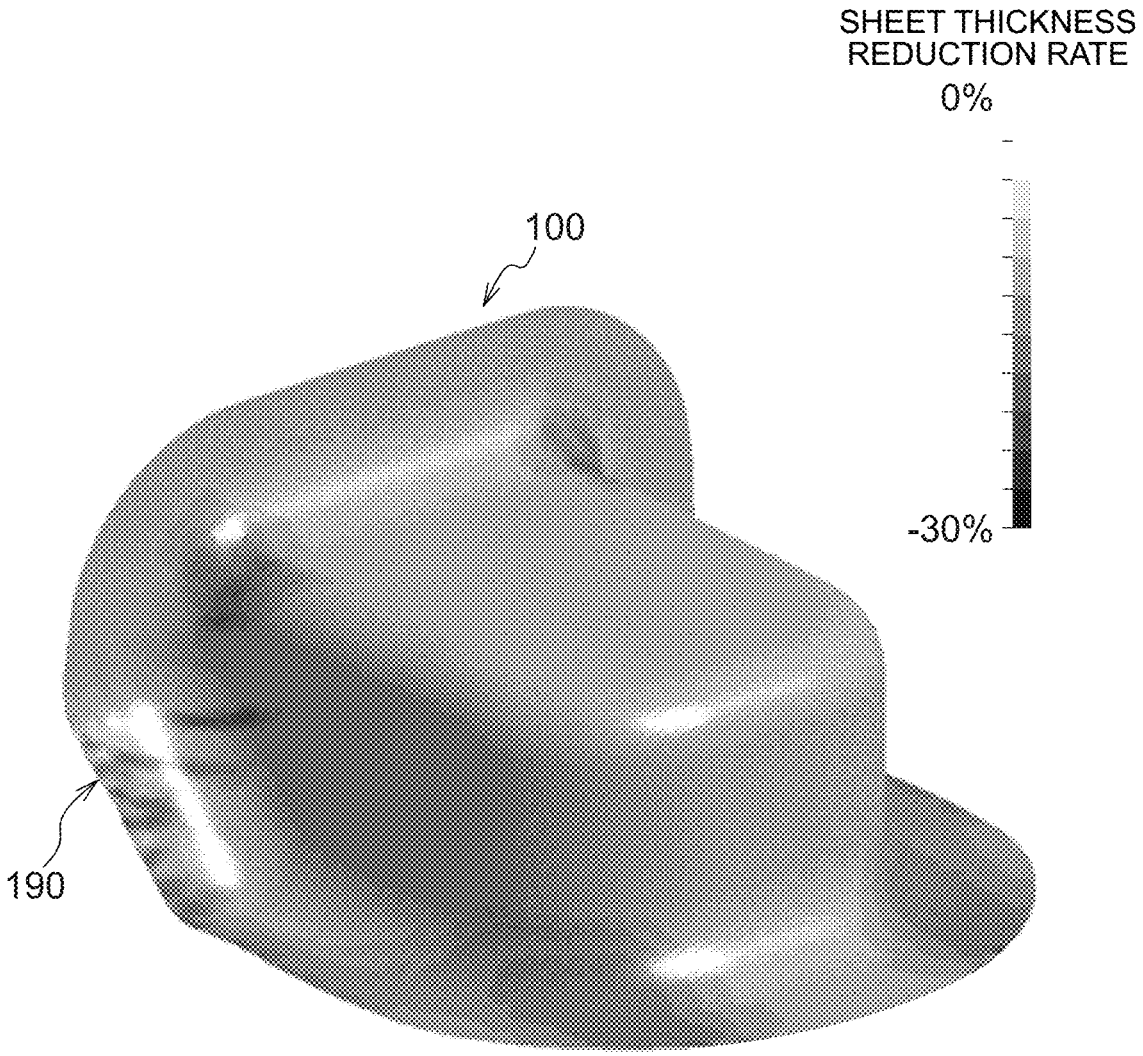
FIG. 25 is a view illustrating a simulation result as an example.

FIG. 25 is a view illustrating a simulation result of the example. As illustrated in FIG. 25, in the press-formed article 100 according to the example, no portion where the sheet thickness reduction rate significantly changed was found in the inclined flange portion 190, and wrinkles were dispersed. That is, according to the present example, it was illustrated that the concentration of wrinkles was suppressed.

Second Embodiment

Next, a preferred second embodiment of the present disclosure will be described in detail. The second embodiment is modified from the first embodiment as follows.

(Changes of Intermediate Formed Article)

Figure 26A:
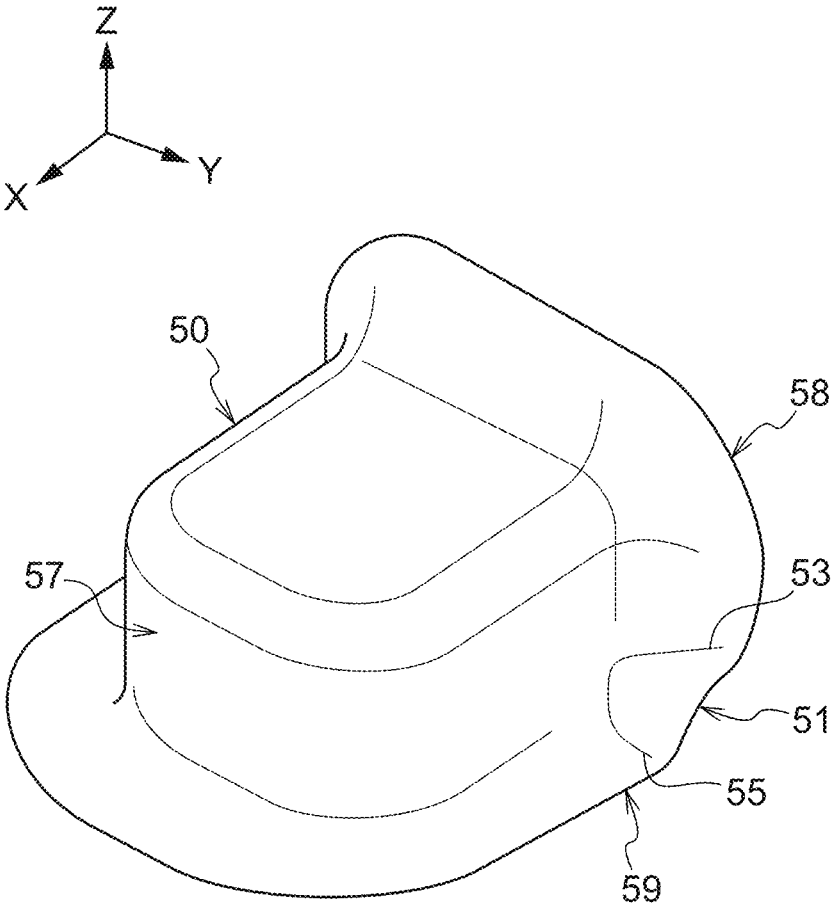
FIG. 26A is a perspective view illustrating a configuration example of an intermediate formed article according to a second embodiment.

The second embodiment is different from the first embodiment in the configuration of the intermediate formed article. That is, as illustrated in FIG. 26A, an intermediate formed article 50 has a shape including a portion 57 corresponding to a bag-shaped portion 101 of a press-formed article 100 and a convex flange portion 51. The convex flange portion 51 is continuous with a portion 58 to be a side standing flange portion 170 and a portion 59 to be a floor flange portion 140 via a first preliminary ridgeline 53 and a second preliminary ridgeline 55 to be described below. In particular, the convex flange portion 51 is continuous with a portion to be the side floor flange portion 143 via the second preliminary ridgeline 55. The convex flange portion 51 is formed as an inclined flange portion 190 of the press-formed article 100 as described below.

As illustrated in FIG. 26A, the intermediate formed article 50 has the first preliminary ridgeline 53 between the convex flange portion 51 and the portion 58 to be the side standing flange portion 170. The first preliminary ridgeline 53 is an R-shaped portion which is continuous with the convex flange portion 51 and the side standing flange portion 170 and has a predetermined curvature radius. The intermediate formed article 50 has the second preliminary ridgeline 55 between the convex flange portion 51 and the portion 59 to be the floor flange portion 140. In particular, the second preliminary ridgeline 55 is formed between the convex flange portion 51 and a portion to be the side floor flange portion 143. The second preliminary ridgeline 55 is an R-shaped portion which is continuous with the convex flange portion 51 and the floor flange portion 140 and has a predetermined curvature radius.

Figure 26B:
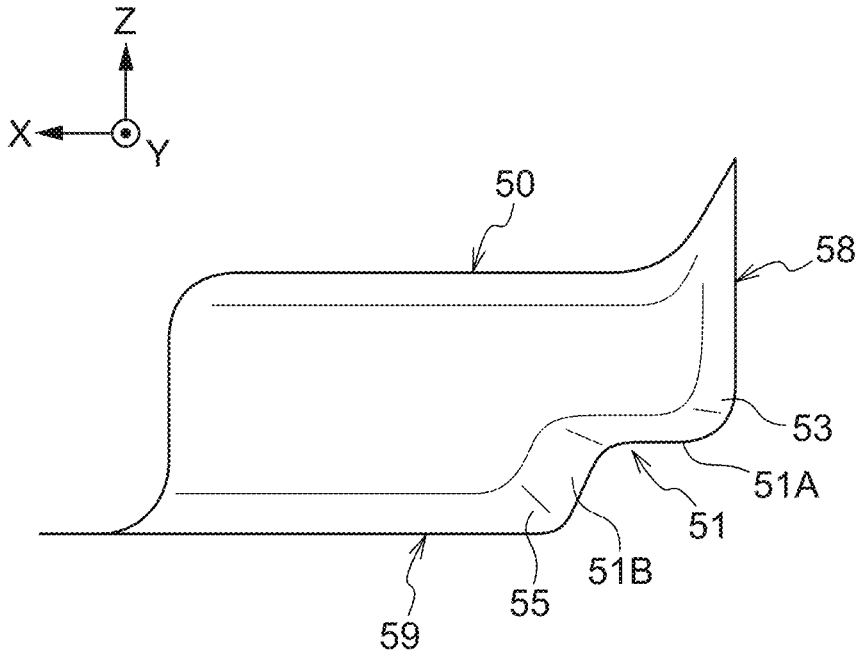
FIG. 26B is a side view illustrating a configuration example of the intermediate formed article according to the second embodiment.

As illustrated in FIG. 26B, in the convex flange portion 51, a portion 51A corresponding to the upper flange ridgeline portion 194 of the press-formed article 100 has a flat shape. Further, in the convex flange portion 51, a portion 51B corresponding to the lower flange ridgeline portion 192 of the press-formed article 100 has a flat shape.

Specifically, the flat portion of the step shape of the convex flange portion 51 is not subjected to preliminary processing. As a result, in the convex flange portion 51, a portion 51A corresponding to the upper flange ridgeline portion 194 or a portion 51B corresponding to the lower flange ridgeline portion 192 has a flat shape. When the intermediate formed article 50 is formed as the press-formed article 100, the formability of the upper flange ridgeline portion 194 and the lower flange ridgeline portion 192 is improved because the preliminary processing is not performed.

Although details will be described below, press forming is further performed on the intermediate formed article 50, and the convex flange portion 51 is flattened. The first preliminary ridgeline 53 or the second preliminary ridgeline 55 is bent and formed as a part of the side standing flange portion 170 or a part of the side floor flange portions 143. As a result, the press-formed article 100 having the inclined flange portion 190 is formed.

<2. Changes of Die/Punch>

Figure 27:
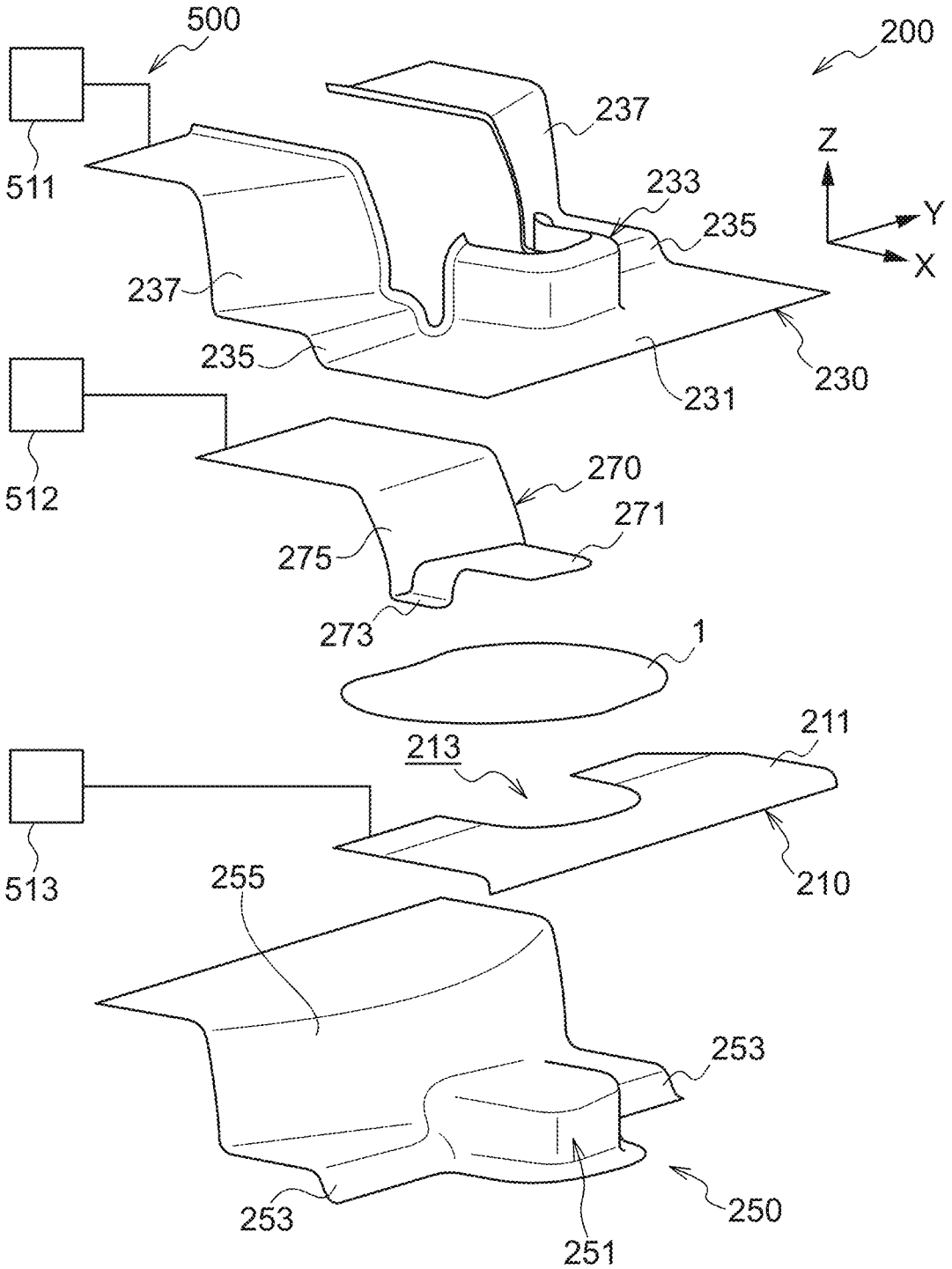
FIG. 27 is a perspective view schematically describing a configuration example of a first die/punch according to the second embodiment.
Figure 28:
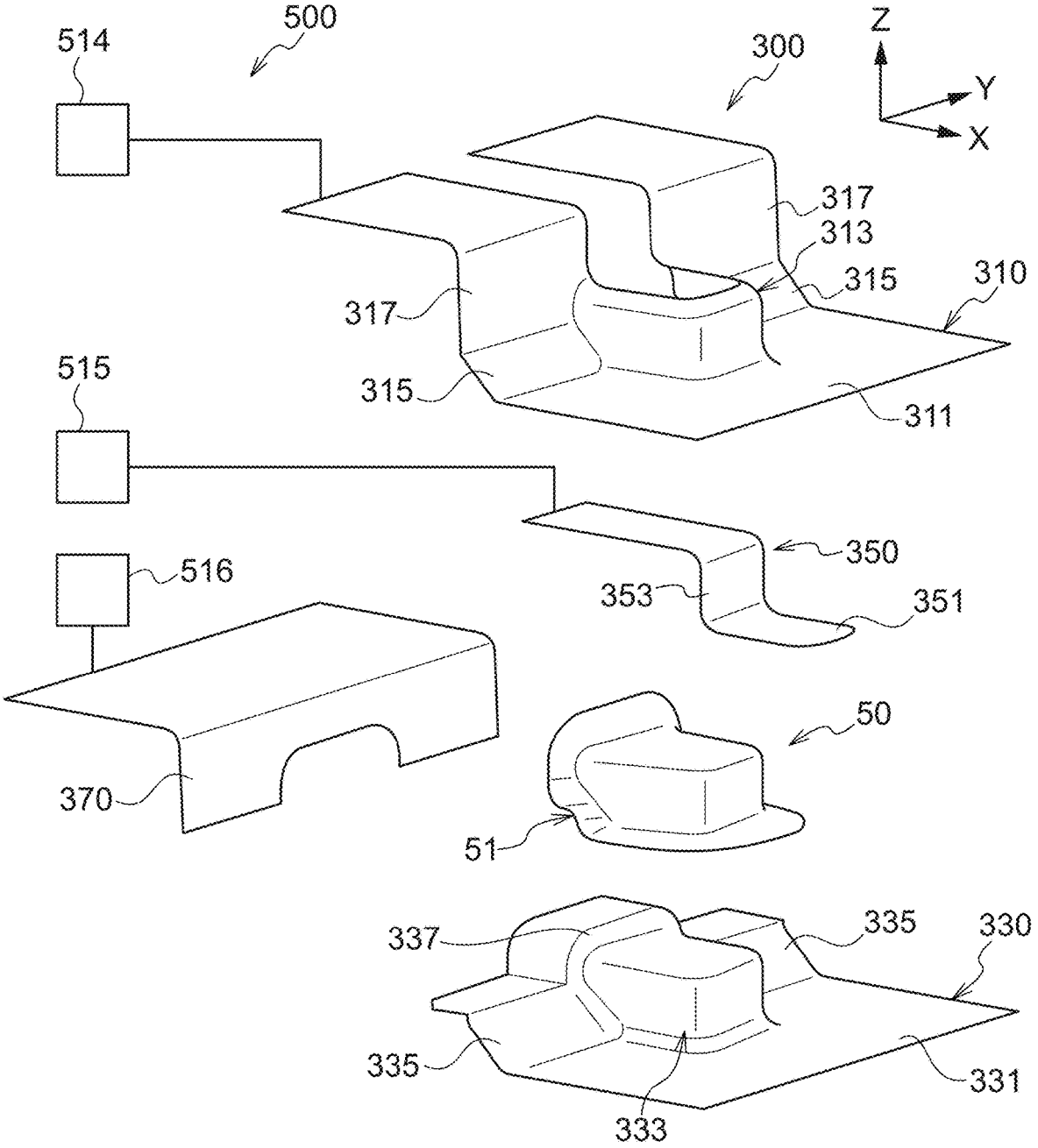
FIG. 28 is a perspective view schematically describing a configuration example of a second die/punch according to the second embodiment.

In the second embodiment, a basic configuration of a die/punch illustrated in FIGS. 27 and 28 is similar to that of the first embodiment. However, the second embodiment is different from the first embodiment in a configuration of a first die/punch 200 in that the intermediate formed article 50 described above can be manufactured. The second embodiment is different from the first embodiment in the configuration of a second die/punch 300 in that the press-formed article 100 can be manufactured from the intermediate formed article 50 described above.

That is, although details of the method of manufacturing the press-formed article 100 will be described below, the intermediate formed article 50 having the convex flange portion 51 between the portion 58 to be the side standing flange portion 170 and the portion 59 to be the floor flange portion 140 with respect to the blank 1 is formed by first press forming (preliminary forming) using the first die/punch 200. Further, the press-formed article 100 having the inclined flange portion 190 is formed by flattening the convex flange portion 51 by second press forming using the second die/punch 300.

A second die inclined surface portion 315 of the second die/punch presses the convex flange portion 51 of the intermediate formed article 50 from the upper surface to form the inclined flange portion 190 on the press-formed article 100. The second die inclined surface portion 315 of the second die/punch bends the first preliminary ridgeline 53 and the second preliminary ridgeline 55 to form a part of the side floor flange portion 143 and a part of the side standing flange portion 170. The second die inclined surface portion 315 is an inclined wall which is provided on each of both sides of the second die peripheral wall holding portion 313 in the Y direction and erected from the second die flat surface portion 311. The second die standing flange forming portion 317 is a wall surface erected from the second die inclined surface portion 315, and forms a standing flange portion 160 including a side standing flange portion 170 of the press-formed article 100 with a second cam 370 to be described below.

The second punch 330 of the second die/punch abuts on one surface of the intermediate formed article 50 from the Z direction in FIG. 3. For example, when the second die/punch 300 relatively moves in the vertical direction, the second punch 330 abuts on the lower surface of the intermediate formed article 50. The second punch 330 is provided on one surface side of the convex flange portion 51 of the intermediate formed article 50, and sandwiches the convex flange portion 51 with the second die 310 to bend the inclined flange portion 190. The second punch 330 forms the inclined flange portion 190 and bends the first preliminary ridgeline 53 and the second preliminary ridgeline 55 with the second die 310 to form a part of the side standing flange portion 170 and a part of the side floor flange portion 143.

<3. Changes in Manufacturing Method>

In the second embodiment, basic steps of a manufacturing method are the same as those in the first embodiment (refer to FIGS. 2 and 3). However, the second embodiment is different from the first embodiment in that, in the first press forming, the intermediate formed article 50 described above can be manufactured. The second embodiment is different from the first embodiment in that, in the second press forming, the press-formed article 100 can be manufactured from the intermediate formed article 50 described above.

(First Press Forming (Preliminary Forming))

Figure 29A:
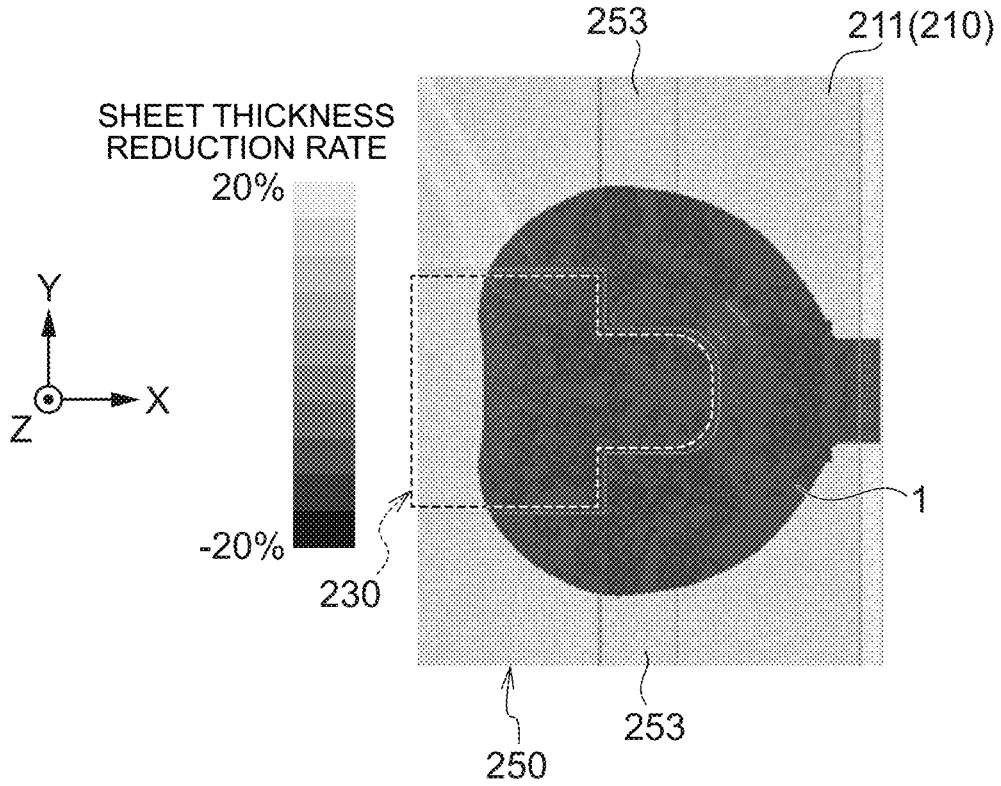
FIG. 29A is a plan view schematically describing a first press forming step according to the second embodiment.
Figure 29B:
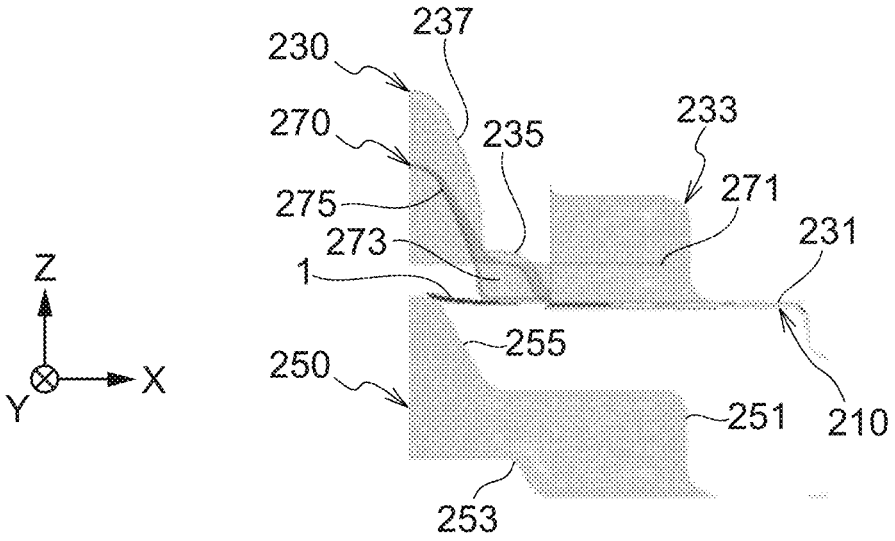
FIG. 29B is a side view schematically describing the first press forming step according to the second embodiment.

Specifically, as illustrated in FIG. 29B, first, the blank 1 is sandwiched between the first holder 210 and the first die 230. Here, as illustrated in FIG. 29A, the blank 1 is a substantially circular sheet material in plan view (as viewed in the Z direction in FIG. 4A), the longest length in the X direction is about 170 mm, and the longest length in the Y direction is about 200 mm. The first holder 210 and the first die 230 sandwich a portion corresponding to the floor flange portion 140 of the press-formed article 100 in the blank 1. Specifically, the outer peripheral edge portion of the blank 1 is sandwiched between the holder flat surface portion 211 and the first die flat surface portion 231.

Figure 30A:
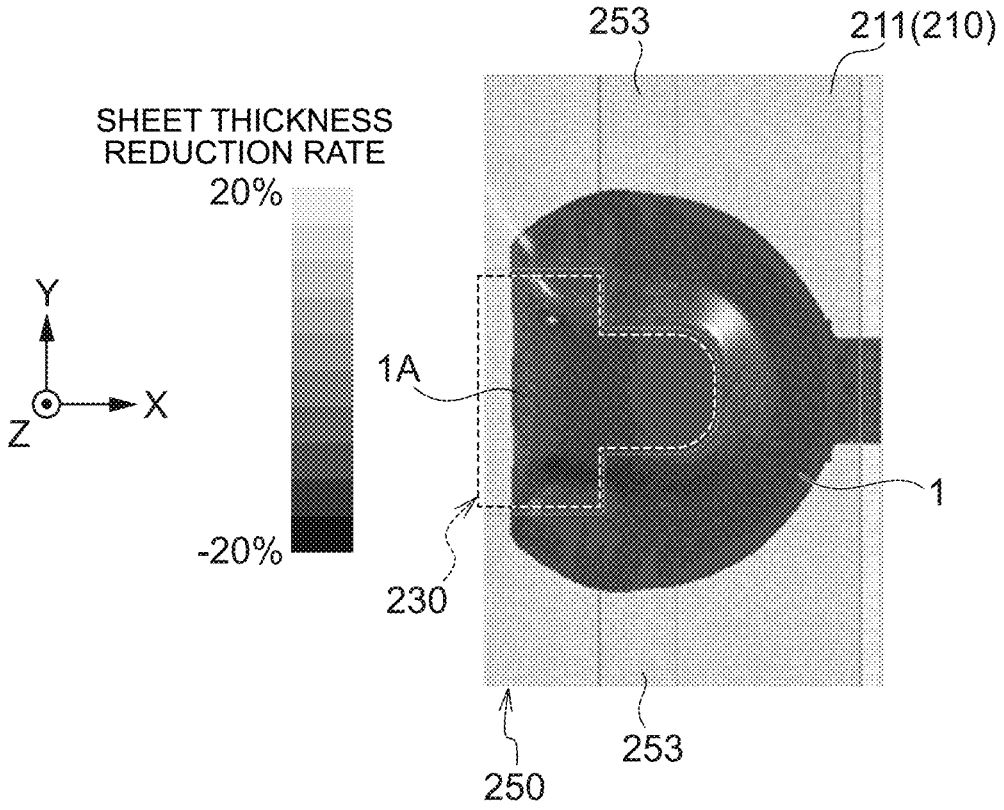
FIG. 30A is a plan view schematically describing the first press forming step according to the second embodiment.
Figure 30B:
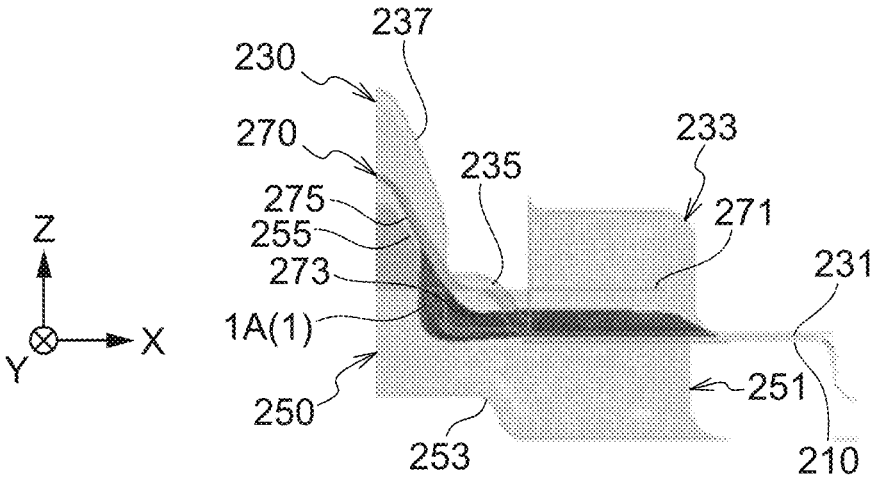
FIG. 30B is a side view schematically describing the first press forming step according to the second embodiment.

Next, as illustrated in FIG. 30B, the blank 1 held between the first holder 210 and the first die 230 is moved relative to the first punch 250, and the first punch 250 and the blank 1 abut on each other. Specifically, the substantially central portion of the blank 1 and the upper wall surface of the first punch peripheral wall forming portion 251 abut on each other. As illustrated in FIG. 30A, the end portion 1A of the blank 1 in the X direction abuts on the first punch standing flange forming portion 255 and is deformed.

In the embodiment in which the first die/punch 200 includes the first pad 270, the first pad 270 abuts on the blank 1 prior to the draw-forming. As a result, a part of the side top sheet ridgeline portion 133, which is a ridgeline portion between the top sheet portion 110 on the end portion side where the peripheral wall portion 120 is not formed and the peripheral wall portion 120 in the press-formed article 100, is formed. Further, a continuous portion between the central standing flange portion 180 and the side standing flange portion 170 of the press-formed article 100 is formed. That is, in the first press forming, before the draw-forming is performed, a part of the side top sheet ridgeline portion 133, the central standing flange ridgeline portion 183, and the standing flange corner portion 185 are formed by the first pad 270 and the first punch 250.

Specifically, as illustrated in FIG. 30A, the blank 1 is sandwiched between the first pad ridgeline forming portion 273 and the first punch peripheral wall forming portion 251 to form a part of the side top sheet ridgeline portion 133. The first pad standing flange forming portion 275 abuts on the end portion 1A of the blank 1 in the X direction. As a result, as illustrated in FIG. 30B, the blank 1 is sandwiched between the first pad standing flange forming portion 275 and the first punch standing flange forming portion 255, the blank 1 is partially bent, and the formation of the central standing flange portion 180 and the peripheral portion thereof is started.

Here, forming of the side top sheet ridgeline portion 133 and the central standing flange portion 180 by the first pad 270 is the same as in the first embodiment (refer to FIGS. 6A to 6D).

Figure 31A:
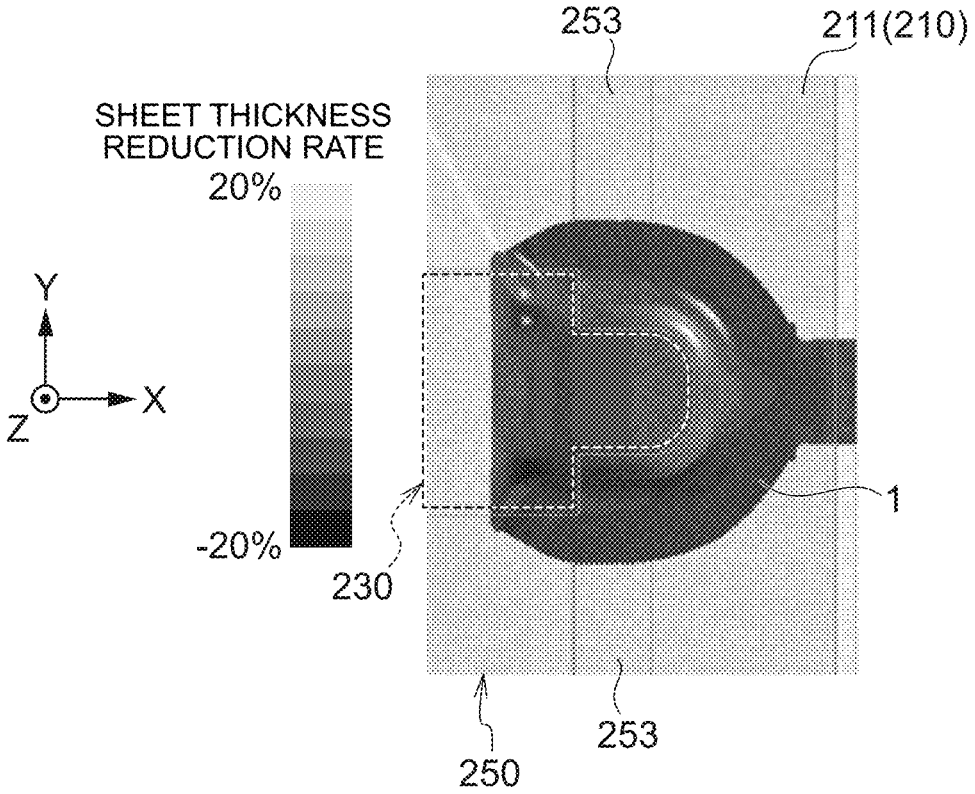
FIG. 31A is a plan view schematically describing the first press forming step according to the second embodiment.
Figure 31B:
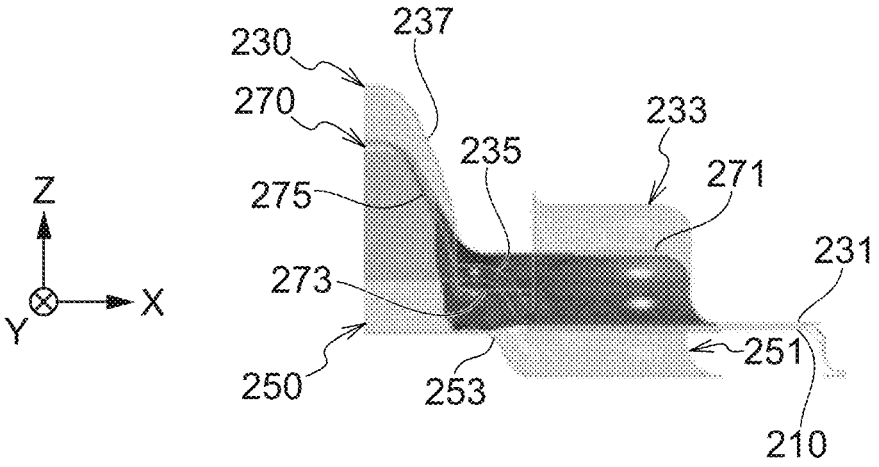
FIG. 31B is a side view schematically describing the first press forming step according to the second embodiment.

Subsequently, as illustrated in FIG. 31A, the blank 1 sandwiched between the first holder 210 and the first die 230 is further moved relative to the first punch 250, and the peripheral wall portion 120 starts to be formed by draw-forming. Specifically, as illustrated in FIG. 31B, the substantially central portion of the blank 1 is drawn while being sandwiched between the first die peripheral wall forming portion 233 and the first punch peripheral wall forming portion 251. At this time, first, the top sheet ridgeline portion 130 is drawn and formed. Since the top sheet ridgeline portion 130 is formed by the draw-forming, generation of wrinkles at a portion adjacent to the top sheet ridgeline portion 130 is suppressed. In fact, as illustrated in FIG. 31A, the thickness of the blank 1 uniformly decreases from the top sheet ridgeline portion 130 to the top sheet portion 110 and the peripheral wall portion 120 according to the draw-forming, and the generation of wrinkles is suppressed.

In the embodiment in which the first die/punch 200 includes the first pad 270, the first pad 270 moves relative to the first punch 250 together with the first holder 210 and the first die 230. As described with reference to FIG. 6C, the first pad ridgeline forming portion 273 forms the side top sheet ridgeline portion 133 with the first punch 250. Further, the end portion of the blank 1 in the X direction is sandwiched between the first pad standing flange forming portion 275 and the first punch standing flange forming portion 255, and bent to form the central standing flange ridgeline portion 183. During the draw-forming by the first holder 210 and the first die 230, the first pad top sheet pressing portion 271 holds the substantially central portion of blank 1 from above. Finally, the first pad top sheet pressing portion 271 sandwiches the substantially center of the blank 1 with the upper wall surface of the first punch peripheral wall forming portion 251.

Figure 32A:
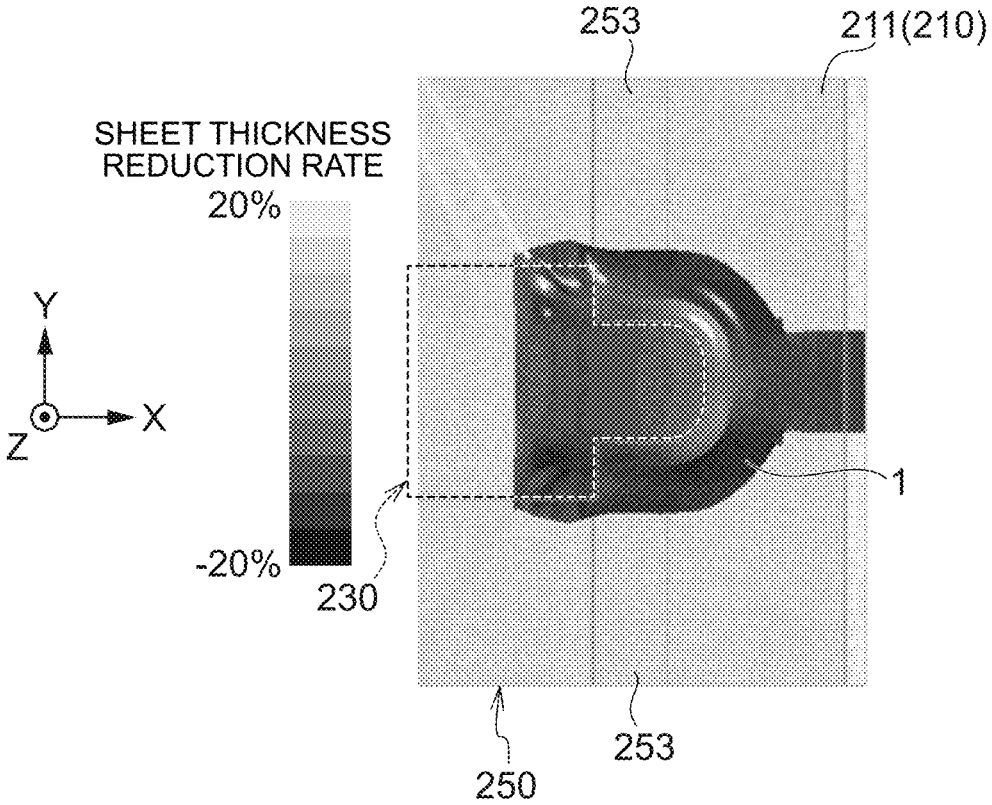
FIG. 32A is a plan view schematically describing the first press forming step according to a second embodiment.
Figure 32B:
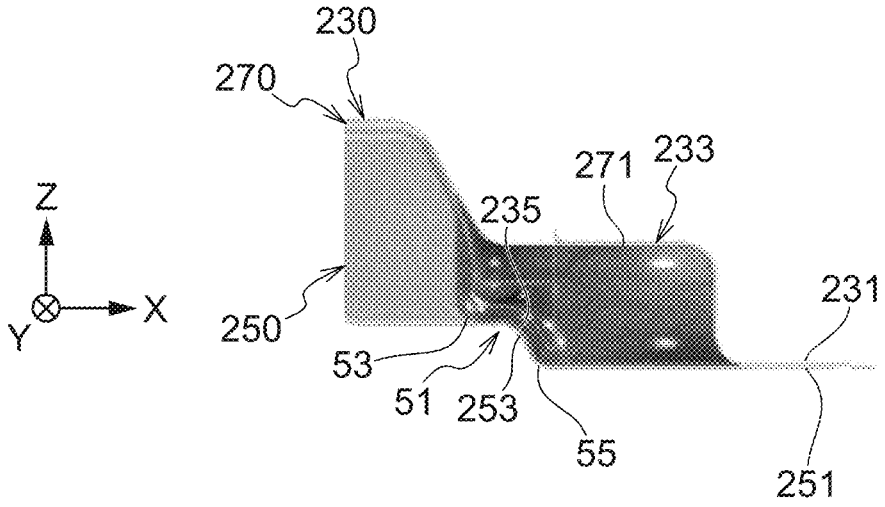
FIG. 32B is a side view schematically describing the first press forming step according to the second embodiment.

In the first press forming, as illustrated in FIGS. 32A and 32B, the blank 1 sandwiched between the first holder 210 and the first die 230 is further moved relative to the first punch 250 to form the peripheral wall portion 120. In addition, the blank 1 abuts on the first punch protrusion forming portion 253, whereby the convex flange portion 51 having a protruding shape is bent and formed. Specifically, when the blank 1 is moved relative to the first punch 250, a part of the blank 1 is sandwiched between the first die protrusion forming portion 235 and the first punch protrusion forming portion 253, and is deformed into a step shape, whereby the convex flange portion 51 is formed. Further, the first preliminary ridgeline 53 and the second preliminary ridgeline 55 are formed together with the convex flange portion 51. A height of the step shape of the convex flange portion 51 is appropriately set to such an extent that the inclined flange portion 190 can be formed based on a sheet thickness and a tensile strength of the blank 1.

Figure 33:
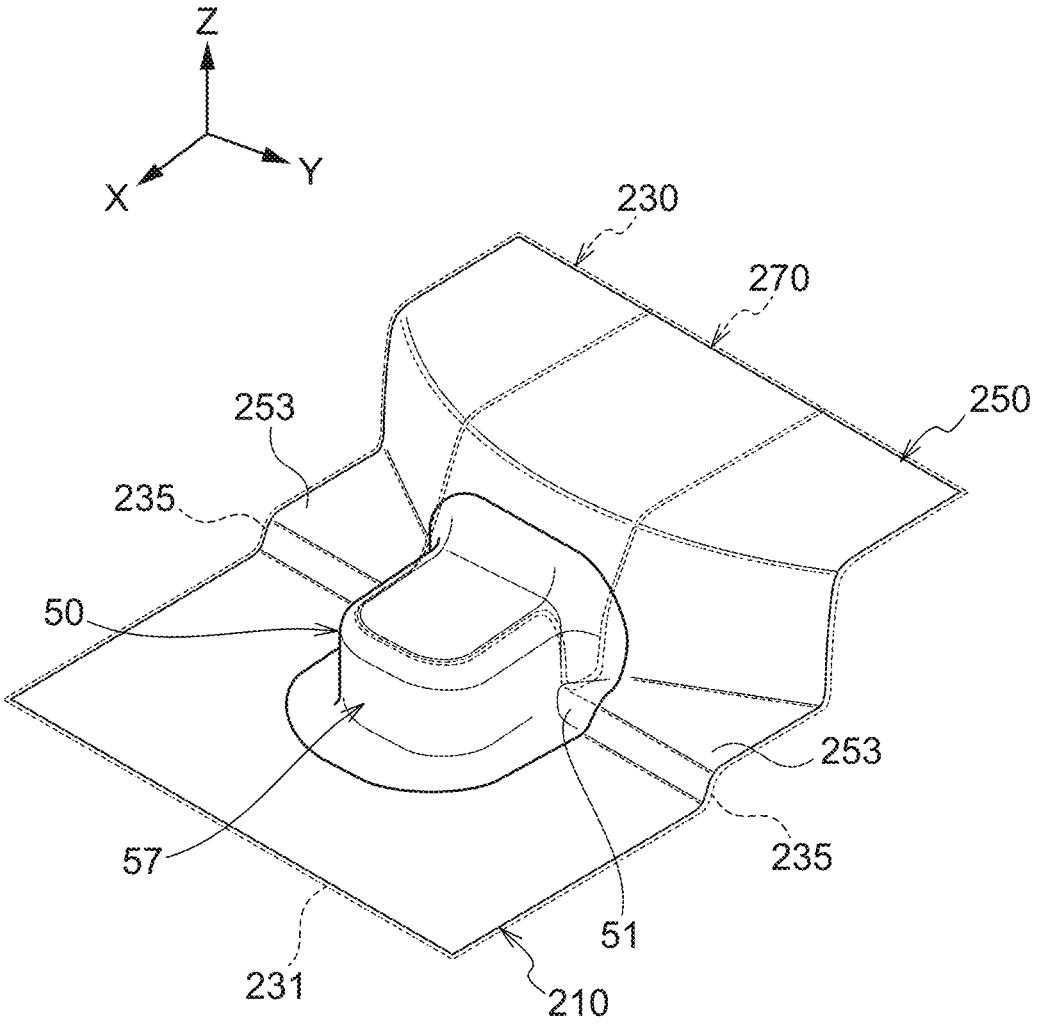
FIG. 33 is a perspective view schematically illustrating a state after completion of the first press forming according to the second embodiment.

FIG. 33 is an explanatory view schematically illustrating a state after completion of the first press forming. As illustrated in FIG. 33, after completion of the first press forming, the blank 1 is formed into an intermediate formed article 50 including a portion 57 corresponding to the bag-shaped portion 101 and a convex flange portion 51. The intermediate formed article 50 taken out from the first die/punch 200 is used for the second press forming.

In the first press forming, the intermediate formed article 50 may be formed such that an angle formed by portions corresponding to the top sheet portion 110, the peripheral wall portion 120, the floor flange portion 140, or the standing flange portion 160 including the side standing flange portion 170 is large and obtuse. Accordingly, concentration of distortion during forming can be alleviated. In this case, in the second press forming or the third press forming, forming is performed such that an angle formed by each portion in the press-formed article 100 becomes a predetermined angle.

(Second Press Forming)

In the second press forming, the intermediate formed article 50 is disposed in the second die/punch 300 as preparation for the second press forming. Specifically, the intermediate formed article 50 is placed at a predetermined position of the second punch 330.

Specifically, an inner peripheral surface of a portion corresponding to the peripheral wall portion 120 in the intermediate formed article 50 and an outer peripheral surface of the second punch peripheral wall holding portion 333 come into contact with each other. The second pad top sheet pressing portion 351 abuts on a portion corresponding to the top sheet portion 110 of the intermediate formed article 50. The intermediate formed article 50 is pushed down by the second pad top sheet pressing portion 351, guided by the second punch peripheral wall holding portion 333, and moves relative to the second punch 330.

Figure 34A:
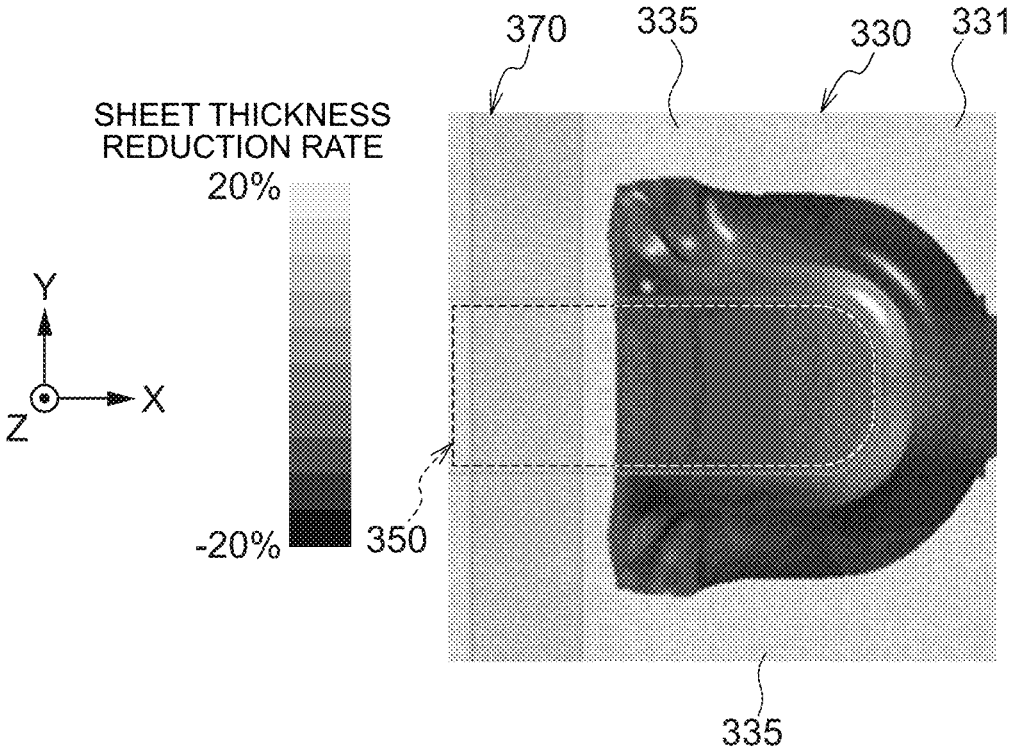
FIG. 34A is a plan view schematically describing a second press forming step according to the second embodiment.
Figure 34B:
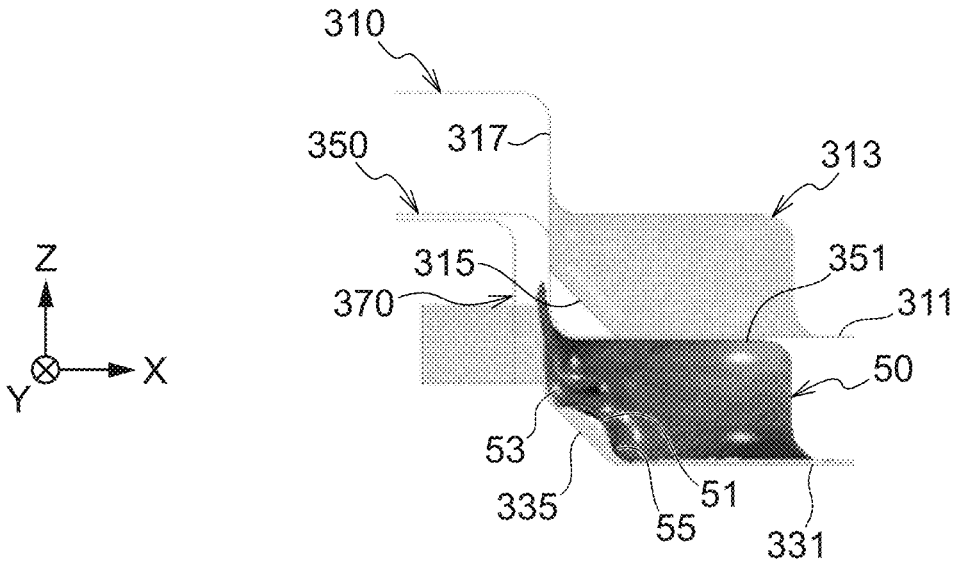
FIG. 34B is a side view schematically describing a second press forming step according to the second embodiment.

Next, as illustrated in FIGS. 34A and 34B, as a result of the intermediate formed article 50 being pushed down by the second pad top sheet pressing portion 351, a portion of the intermediate formed article 50 corresponding to the floor flange portion 140 abuts on the second punch flat surface portion 331. The inner peripheral surface of the bag-shaped portion 101 of the intermediate formed article 50 abuts on the outer peripheral surface of the second punch peripheral wall holding portion 333. As a result, the intermediate formed article 50 is held in the second die/punch 300. In this case, the convex flange portion 51 of the intermediate formed article 50 is located above the second punch inclined surface portion 335.

Figure 34C:
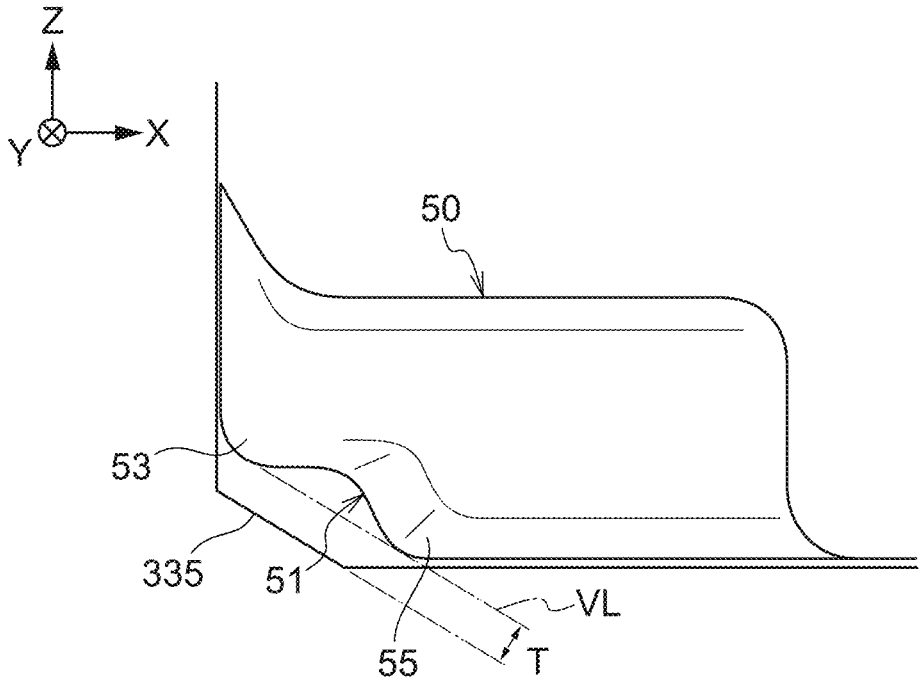
FIG. 34C is a side view schematically describing an offset amount in the second press forming step according to the second embodiment.

As illustrated in FIG. 34C, the convex flange portion 51 is separated from the second punch inclined surface portion 335. Specifically, a virtual line VL connecting vertexes of the first preliminary ridgeline 53 and the second preliminary ridgeline 55 of the convex flange portion 51 has an offset amount T of a predetermined distance from the second punch inclined surface portion 335. The offset amount T is, for example, from 1 mm to 5 mm.

When the offset amount T is 1 mm or more, bending of the first preliminary ridgeline 53 and the second preliminary ridgeline 55 to be described below is realized. That is, wrinkles are dispersed around the inclined flange portion 190, and the effect of suppressing wrinkles in the inclined flange portion 190 is improved. Meanwhile, when the offset amount T is 5 mm or less, the workability when the convex flange portion 51 is formed in the inclined flange portion 190 is improved. In other words, in a case where the offset amount T is larger than 5 mm, when the convex flange portion 51 is formed in the inclined flange portion 190, there is a case where a crushing margin is large and the processing becomes difficult. However, since the offset amount T is set to a predetermined value or less, the processing becomes easy.

Figure 35A:
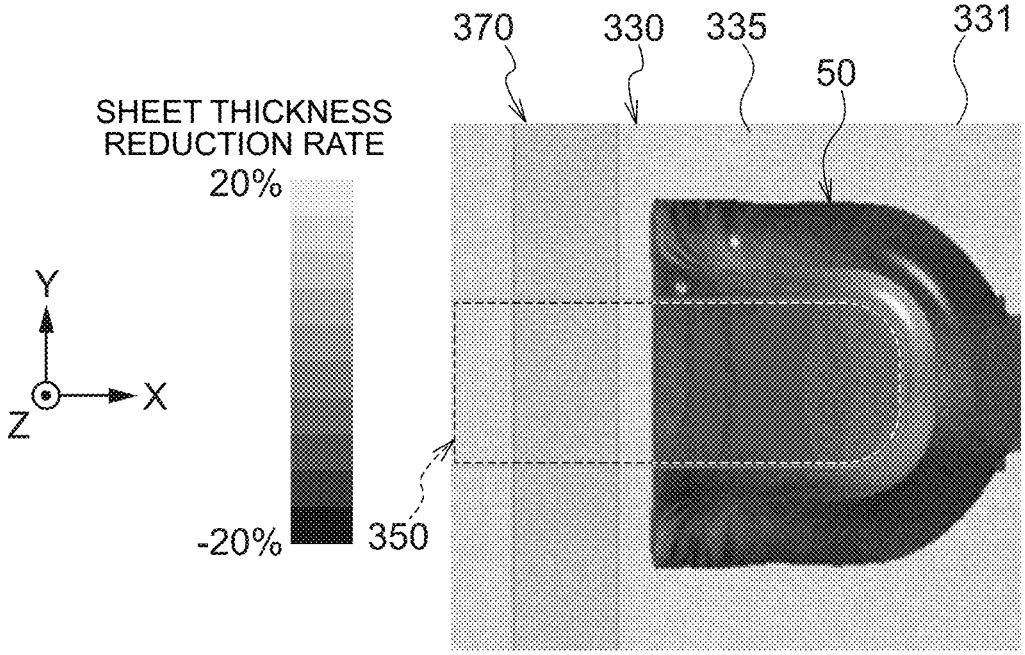
FIG. 35A is a plan view schematically describing the second press forming step according to the second embodiment.
Figure 35B:
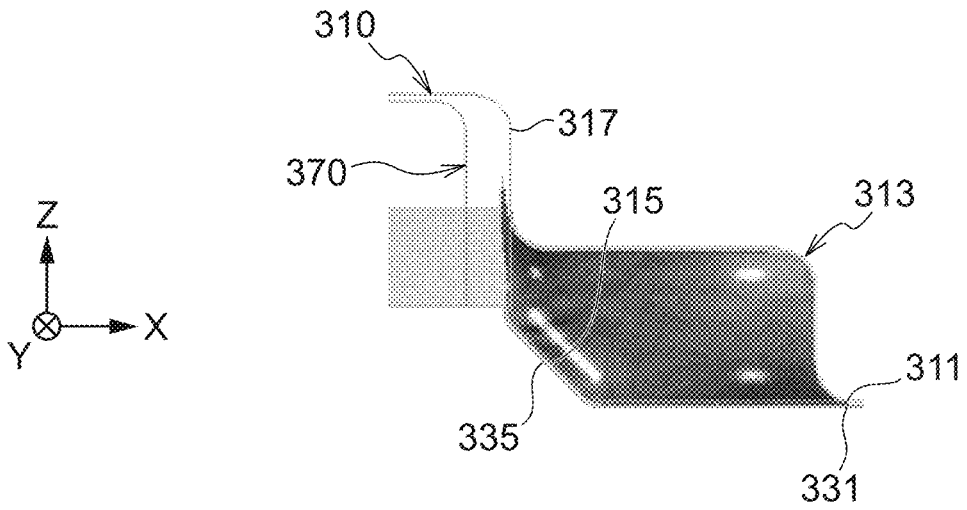
FIG. 35B is a side view schematically describing the second press forming step according to the second embodiment.

Subsequently, as illustrated in FIGS. 35A and 35B, the second die 310 moves along the Z direction toward the intermediate formed article 50. The second die flat surface portion 311 sandwiches a portion 59 to be the floor flange portion 140 of the intermediate formed article 50 with the second punch flat surface portion 331. The second die peripheral wall holding portion 313 sandwiches the portion 57 corresponding to the peripheral wall portion 120 of the intermediate formed article 50 with the second punch peripheral wall holding portion 333. The second die inclined surface portion presses the convex flange portion 51 having a convex shape between the second die inclined surface portion 315 and the second punch inclined surface portion 335 to bend the convex flange portion 51 into a flat shape. As a result, the inclined flange portion 190, which is an inclined wall continuous between the floor flange portion 140 and the side standing flange portion 170, is formed.

Figure 35C:
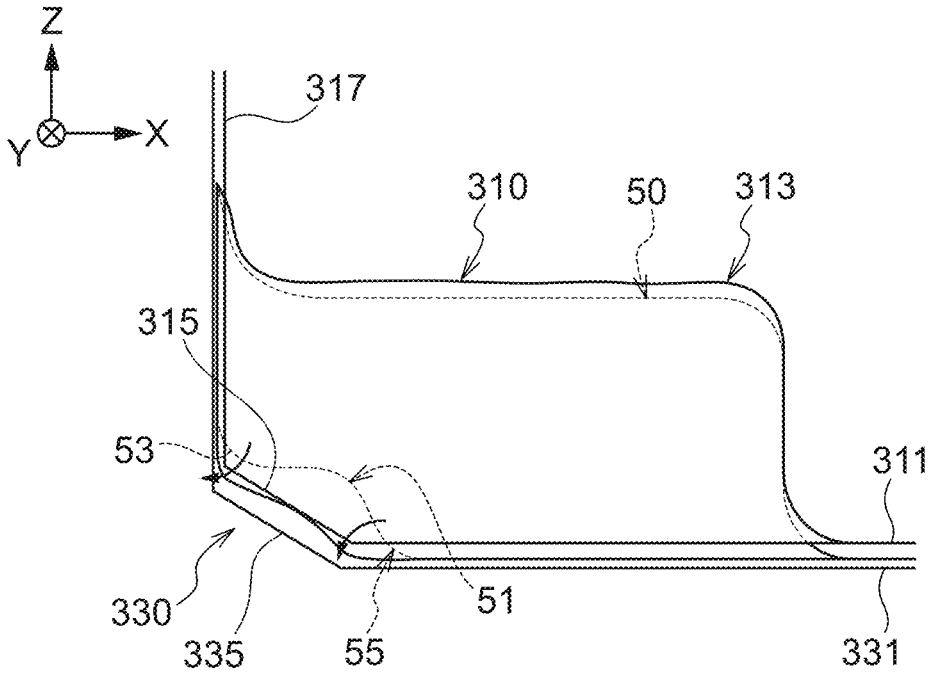
FIG. 35C is a side view schematically describing bending of a preliminary ridgeline in the second press forming step according to the second embodiment.

When the inclined flange portion 190 is formed, as illustrated in FIG. 35C, the first preliminary ridgeline 53 of the convex flange portion 51 is bent by the second die 310 and the second punch 330 (refer to an arrow in FIG. 35C). As a result, the first preliminary ridgeline 53 is formed as a part of the side standing flange portion 170. Specifically, the first preliminary ridgeline 53 is formed as one end portion (a portion on the inclined flange portion 190 side) of the side standing flange portion 170 in the Z direction.

Further, the second preliminary ridgeline 55 of the convex flange portion 51 is bent by the second die 310 and the second punch 330 (refer to an arrow in FIG. 35C). As a result, the second preliminary ridgeline 55 is formed as a part of the side floor flange portion 143. Specifically, the second preliminary ridgeline 55 is formed as one end portion (a portion on the inclined flange portion 190 side) of the side floor flange portion 143 in the X direction.

Here, for example, the present inventors have found that when a flat inclined wall is formed from the beginning without forming the convex flange portion 51 having a convex shape, the wall thickness is biased (wrinkles are concentrated) at the end portion of the inclined wall (the end portion in the X direction in side view (viewed in the Y direction)). This is considered to be because when the flat shape is directly formed, compressive strain concentrates on the end portion of the inclined wall due to material flow during press forming, and more wrinkles are formed. Therefore, as a result of intensive studies, the present inventors have found that wrinkles can be dispersed and concentration of wrinkles can be suppressed by once forming the convex flange portion 51 and crushing the convex flange portion 51. Specifically, by pressing the convex flange portion 51 of the convex shape of the intermediate formed article 50 to form a flat shape, concentration of wrinkles in the inclined flange portion 190 of the press-formed article 100 is suppressed. In particular, when the press-formed article 100 is made of a high-tensile steel sheet, the concentration of wrinkles can be suppressed by pressing the convex flange portion 51 to form the inclined flange portion 190.

As a result of intensive studies by the inventors, the inventors have found that the concentration of wrinkles can be further suppressed when processing is applied to a region wider than the region corresponding to the inclined flange portion 190 as compared with the case where only the region corresponding to the inclined flange portion 190 of the press-formed article 100 is used as the convex flange portion 51 in the intermediate formed article 50. This is considered to be because the concentration of wrinkles in the inclined flange portion 190 is further suppressed by widening the dispersion range in the dispersion of wrinkles by crushing the convex flange portion 51 as described above.

Figure 35D:
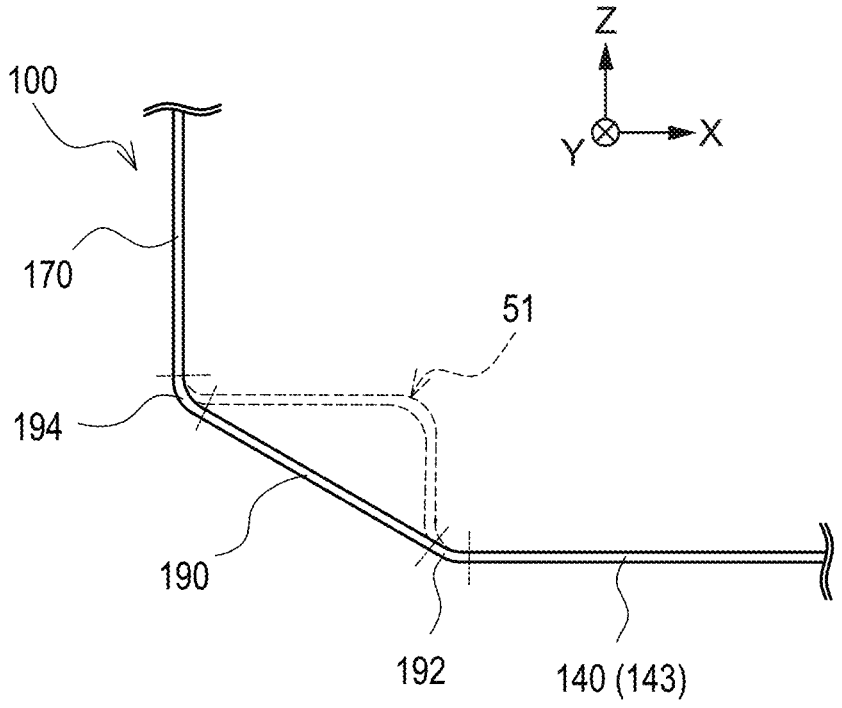
FIG. 35D is a partially enlarged view schematically describing bending of a preliminary ridgeline in a second press forming step as a reference example.
Figure 35E:
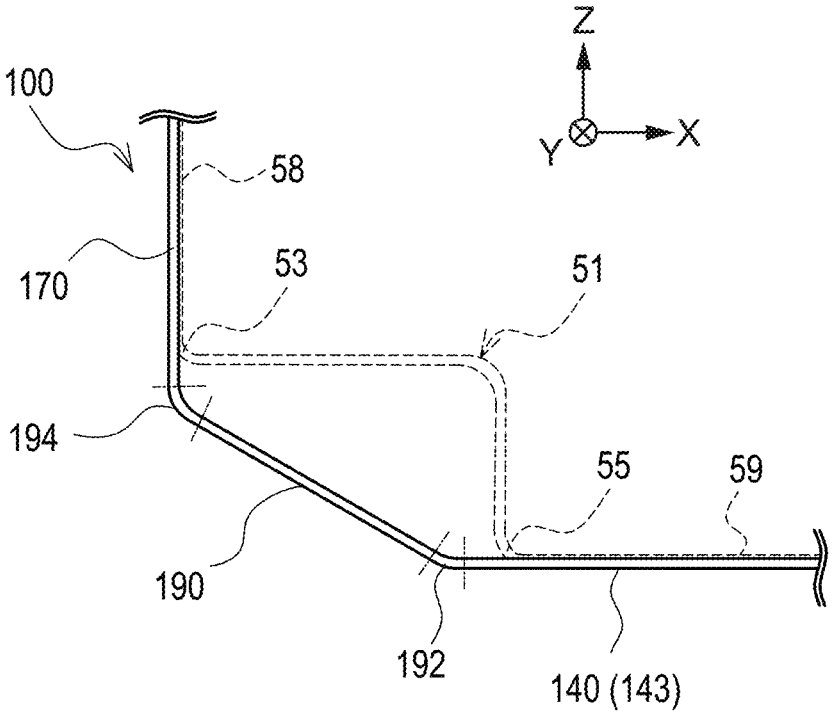
FIG. 35E is a partially enlarged view schematically describing bending of the preliminary ridgeline in the second press forming step according to the second embodiment.

The suppression of wrinkles according to the second embodiment will be described more specifically with reference to FIGS. 35D and 35E. FIG. 35D is a partially enlarged view schematically describing bending of the preliminary ridgeline in the second press forming step as a reference example. FIG. 35E is a partially enlarged view schematically describing bending of the preliminary ridgeline in the second press forming step according to the first embodiment. First, as illustrated in FIG. 35D, it is assumed that only a region corresponding to the inclined flange portion 190 of the press-formed article 100 is the convex flange portion 51 of the intermediate formed article 50. In this case, the convex flange portion 51 is compressed and crushed, and thus, wrinkles are dispersed in the inclined flange portion 190. Meanwhile, since the deformation is applied to the convex flange portion 51, the material flow during the deformation remains in the inclined flange portion 190.

In this regard, as illustrated in FIG. 35E, the first preliminary ridgeline 53 is provided between the portion 58 to be the side standing flange portion 170 and the convex flange portion 51, and the second preliminary ridgeline 55 is further provided between the portion 59 to be the floor flange portion 140 and the convex flange portion 51. In this case, by providing the first preliminary ridgeline 53 and the second preliminary ridgeline 55 in the intermediate formed article 50, a region wider than a region to be the inclined flange portion 190 is to be processed.

That is, the portion 58 to be the side standing flange portion 170 has a line length shorter than that of the side standing flange portion 170 of the press-formed article 100 in side view (as viewed in the Y direction), and is formed as the side standing flange portion 170 by bending the first preliminary ridgeline 53 at the time of the press working. The portion 59 to be the floor flange portion 140 has a line length shorter than that of the floor flange portion 140 of the press-formed article 100 in side view (Y direction view), and is formed as the floor flange portion 140 by bending the second preliminary ridgeline 55 at the time of the press working. In this manner, when the convex flange portion 51 is pressed, the first preliminary ridgeline 53 and the second preliminary ridgeline 55 are bent to form the side standing flange portion 170 and the side floor flange portion 143. As a result, since the range of processing is expanded, the dispersion range of wrinkles is expanded not only in the inclined flange portion 190 but also in the peripheral portion. As a result, wrinkles in the inclined flange portion 190 of the press-formed article 100 are further suppressed.

Figure 36A:
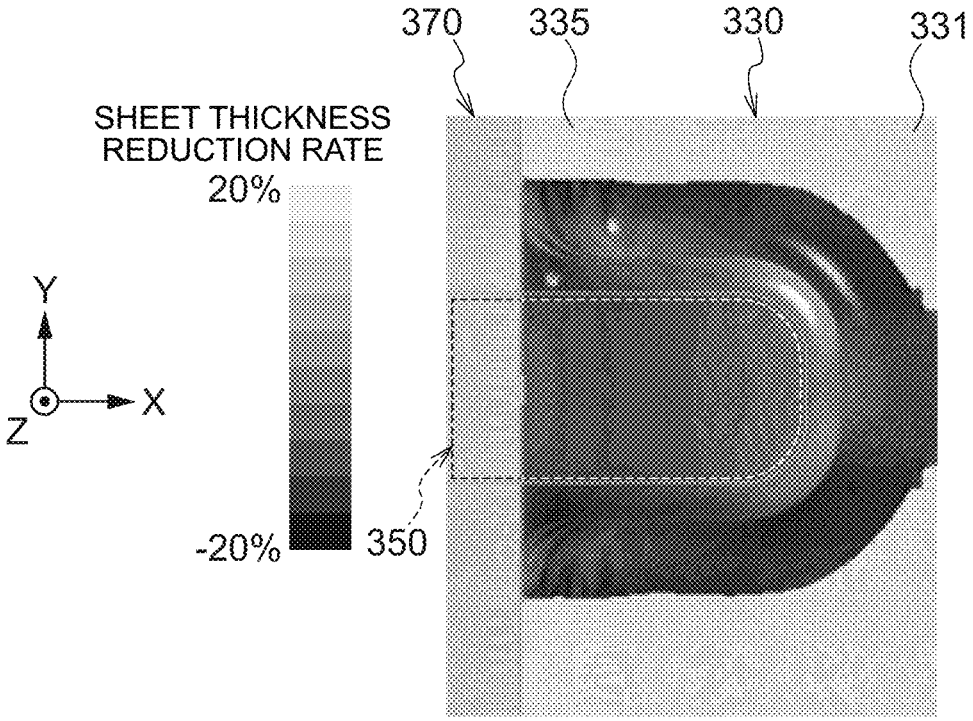
FIG. 36A is a plan view schematically describing the second press forming step according to a second embodiment.
Figure 36B:
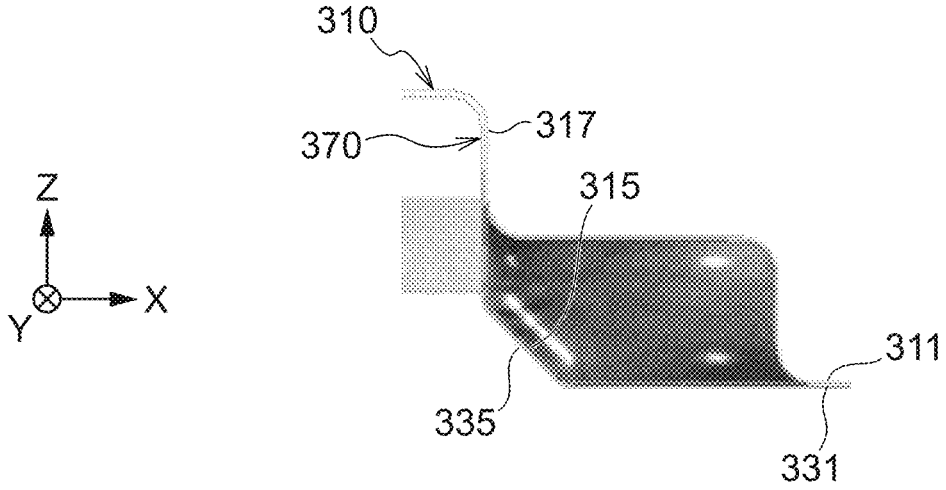
FIG. 36B is a side view schematically describing the second press forming step according to the second embodiment.

Subsequently, as illustrated in FIGS. 36A and 36B, the second cam 370 moves along the X direction to abut on the standing flange portion of the intermediate formed article 50. That is, the second cam 370 sandwiches a portion corresponding to the standing flange portion 160 of the intermediate formed article 50 with the second punch standing flange forming portion 337. Hereinbefore, the first press forming and the second press forming in the method of manufacturing the press-formed article 100 according to the second embodiment have been described. The method of manufacturing the press-formed article 100 according to the second embodiment may include various additional steps necessary for manufacturing the press-formed article 100 in addition to the first press forming and the second press forming.

Figure 37:
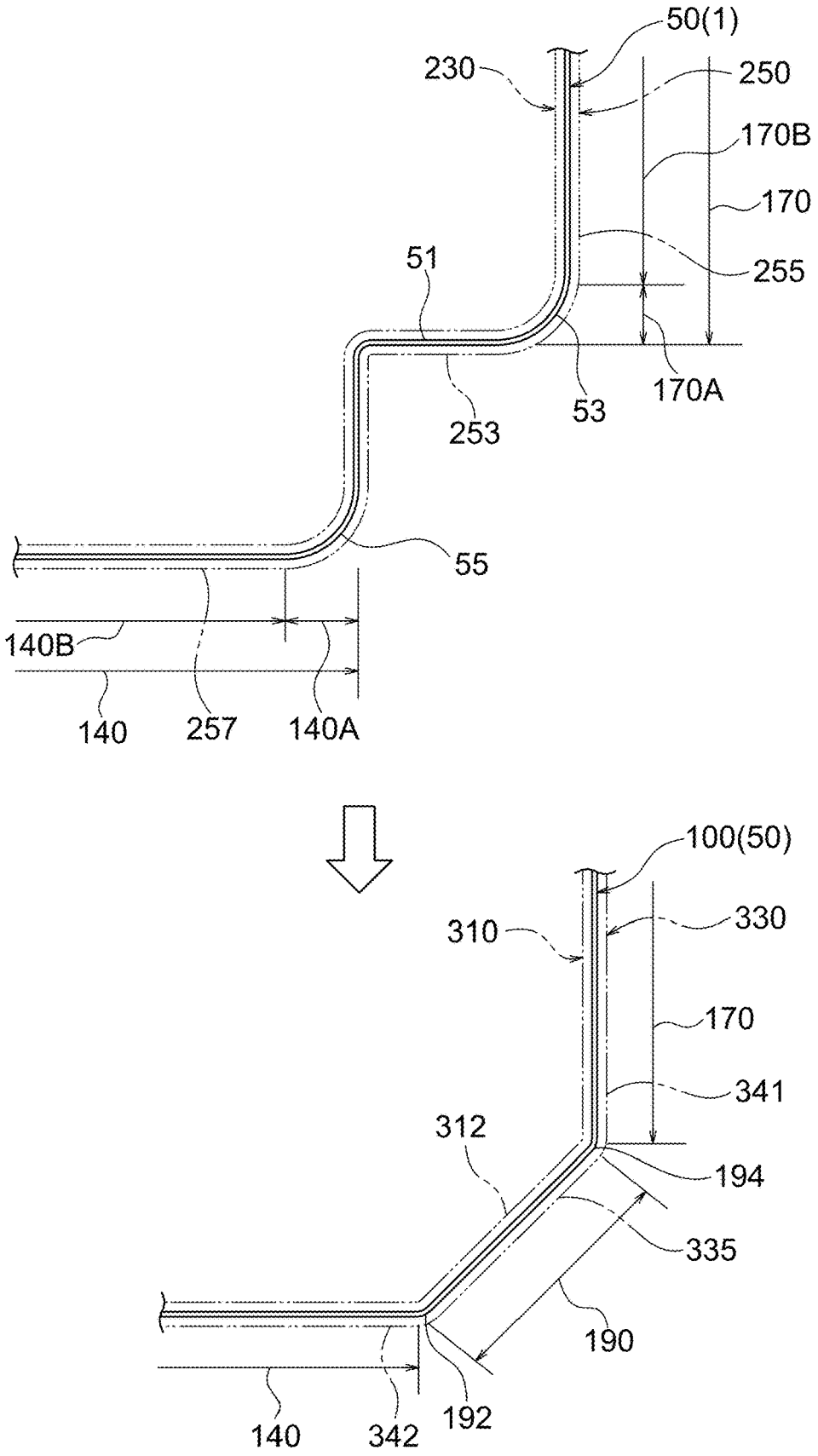
FIG. 37 is a supplementary explanatory view of the second embodiment.

The second embodiment will be supplemented as follows with reference to FIG. 37.

In the second embodiment, the first punch 250 includes: the first punch protrusion forming portion 253 that abuts on the region to be the inclined flange portion 190 on one surface of the blank 1 and bends the blank 1 together with the first die 230 to form the convex flange portion 51; the first punch standing flange forming portion 255 that abuts on a region to be the side standing flange portion 170 on one surface of the blank 1 and bends the blank 1 together with the first die 230 to form at least the side standing flange main body portion 170B located on a side opposite to the inclined flange portion 190 with respect to the end portion 170A of the side standing flange portion 170 on the inclined flange portion 190 side; and a first punch floor flange forming portion 257 that abuts on a region to be the floor flange portion 140 on one surface of the blank 1 and bends the blank 1 together with the first die 230 to form at least the floor flange main body portion 140B located on a side opposite to the inclined flange portion 190 with respect to the end portion 140A of the floor flange portion 140 on the inclined flange portion 190 side.

In the second embodiment, the first punch standing flange forming portion 255 has a shape for bending the blank 1 to form the side standing flange main body portion 170B of the side standing flange portion 170, and the first preliminary ridgeline 53 connecting the side standing flange main body portion 170B and the convex flange portion 51. The first punch floor flange forming portion 257 has a shape for bending the blank 1 to form the floor flange main body portion 140B of the floor flange portion 140 and the second preliminary ridgeline 55 connecting the floor flange main body portion 140B and the convex flange portion 51.

The second die 310 includes an inclined surface 312 that abuts on the other surface of the convex flange portion 51. The second punch 330 is provided on one surface side of the convex flange portion 51, and has a second punch inclined surface portion 335 that bends the inclined flange portion 190 from the convex flange portion 51 by sandwiching the convex flange portion 51 with the second die 310. In addition, the second punch 330 includes at least one of a first bend-forming portion 341 that bends the first preliminary ridgeline 53 to a part of the side standing flange portion 170 by the second die 310 and a second bend-forming portion 342 that bends the second preliminary ridgeline 55 to a part of the floor flange portion 140 by the second die 310. The second punch 330 may include both the first bend-forming portion 341 and the second bend-forming portion 342.

In the second embodiment, the intermediate formed article 50 is formed from the blank 1 by subjecting the blank 1 to the first press forming including bending the blank 1 by the blank 1 abutting on the first punch protrusion forming portion 253 provided at the first punch 250 to form the convex flange portion 51 having a convex shape formed at the inclined flange portion 190, and bending the blank 1 by the blank 1 abutting on the first punch 250 to form at least the side standing flange main body portion 170B located on the opposite side of the inclined flange portion 190 with respect to the end portion 170A of the side standing flange portion 170 on the inclined flange portion 190 side and the floor flange main body portion 140B located on the opposite side of the inclined flange portion 190 with respect to the end portion 140A of the floor flange portion 140 on the inclined flange portion 190 side.

The first press forming includes bending the blank 1 by the blank 1 abutting on the first punch 250 to form the side standing flange main body portion 170B of the side standing flange portion 170, the first preliminary ridgeline 53 connecting the side standing flange main body portion 170B and the convex flange portion 51, the floor flange main body portion 140B of the floor flange portion 140, and the second preliminary ridgeline 55 connecting the floor flange main body portion 140B and the convex flange portion 51.

In the second embodiment, the second press forming includes at least one of bending the intermediate formed article 50 by the second die 310 and the second punch 330 to form the first preliminary ridgeline 53 into a part of the side standing flange portion 170 and bending the intermediate formed article 50 by the second die 310 and the second punch 330 to form the second preliminary ridgeline 55 into a part of the floor flange portion 140. In the second press forming, both bending the intermediate formed article 50 by the second die 310 and the second punch 330 to form the first preliminary ridgeline 53 into a part of the side standing flange portion 170 and bending the intermediate formed article 50 by the second die 310 and the second punch 330 to form the second preliminary ridgeline 55 into a part of the floor flange portion 140 may be performed. The second press forming includes bending the intermediate formed article 50 by the second die 310 and the second punch 330 to form the convex flange portion 51 into the inclined flange portion 190.

When the press-formed article 100 includes the upper flange ridgeline portion 194 formed between the inclined flange portion 190 and the side standing flange portion 170 and the lower flange ridgeline portion 192 formed between the inclined flange portion 190 and the floor flange portion 140, in the first press forming, at least one of a portion to be the upper flange ridgeline portion 194 and a portion to be the lower flange ridgeline portion 192 in the convex flange portion 51 may have a flat shape.

Operation and Effect

According to the second embodiment, in the press-formed article 100, the floor flange portion 140 and the side standing flange portion 170 are continuous by the inclined flange portion 190. Further, the floor flange portion 140 and the side standing flange portion 170 extend from the bag-shaped portion 101 and are continuous. As a result, the rigidity of the press-formed article 100 is improved, the resistance force against torsion and crushing increases, and the load transfer capability is also improved.

Further, according to the second embodiment, since the inclined flange portion 190 is formed using the intermediate formed article 50 in which the convex flange portion 51 is formed at the portion where the floor flange portion 140 and the side standing flange portion 170 are continuous in the press-formed article 100, it is possible to eliminate the thickness deviation. That is, by flattening the convex shape of the intermediate formed article 50 once formed with the convex shape, it is possible to suppress the concentration of wrinkles on the inclined flange portion 190 due to the material flow during pressing and to disperse the wrinkles of the inclined flange portion 190. As a result, even when the draw-forming is applied to the press-formed article 100 having the bag-shaped portion 101, concentration of wrinkles generated between the floor flange portion 140 and the side standing flange portion 170 can be suppressed.

The first and second preliminary ridgelines 53 and 55 of the intermediate formed article 50 are bent to form a part of the side standing flange portion 170 and a part of the side floor flange portion 143, respectively. As a result, a range in which wrinkles are dispersed from the inclined flange portion 190 is widened, and wrinkles generated in the inclined flange portion 190 are further suppressed. Furthermore, since the effect of suppressing wrinkles in the inclined flange portion 190 is secured, the line length of the inclined flange portion 190 can be shortened, and the load transfer capability in the press-formed article 100 is further improved.

When the press-formed article 100 in which the length L of the inclined flange portion 190 is relatively small with respect to the height H of the press-formed article 100 is manufactured by the manufacturing method described in the second embodiment, the offset amount T (refer to FIG. 34C) can be set relatively large, and the region between the first preliminary ridgeline 53 and the second preliminary ridgeline 55 of the convex flange portion 51 can be set wider than the region of the inclined flange portion 190. Therefore, the wrinkles generated by the forming of the inclined flange portion 190 can be dispersed in a wide region, and the wrinkle dispersion effect becomes remarkable. Therefore, as the length L of the inclined flange portion 190 is smaller than the height H, the superiority of the method of manufacturing a press-formed article according to the second embodiment over the method of manufacturing a press-formed article according to the first embodiment is improved.

According to the second embodiment, the bag-shaped portion 101 including the peripheral wall portion 120 of the press-formed article 100 is formed by draw-forming. In addition, the standing flange portion 160 including the convex flange portion 51 and the side standing flange portion 170 is formed by bend-forming. As described above, the press-formed article 100 which has the bag-shaped portion 101 and in which the floor flange portion 140 and the side standing flange portion 170 are continuous is formed by a combination of the draw-forming and the bend-forming, which cannot be realized only by bend-forming.

According to the second embodiment, the convex flange portion 51 has a step shape in a side view. Since the convex flange portion 51 has the step shape, the line length of the convex flange portion 51 in side view is sufficiently secured, and the wrinkles are effectively dispersed during the second press forming.

In the second embodiment, the intermediate formed article 50 is provided with both the first and second preliminary ridgelines 53 and 55, and the first and second preliminary ridgelines 53 and 55 are formed as the side standing flange portion 170 and the side floor flange portion 143, respectively. However, the present invention is not limited to this. For example, the intermediate formed article 50 may be provided with either the first preliminary ridgeline 53 or the second preliminary ridgeline 55, and either the first preliminary ridgeline 53 or the second preliminary ridgeline 55 may be formed as the side standing flange portion 170 and the side floor flange portion 143, respectively. One embodiment of the present invention has been described above.

Example 2

In order to confirm the effects of the manufacturing method, the press-formed article 100, and the press forming apparatus according to the present invention, characteristics of the press-formed article 100 formed by applying the manufacturing method according to the second embodiment were evaluated with respect to the suppression of the influence of wrinkles.

Specifically, simulation calculation assuming the manufacturing method according to the second embodiment was performed, and the sheet thickness reduction rate (sheet reduction rate) in the model shape of the calculation result was used as a guide for generation of wrinkles. The simulation conditions were press forming using a steel sheet having a tensile strength of 440 MPa class and a sheet thickness of about 2.3 mm.

Figure 38:
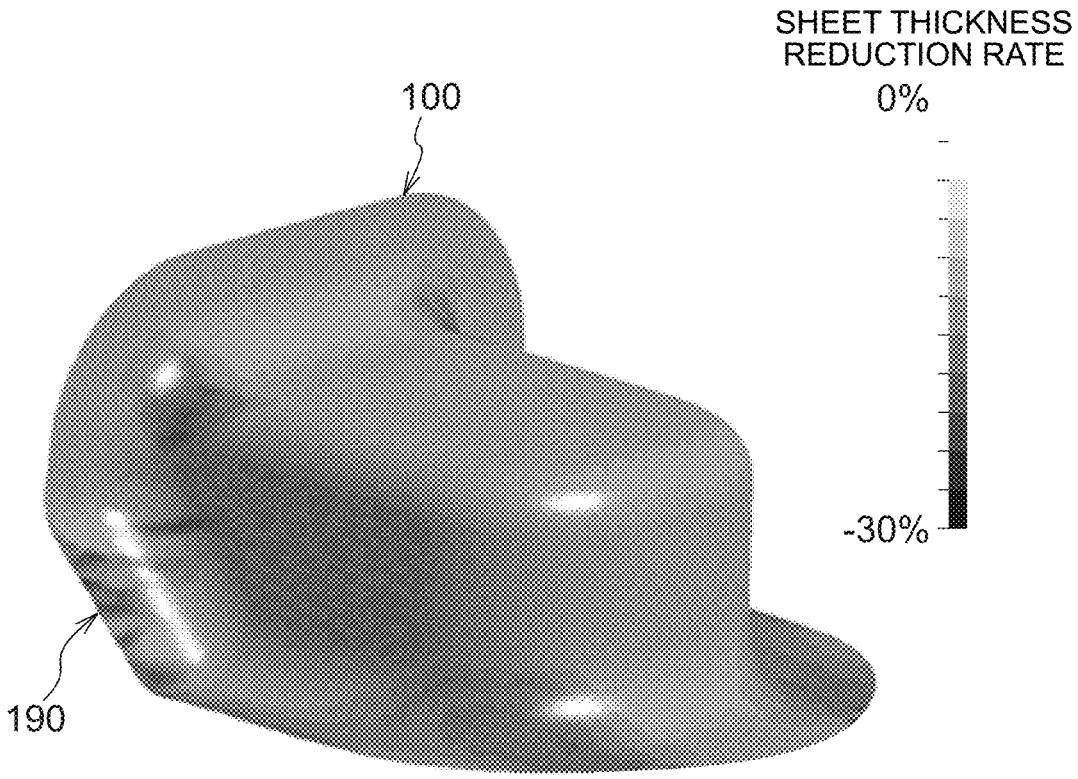
FIG. 38 is a view describing a simulation result as an example.
Figure 39A:
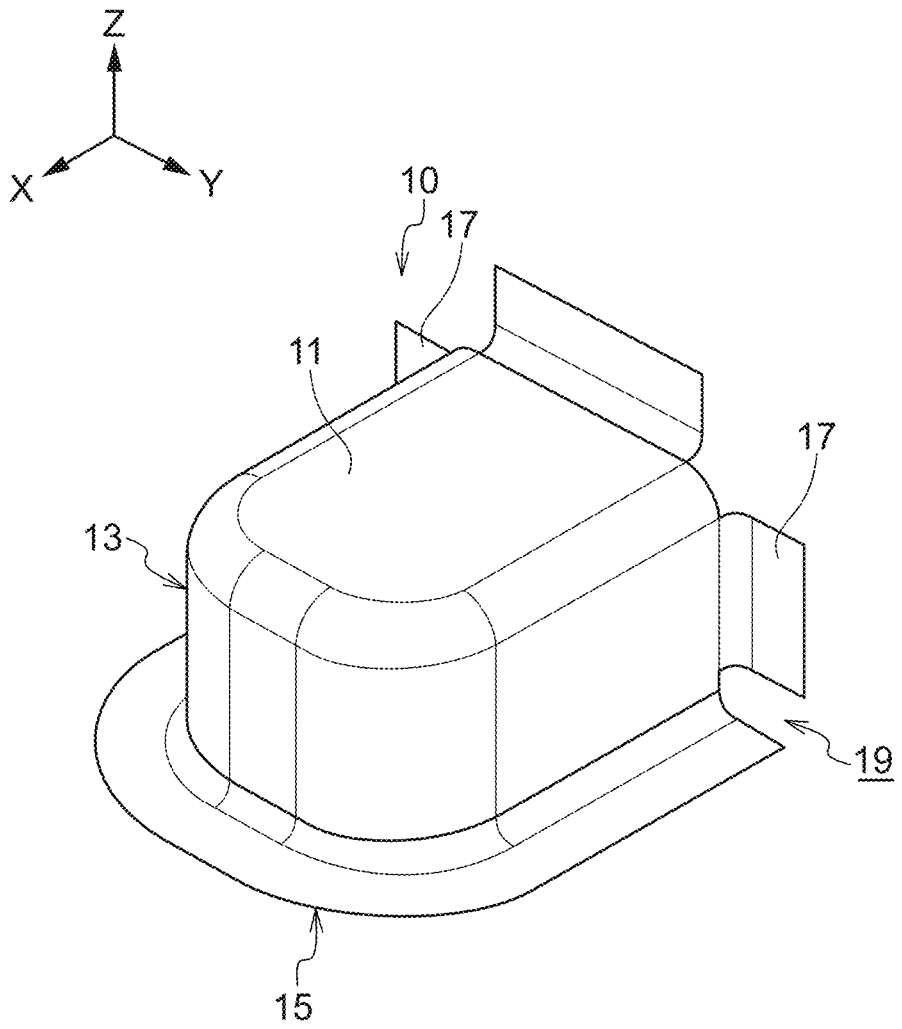
FIG. 39A is a perspective view of a conventional structural member.
Figure 39B:
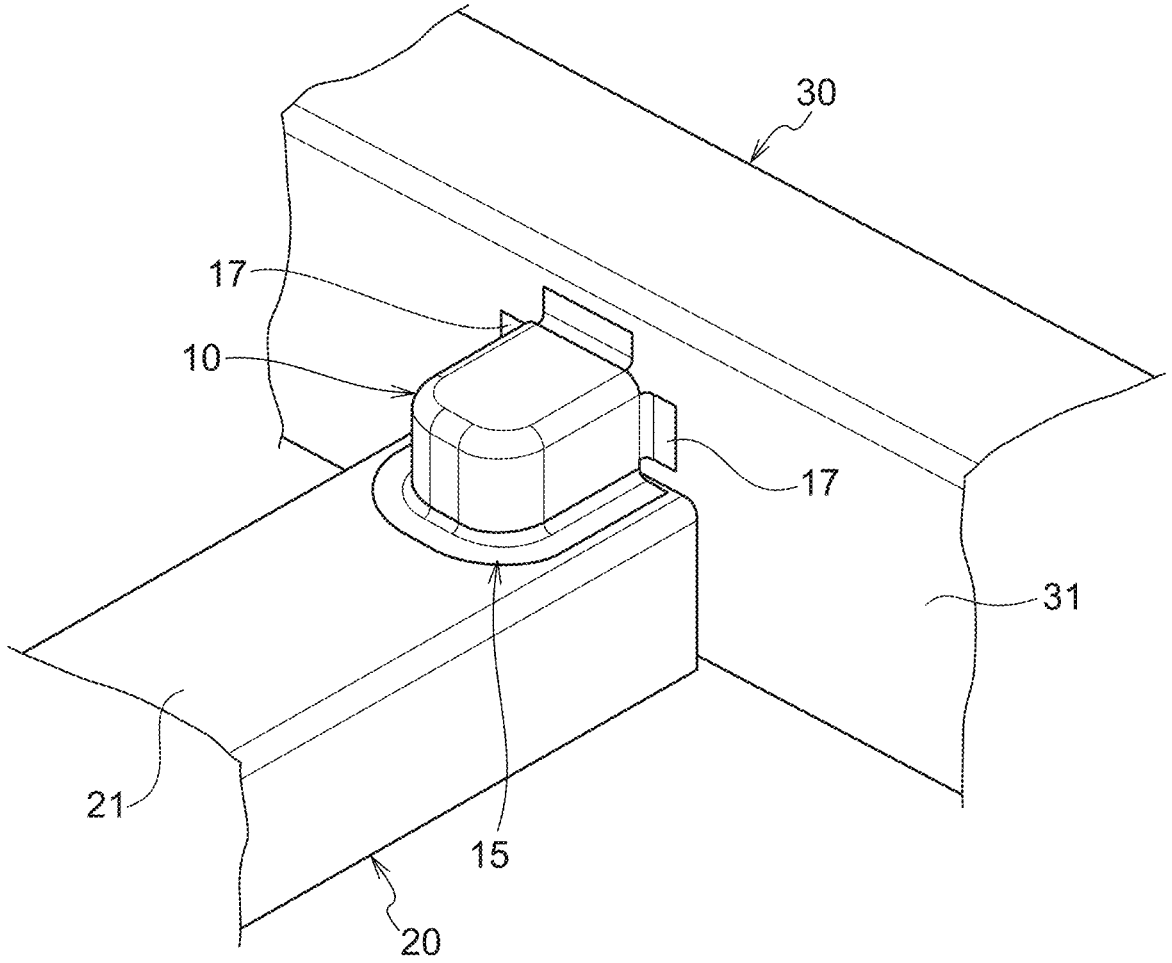
FIG. 39B is a perspective view illustrating a state where a conventional structural member is attached between members.

FIG. 38 is a view illustrating a simulation result of the embodiment. As illustrated in FIG. 38, there was no portion where the sheet thickness reduction rate significantly changed, and wrinkles were dispersed. That is, according to the present example, it was illustrated that the concentration of wrinkles was suppressed. In addition, a region where the sheet thickness reduction rate is the predetermined value or less is wider than that of the reference example, indicating that the concentration of wrinkles is further suppressed.

The preferred embodiments of the present disclosure have been described above in detail with reference to the accompanying drawings, but the present disclosure is not limited to the embodiments. It is obvious that a person having ordinary knowledge in the technical field to which the present disclosure belongs can conceive various modifications or applications within the scope of the technical idea described in the claims, and it is naturally understood that these also belong to the technical scope of the present disclosure.

For example, in the embodiments, an example in which the top sheet portion 110, the peripheral wall portion 120, the floor flange portion 140, and the like are orthogonal to each other has been described, but the present disclosure is not limited to the example. The extending direction of each adjacent portion is not limited to the orthogonal direction, and is appropriately set according to the strength and rigidity required for the press-formed article 100.

In the embodiments, an example in which the top sheet portion 110, the peripheral wall portion 120, the floor flange portion 140, and the like have planar shapes has been described, but the present disclosure is not limited to the example. For example, each of the portions may have partial unevenness, a curved surface, or a partial opening.

In the embodiments, the press-formed article 100 has the ridgeline portion and the corner portion, but the present disclosure is not limited to this example. For example, the top sheet ridgeline portion 130 may not be formed between the top sheet portion 110 and the peripheral wall portion 120, and the top sheet portion 110 and the peripheral wall portion 120 may be directly connected to each other.

The disclosures of Japanese Patent Application No. 2019-143704 and Japanese Patent Application No. 2019-230803 are incorporated herein by reference in their entirety.

REFERENCE SIGNS LIST

1 blank (metal sheet)
50 Intermediate formed article
51 convex flange portion
53 first preliminary ridgeline
55 second preliminary ridgeline
100 press-formed article
101 bag-shaped portion
110 top sheet portion
120 peripheral wall portion
130 top sheet ridgeline portion
133 side top sheet ridgeline portion
140 floor flange portion
143 side floor flange portion

150 floor flange ridgeline portion
160 standing flange portion
170 side standing flange portion
180 central standing flange portion
190 inclined flange portion
200 first die/punch
210 holder
230 first die
250 first punch
253 first punch protrusion forming portion (protrusion)
270 first pad
300 second die/punch
310 second die
315 second die inclined surface portion (inclined surface)
330 second punch
350 second pad
370 second cam
500 press forming apparatus

The invention claimed is:

1. A method of manufacturing a press-formed article including:

a top sheet portion, a peripheral wall portion formed along three peripheral edge portions of the top sheet portion and extending from the peripheral edge portions in a direction intersecting an extending direction of the top sheet portion, a floor flange portion extending outward from an end portion of the peripheral wall portion opposite to an end portion continuous with the top sheet portion in a direction intersecting an extending direction of the peripheral wall portion, a side standing flange portion extending outward from a circumferential end portion of the peripheral wall portion, and an inclined flange portion that is an inclined wall continuous between the side standing flange portion and the floor flange portion, the method comprising:

first press forming; and second press forming, wherein an intermediate formed article is formed from a metal sheet by subjecting the metal sheet to the first press forming including:

moving the metal sheet sandwiched between a first holder and a first die relative to a first punch in a state in which a portion of the metal sheet to be the floor flange portion is sandwiched between the first holder and the first die to perform draw-forming on the metal sheet to form the peripheral wall portion, bending the metal sheet by the metal sheet abutting on a first punch protrusion forming portion provided at the first punch to form a convex flange portion having a convex shape formed at the inclined flange portion, and bending the metal sheet by the metal sheet abutting on the first punch to form at least a side standing flange main body portion located on a side opposite to the inclined flange portion with respect to an end portion on the inclined flange portion side of the side standing flange portion and a floor flange main body portion located on a side opposite to the inclined flange portion with respect to an end portion on the inclined flange portion side of the floor flange portion, and wherein the second press forming includes:

bending the intermediate formed article by a second die and a second punch to form the convex flange portion at the inclined flange portion.

2. The method of manufacturing the press-formed article according to claim 1, wherein:

the press-formed article includes a central standing flange portion extending from an end portion of the top sheet portion where the peripheral wall portion is not formed in the direction intersecting the extending direction of the top sheet portion and opposite to the extending direction of the peripheral wall portion, the central standing flange portion being continuous with the side standing flange portion, and before the draw-forming is performed in the first press forming, a ridgeline between the top sheet portion and the peripheral wall portion on an end portion side where the peripheral wall portion is not formed and a continuous portion between the central standing flange portion and the side standing flange portion are formed in the metal sheet by a first pad and the first punch.

3. The method of manufacturing the press-formed article according to claim 1, wherein the first press forming includes bending the metal sheet to form the convex flange portion having at least one step shape in side view after the first press forming.

4. The method of manufacturing the press-formed article according to claim 1, wherein the first press forming includes bending the metal sheet by the metal sheet abutting on the first punch to form the side standing flange portion and the floor flange portion.

5. The method of manufacturing the press-formed article according to claim 1, wherein:

the first press forming includes bending the metal sheet by the metal sheet abutting on the first punch to form the side standing flange main body portion of the side standing flange portion, a first preliminary ridgeline connecting the side standing flange main body portion and the convex flange portion, the floor flange main body of the floor flange portion, and a second preliminary ridgeline connecting the floor flange main body and the convex flange portion, and the second press forming includes at least one of bending the intermediate formed article by the second die and the second punch to form the first preliminary ridgeline into a part of the side standing flange portion or bending the intermediate formed article by the second die and the second punch to form the second preliminary ridgeline into a part of the floor flange portion.

6. The method of manufacturing the press-formed article according to claim 5, wherein the second press forming includes bending the first preliminary ridgeline to form a part of the side standing flange portion and bending the second preliminary ridgeline to form a part of the floor flange portion by the second die and the second punch.

7. The method of manufacturing the press-formed article according to claim 5, wherein:

the press-formed article includes an upper flange ridgeline formed between the inclined flange portion and the side standing flange portion and a lower flange ridgeline formed between the inclined flange portion and the floor flange portion, and in the first press forming, at least one of a portion to be the upper flange ridgeline or a portion to be the lower flange ridgeline is formed into a flat shape in the convex flange portion.

8. A press forming apparatus for obtaining a press-formed article including:

a top sheet portion, a peripheral wall portion formed along three peripheral edge portions of the top sheet portion and extending from the peripheral edge portions in a direction intersecting an extending direction of the top sheet portion, a floor flange portion extending outward from an end portion of the peripheral wall portion opposite to an end portion continuous with the top sheet portion in a direction intersecting an extending direction of the peripheral wall portion, a side standing flange portion extending outward from a circumferential end portion of the peripheral wall portion, and an inclined flange portion that is an inclined wall continuous between the side standing flange portion and the floor flange portion, the press forming apparatus comprising:

a first holder having a portion abutting on a region to be the floor flange portion on one surface of a metal sheet;

a first die including a portion abutting on a region to be the floor flange portion on another surface of the metal sheet, a portion sandwiching the metal sheet between the first holder and the first die, and a portion abutting on a region to be the peripheral wall portion of the metal sheet;

a first punch, the first punch including a first punch peripheral wall forming portion that abuts on a region to be the peripheral wall portion of the one surface of the metal sheet and performs draw-forming on the metal sheet together with the first die to form the peripheral wall portion, a first punch protrusion forming portion that abuts on a region to be the inclined flange portion of the one surface of the metal sheet and bends the metal sheet together with the first die to form a convex flange portion, a first punch standing flange forming portion that abuts on a region to be the side standing flange portion of the one surface of the metal sheet and bends the metal sheet together with the first die to form at least a side standing flange main body portion located on a side opposite to the inclined flange portion with respect to an end portion of the side standing flange portion on the inclined flange portion side, and a first punch floor flange forming portion that abuts on a region to be the floor flange portion of the one surface of the metal sheet and bends the metal sheet together with the first die to form at least a floor flange main body portion located on a side opposite to the inclined flange portion with respect to an end portion of the floor flange portion on the inclined flange portion side;

a second die including an inclined surface abutting on an other surface of the convex flange portion; and a second punch, the second punch including a second punch inclined surface portion which is provided on the one surface side of the convex flange portion and bends the inclined flange portion from the convex flange portion by sandwiching the convex flange portion with the second die.

9. The press forming apparatus according to claim 8, wherein:

the first punch standing flange forming portion has a shape for bending the side standing flange portion, and the first punch floor flange forming portion has a shape for bending the floor flange portion.

10. The press forming apparatus according to claim 8, wherein:

the first punch standing flange forming portion has a shape for bending the metal sheet to form the side standing flange main body portion of the side standing flange portion, and a first preliminary ridgeline connecting the side standing flange main body portion and the convex flange portion, the first punch floor flange forming portion has a shape for bending the metal sheet to form the floor flange main body portion of the floor flange portion, and a second preliminary ridgeline connecting the floor flange main body portion and the convex flange portion, and the second punch includes at least one of a first bend-forming portion which forms the first preliminary ridgeline at a part of the side standing flange portion with the second die or a second bend-forming portion which forms the second preliminary ridgeline at a part of the floor flange portion with the second die.

* * * * *